US009322248B2

(12) United States Patent
Yeh et al.

(10) Patent No.: US 9,322,248 B2
(45) **Date of Patent: *Apr. 26, 2016**

(54) WELLBORE APPARATUS AND METHODS FOR MULTI-ZONE WELL COMPLETION, PRODUCTION AND INJECTION

(75) Inventors: Charles S. Yeh, Spring, TX (US); Michael D. Barry, The Woodlands, TX (US); Michael T. Hecker, Tomball, TX (US); Tracy J. Moffett, Sugar Land, TX (US); Jon Blacklock, Kuala Lumpur (MY); David C. Haeberle, Cypress, TX (US); Patrick C. Hyde, Hurst, TX (US); Iain M. Macleod, Newmachar (GB); Lee Mercer, Kintore (GB); Stephen Reid, Aberdeen (GB); Andrew J. Elrick, Mintlaw Peterhead (GB)

(73) Assignee: ExxonMobil Upstream Research Company, Houston, TX (US)

( * ) Notice: Subject to any disclaimer, the term of this patent is extended or adjusted under 35 U.S.C. 154(b) by 376 days.

This patent is subject to a terminal disclaimer.

(21) Appl. No.: 13/991,857

(22) PCT Filed: Nov. 17, 2011

(86) PCT No.: PCT/US2011/061225

§ 371 (c)(1),
(2), (4) Date: Jun. 5, 2013

(87) PCT Pub. No.: WO2012/082305

PCT Pub. Date: Jun. 21, 2012

(65) Prior Publication Data

US 2013/0277053 A1 Oct. 24, 2013

Related U.S. Application Data

(60) Provisional application No. 61/424,427, filed on Dec. 17, 2010, provisional application No. 61/549,056, filed on Oct. 19, 2011.

(51) Int. Cl.
*E21B 43/04* (2006.01)
*E21B 43/08* (2006.01)
(Continued)

(52) U.S. Cl.
CPC ..... *E21B 43/04* (2013.01); *E21B 33/124* (2013.01); *E21B 34/063* (2013.01); *E21B 34/14* (2013.01); *E21B 43/045* (2013.01); *E21B 43/08* (2013.01); *E21B 43/14* (2013.01)

(58) Field of Classification Search
CPC ... E21B 33/124; E21B 33/126; E21B 34/063; E21B 34/14; E21B 43/14; E21B 43/04; E21B 43/045; E21B 43/08
See application file for complete search history.

(56) References Cited

U.S. PATENT DOCUMENTS 3,467,183 A * 9/1969 Young ..... 166/121
4,945,991 A 8/1990 Jones
(Continued)

FOREIGN PATENT DOCUMENTS

WO WO 2010120419 A1 * 10/2010

OTHER PUBLICATIONS

Barry, M. D., et al., (2007), "Openhole Gravel Packing with Zonal Isolation," SPE-110460, *SPE Annual Technical Conference and Exhibition*, pp. 1-10.
(Continued)

*Primary Examiner* — Jennifer H Gay
(74) *Attorney, Agent, or Firm* — ExxonMobil Upstream Research-Law Department

(57) ABSTRACT

Completing a wellbore in a subsurface formation with packer assembly having first mechanically-set packer as first zonal isolation tool, and second zonal isolation tool comprises internal bore for receiving production fluids, and alternate flow channels. First packer has alternate flow channels around inner mandrel, and sealing element external to inner mandrel and includes operatively connecting packer assembly to a sand screen, and running into wellbore. First packer set by actuating sealing element into engagement with surrounding open-hole portion of the wellbore. Thereafter, injecting a gravel slurry and further injecting the gravel slurry through the alternate flow channels to allow it to bypass the sealing element, resulting in a gravel packed wellbore within an annular region between sand screen and surrounding formation below packer assembly.

77 Claims, 25 Drawing Sheets

(51) Int. Cl.

| | |
|---|---|
| ***E21B 43/14*** | (2006.01) |
| ***E21B 33/12*** | (2006.01) |
| ***E21B 34/06*** | (2006.01) |
| ***E21B 34/14*** | (2006.01) |
| ***E21B 33/124*** | (2006.01) |

(56) References Cited

U.S. PATENT DOCUMENTS 5,113,935 A 5/1992 Jones et al.
5,348,091 A 9/1994 Tchakarov et al.
5,390,966 A 2/1995 Cox et al.
5,396,954 A 3/1995 Brooks
5,476,143 A 12/1995 Sparlin et al.
5,515,915 A 5/1996 Jones et al.
5,588,487 A 12/1996 Bryant
5,636,689 A 6/1997 Rubbo et al.
5,868,200 A 2/1999 Bryant et al.
5,887,660 A 3/1999 Yokley et al.
5,890,533 A * 4/1999 Jones ..... 166/51
5,909,774 A 6/1999 Griffith et al.
5,975,205 A 11/1999 Carisella
6,003,834 A 12/1999 Read
6,179,056 B1 1/2001 Smith
6,186,227 B1 * 2/2001 Vaynshteyn et al. ..... 166/120
6,220,345 B1 4/2001 Jones et al.
6,227,303 B1 5/2001 Jones
6,298,916 B1 10/2001 Tibbles et al.
6,325,144 B1 12/2001 Turley et al.
6,354,378 B1 3/2002 Patel
6,409,219 B1 6/2002 Broome et al.
6,464,261 B1 10/2002 Dybevik et al.
6,513,599 B1 2/2003 Bixenman et al.
6,516,881 B2 2/2003 Hailey, Jr.
6,520,254 B2 2/2003 Hurst et al.
6,557,634 B2 5/2003 Hailey, Jr. et al.
6,575,251 B2 6/2003 Watson et al.
6,581,689 B2 6/2003 Hailey, Jr.
6,601,646 B2 8/2003 Streich et al.
6,644,404 B2 11/2003 Schultz et al.
6,666,274 B2 12/2003 Hughes
6,695,067 B2 2/2004 Johnson et al.
6,705,402 B2 3/2004 Proctor
6,749,023 B2 6/2004 Nguyen et al.
6,749,024 B2 6/2004 Bixenman
6,752,206 B2 6/2004 Watson et al.
6,752,207 B2 6/2004 Danos et al.
6,755,245 B2 6/2004 Nguyen et al.
6,789,621 B2 9/2004 Wetzel et al.
6,789,623 B2 9/2004 Hill, Jr. et al.
6,789,624 B2 9/2004 McGregor et al.
6,814,139 B2 11/2004 Hejl et al.
6,817,410 B2 11/2004 Wetzel et al.
6,830,104 B2 12/2004 Nguyen et al.
6,883,608 B2 4/2005 Parlar et al.
6,923,262 B2 8/2005 Broome et al.
6,935,432 B2 8/2005 Nguyen
6,983,796 B2 1/2006 Bayne et al.
6,986,390 B2 1/2006 Doane et al.
6,997,263 B2 2/2006 Campbell et al.
7,044,231 B2 5/2006 Doane et al.
7,048,061 B2 5/2006 Bode et al.
7,051,805 B2 5/2006 Doane et al.
7,055,598 B2 6/2006 Ross et al.
7,096,945 B2 8/2006 Richards et al.
7,100,691 B2 9/2006 Nguyen et al.
7,104,324 B2 9/2006 Wetzel et al.
7,147,054 B2 12/2006 Wang et al.
7,152,677 B2 12/2006 Parlar et al.
7,207,383 B2 4/2007 Hurst et al.
7,222,676 B2 5/2007 Patel et al.
7,243,715 B2 7/2007 Wang et al.
7,243,723 B2 7/2007 Surjaatmadja et al.
7,243,724 B2 7/2007 McGregor et al.
7,243,732 B2 7/2007 Richard
7,252,142 B2 8/2007 Brezinski et al.
7,264,061 B2 9/2007 Dybevik et al.
7,278,479 B2 10/2007 Kvernstuen et al.
7,343,983 B2 3/2008 Livingstone
7,363,974 B2 4/2008 Wang et al.
7,367,395 B2 5/2008 Vidrine et al.
7,370,700 B2 5/2008 Hurst et al.
7,373,978 B2 5/2008 Barry et al.
7,392,852 B2 7/2008 Richard
7,407,007 B2 8/2008 Tibbles
7,426,962 B2 9/2008 Moen et al.
7,431,058 B2 10/2008 Holting
7,431,085 B2 10/2008 Coronado et al.
7,431,091 B2 10/2008 Themig et al.
7,431,098 B2 10/2008 Ohmer et al.
7,441,605 B2 10/2008 Coronado et al.
7,464,752 B2 * 12/2008 Dale et al. ..... 166/227
7,493,959 B2 2/2009 Johnson et al.
7,497,267 B2 3/2009 Setterberg, Jr. et al.
7,562,709 B2 7/2009 Saebi et al.
7,584,799 B2 9/2009 Coronado et al.
7,591,321 B2 9/2009 Whitsitt et al.
7,597,141 B2 10/2009 Rouse et al.
7,624,810 B2 12/2009 Fould et al.
7,661,476 B2 2/2010 Yeh et al.
7,681,652 B2 3/2010 Gaudette et al.
7,735,559 B2 6/2010 Malone
7,828,056 B2 11/2010 Dybevik et al.
7,832,472 B2 11/2010 Themig
7,870,898 B2 * 1/2011 Yeh et al. ..... 166/235
7,886,819 B2 2/2011 Setterberg, Jr. et al.
7,938,184 B2 5/2011 Yeh et al.
7,971,642 B2 7/2011 Yeh et al.
8,215,406 B2 7/2012 Dale et al.
8,522,867 B2 * 9/2013 Yeh et al. ..... 166/235
8,752,625 B2 * 6/2014 Tibbles ..... 166/278
8,789,612 B2 * 7/2014 Haeberle et al. ..... 166/387
8,839,861 B2 * 9/2014 Yeh et al. ..... 166/278
9,133,705 B2 * 9/2015 Angeles Boza et al. ..... 43/4
2003/0127227 A1 7/2003 Fehr et al.
2003/0173075 A1 9/2003 Morvant et al.
2004/0007829 A1 1/2004 Ross
2004/0140089 A1 7/2004 Gunneroed
2005/0028977 A1 2/2005 Ward
2005/0039917 A1 2/2005 Hailey, Jr.
2005/0061501 A1 3/2005 Ward et al.
2005/0082060 A1 4/2005 Ward et al.
2005/0241855 A1 11/2005 Wylie et al.
2005/0263287 A1 12/2005 Achee, Jr. et al.
2006/0237197 A1 * 10/2006 Dale et al. ..... 166/378
2007/0044962 A1 * 3/2007 Tibbles ..... 166/278
2007/0056750 A1 3/2007 John et al.
2008/0066900 A1 * 3/2008 Saebi et al. ..... 166/51
2008/0125335 A1 5/2008 Bhavsar
2008/0128126 A1 6/2008 Dagenais et al.
2008/0128129 A1 * 6/2008 Yeh et al. ..... 166/275
2008/0142222 A1 6/2008 Howard et al.
2008/0142227 A1 * 6/2008 Yeh et al. ..... 166/369
2008/0314589 A1 12/2008 Guignard et al.
2009/0008084 A1 1/2009 Dybevik et al.
2009/0008092 A1 * 1/2009 Haeberle et al. ..... 166/278
2009/0084556 A1 4/2009 Richards et al.
2009/0159279 A1 6/2009 Assal
2009/0159298 A1 6/2009 Assal
2009/0283279 A1 11/2009 Patel et al.
2009/0294128 A1 * 12/2009 Dale et al. ..... 166/306
2009/0308592 A1 12/2009 Mercer et al.
2010/0032158 A1 2/2010 Dale et al.
2010/0059223 A1 * 3/2010 Langlais et al. ..... 166/276
2010/0065284 A1 3/2010 Freyer
2010/0096119 A1 4/2010 Sevre et al.
2010/0147538 A1 6/2010 Gaudette et al.
2010/0155064 A1 6/2010 Nutley et al.
2010/0218948 A1 9/2010 Mickelburgh et al.
2010/0243270 A1 * 9/2010 Ingram et al. ..... 166/377
2010/0252252 A1 10/2010 Harris et al.
2011/0042106 A1 2/2011 MacLeod
2011/0203793 A1 * 8/2011 Tibbles ..... 166/278
2011/0209873 A1 * 9/2011 Stout ..... 166/320
2011/0240290 A1 * 10/2011 Jasek et al. ..... 166/278

(56) References Cited

U.S. PATENT DOCUMENTS

| | | | | |
|---|---|---|---|---|
| 2011/0284208 | A1 | 11/2011 | MacLeod et al. | |
| 2012/0018153 | A1 | 1/2012 | Yeh et al. | |
| 2012/0217010 | A1* | 8/2012 | Haeberle et al. | 166/278 |
| 2013/0000899 | A1* | 1/2013 | Broussard et al. | 166/278 |
| 2013/0248172 | A1* | 9/2013 | Angeles Boza et al. | 166/250.01 |
| 2013/0248178 | A1* | 9/2013 | Hecker et al. | 166/278 |
| 2013/0248179 | A1* | 9/2013 | Yeh et al. | 166/278 |
| 2013/0255943 | A1* | 10/2013 | Yeh et al. | 166/278 |
| 2013/0277053 | A1* | 10/2013 | Yeh et al. | 166/278 |
| 2015/0218909 | A1* | 8/2015 | Yeh et al. | 34/12 |
| 2015/0233215 | A1* | 8/2015 | Yeh et al. | 43/45 |

OTHER PUBLICATIONS

Hecker, M. T., et al., (2004), "Reducing Well Cost by Gravel Packing in Nonaqueous Fluid," SPE-90758, *SPE AnnualTechnical Conference and Exhibition*, pp. 1-7.

Hecker, M. T., et al., (2010), Extending Openhole Gravel Packing Capability: Initial Field Installation of Internal Shunt Alternate Path Technology, SPE-135102, *SPE AnnualTechnical Conference and Exhibition*, pp. 1-6.

Hurst, G., et al., (2004), "Alternate Path Completions: A Critical Review and Lessons Learned From Case Histories With Recommended Practices for Deepwater Applications", SPE-86532, *SPE Internatinal Symposium and Exhibition*, pp. 1-14.

* cited by examiner

WELLBORE APPARATUS AND METHODS FOR MULTI-ZONE WELL COMPLETION, PRODUCTION AND INJECTION

CROSS REFERENCE TO RELATED APPLICATIONS

This application is the National Stage of International Application No. PCT/US2011/061225, filed 17 Nov. 2011, which claims the benefit of U.S. Provisional Application No. 61/424,427, filed 17 Dec. 2010 and U.S. Provisional Application No. 61/549,056, filed 19 Oct. 2011, the entirety of which is incorporated herein by reference for all purposes.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of well completions. More specifically, the present invention relates to the isolation of formations in connection with wellbores that have been completed using gravel-packing. The application also relates to a downhole packer that may be set within either a cased hole or an open-hole wellbore and which incorporates alternate flow channel technology.

DISCUSSION OF TECHNOLOGY

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the formation. A cementing operation is typically conducted in order to fill or "squeeze" the annular area with cement. The combination of cement and casing strengthens the wellbore and facilitates the isolation of the formation behind the casing.

It is common to place several strings of casing having progressively smaller outer diameters into the wellbore. The process of drilling and then cementing progressively smaller strings of casing is repeated several times until the well has reached total depth. The final string of casing, referred to as a production casing, is cemented in place and perforated. In some instances, the final string of casing is a liner, that is, a string of casing that is not tied back to the surface.

As part of the completion process, a wellhead is installed at the surface. The wellhead controls the flow of production fluids to the surface, or the injection of fluids into the wellbore. Fluid gathering and processing equipment such as pipes, valves and separators are also provided. Production operations may then commence.

It is sometimes desirable to leave the bottom portion of a wellbore open. In open-hole completions, a production casing is not extended through the producing zones and perforated; rather, the producing zones are left uncased, or "open." A production string or "tubing" is then positioned inside the wellbore extending down below the last string of casing and across a subsurface formation.

There are certain advantages to open-hole completions versus cased-hole completions. First, because open-hole completions have no perforation tunnels, formation fluids can converge on the wellbore radially 360 degrees. This has the benefit of eliminating the additional pressure drop associated with converging radial flow and then linear flow through particle-filled perforation tunnels. The reduced pressure drop associated with an open-hole completion virtually guarantees that it will be more productive than an unstimulated, cased hole in the same formation.

Second, open-hole techniques are oftentimes less expensive than cased hole completions. For example, the use of gravel packs eliminates the need for cementing, perforating, and post-perforation clean-up operations.

A common problem in open-hole completions is the immediate exposure of the wellbore to the surrounding formation. If the formation is unconsolidated or heavily sandy, the flow of production fluids into the wellbore may carry with it formation particles, e.g., sand and fines. Such particles can be erosive to production equipment downhole and to pipes, valves and separation equipment at the surface.

To control the invasion of sand and other particles, sand control devices may be employed. Sand control devices are usually installed downhole across formations to retain solid materials larger than a certain diameter while allowing fluids to be produced. A sand control device typically includes an elongated tubular body, known as a base pipe, having numerous slotted openings. The base pipe is then typically wrapped with a filtration medium such as a screen or wire mesh.

To augment sand control devices, particularly in open-hole completions, it is common to install a gravel pack. Gravel packing a well involves placing gravel or other particulate matter around the sand control device after the sand control device is hung or otherwise placed in the wellbore. To install a gravel pack, a particulate material is delivered downhole by means of a carrier fluid. The carrier fluid with the gravel together forms a gravel slurry. The slurry dries in place, leaving a circumferential packing of gravel. The gravel not only aids in particle filtration but also helps maintain formation integrity.

In an open-hole gravel pack completion, the gravel is positioned between a sand screen that surrounds a perforated base pipe and a surrounding wall of the wellbore. During production, formation fluids flow from the subterranean formation, through the gravel, through the screen, and into the inner base pipe. The base pipe thus serves as a part of the production string.

A problem historically encountered with gravel-packing is that an inadvertent loss of carrier fluid from the slurry during the delivery process can result in premature sand or gravel bridges being formed at various locations along open-hole intervals. For example, in an inclined production interval or an interval having an enlarged or irregular borehole, a poor distribution of gravel may occur due to a premature loss of carrier fluid from the gravel slurry into the formation. Premature sand bridging can block the flow of gravel slurry, causing voids to form along the completion interval. Thus, a complete gravel-pack from bottom to top is not achieved, leaving the wellbore exposed to sand and fines infiltration.

The problems of sand bridging and of bypassing zonal isolation have been addressed through the use of Alternate Path® Technology, or "APT." Alternate Path® Technology employs shunt tubes (or shunts) that allow the gravel slurry to bypass selected areas along a wellbore. Such fluid bypass technology is described, for example, in U.S. Pat. No. 5,588,487 entitled "Tool for Blocking Axial Flow in Gravel-Packed Well Annulus," and PCT Publication No. WO2008/060479 entitled "Wellbore Method and Apparatus for Completion, Production, and Injection," each of which is incorporated herein by reference in its entirety. Additional references which discuss alternate flow channel technology include U.S. Pat. Nos. 4,945,991; 5,113,935; 7,661,476; and M. D. Barry, et al., "Open-hole Gravel Packing with Zonal Isolation," SPE Paper No. 110,460 (November 2007).

The efficacy of a gravel pack in controlling the influx of sand and fines into a wellbore is well-known. However, it is also sometimes desirable with open-hole completions to isolate selected intervals along the open-hole portion of a wellbore in order to control the inflow of fluids. For example, in connection with the production of condensable hydrocarbons, water may sometimes invade an interval. This may be due to the presence of native water zones, coning (rise of near-well hydrocarbon-water contact), high permeability streaks, natural fractures, or fingering from injection wells. Depending on the mechanism or cause of the water production, the water may be produced at different locations and times during a well's lifetime. Similarly, a gas cap above an oil reservoir may expand and break through, causing gas production with oil. The gas breakthrough reduces gas cap drive and suppresses oil production.

In these and other instances, it is desirable to isolate an interval from the production of formation fluids into the wellbore. Annular zonal isolation may also be desired for production allocation, production/injection fluid profile control, selective stimulation, or water or gas control. However, the design and installation of open-hole packers is highly problematic due to under-reamed areas, areas of washout, higher pressure differentials, frequent pressure cycling, and irregular borehole sizes. In addition, the longevity of zonal isolation is a consideration as the water/gas coning potential often increases later in the life of a field due to pressure drawdown and depletion.

Therefore, a need exists for an improved sand control system that provides fluid bypass technology for the placement of gravel that bypasses a packer. A need further exists for a packer assembly that provides isolation of selected subsurface intervals along an open-hole wellbore. Further, a need exists for a packer that utilizes alternate flow channels, and that provides a hydraulic seal to an open-hole wellbore before any gravel is placed around the sealing element.

SUMMARY OF THE INVENTION

An gravel pack zonal isolation apparatus for a wellbore is first provided herein. The zonal isolation apparatus has particular utility in connection with the placement of a gravel pack within an open-hole portion of the wellbore. The open-hole portion extends through one, two, or more subsurface intervals.

In one embodiment, the zonal isolation apparatus first includes a sand control device. The sand control device includes a base pipe. The base pipe defines a tubular member having a first end and a second end. Preferably, the zonal isolation apparatus further comprises a filter medium surrounding the base pipe along a substantial portion of the base pipe. Together, the base pipe and the filter medium form a sand screen.

The sand screen is arranged to have alternate flow path technology. In this respect, the sand screen includes at least one alternate flow channel to bypass the base pipe. The channels extend from the first end to the second end.

The zonal isolation apparatus also includes at least one and, optionally, at least two packer assemblies. Each packer assembly comprises at least two mechanically-set packers. These represent an upper packer element and a lower packer element. The upper and lower packer elements may be about 6 inches (15.2 cm) to 24 inches (61.0 cm) in length.

Intermediate the at least two mechanically set packers is at least one swellable packer element. The swellable packer element is preferably about 3 feet (0.91 meters) to 40 feet (12.2 meters) in length. In one aspect, the swellable packer element is fabricated from an elastomeric material. The swellable packer element is actuated over time in the presence of a fluid such as water, gas, oil, or a chemical. Swelling may take place, for example, should one of the mechanically set packer elements fails. Alternatively, swelling may take place over time as fluids in the formation surrounding the swellable packer element contact the swellable packer element.

The swellable packer element preferably swells in the presence of an aqueous fluid. In one aspect, the swellable packer element may include an elastomeric material that swells in the presence of hydrocarbon liquids or an actuating chemical. This may be in lieu of or in addition to an elastomeric material that swells in the presence of an aqueous fluid.

The zonal isolation apparatus also includes one or more alternate flow channels. The alternate flow channels are disposed outside of the base pipe and along the various packer elements within each packer assembly. The alternate flow channels serve to divert gravel pack slurry from an upper interval to one or more lower intervals during a gravel packing operation.

In one embodiment, the elongated base pipe comprises multiple joints of pipe connected end-to-end to form the first end of the sand control device and a second end of the sand control device. The zonal isolation apparatus may then comprise an upper packer assembly placed at the first end of the sand control device, and a lower packer assembly placed at the second end of the sand control device. The upper packer assembly and the lower packer assembly are spaced apart along the joints of pipe so as to straddle a selected subsurface interval within a wellbore.

The first and second mechanically-set packers are uniquely designed to be set within the open-hole portion of the wellbore before a gravel packing operation begins. To this end, a specially-designed downhole packer is offered herein, which may be used with the packer assembly and the methods herein. The downhole packer seals an annular region between a tubular body and a surrounding wellbore. The wellbore may be a cased hole, meaning that a string of production casing has been perforated. Alternatively, the wellbore may be completed as an open hole.

In one embodiment, each downhole packer comprises an inner mandrel, at least one alternate flow channel along the inner mandrel, and a sealing element external to the inner mandrel. The sealing element resides circumferentially around the inner mandrel.

Each downhole packer may further include a movable piston housing. The piston housing is initially fixed around the inner mandrel. The piston housing has a pressure-bearing surface at a first end, and is operatively connected to the sealing element. The piston housing may be released and caused to move along the inner mandrel. Movement of the piston housing actuates the sealing element into engagement with the surrounding open-hole wellbore.

Preferably, each packer further includes a piston mandrel. The piston mandrel is disposed between the inner mandrel and the surrounding piston housing. An annulus is preserved between the inner mandrel and the piston mandrel. The annulus beneficially serves as the at least one alternate flow channel.

Each packer may also include one or more flow ports. The flow ports provide fluid communication between the alternate flow channel and the pressure-bearing surface of the piston housing. The flow ports are sensitive to hydrostatic pressure within the wellbore.

In one embodiment, each downhole packer also includes a release sleeve. The release sleeve resides along an inner surface of the inner mandrel. Further, each packer includes a release key. The release key is connected to the release sleeve. The release key is movable between a retaining position wherein the release key engages and retains the moveable piston housing in place, to a releasing position wherein the release key disengages the piston housing. When disengaged, hydrostatic pressure acts against the pressure-bearing surface of the piston housing and moves the piston housing along the inner mandrel to actuate the sealing element.

In one aspect, each packer also has at least one shear pin. The at least one shear pin may be one or more set screws. The shear pin or pins releasably connects the release sleeve to the release key. The shear pin or pins is sheared when a setting tool is pulled up the inner mandrel and slides the release sleeve. Thus, each packer is a mechanically-set packer.

In one embodiment, each downhole packer also has a centralizer. The centralizer has extendable fingers. The fingers extend radially in response to movement of the piston housing. The centralizer is disposed around the inner mandrel between the piston housing and the sealing element. The downhole packer is preferably configured so that force applied by the piston housing against the centralizer also actuates the sealing element against the surrounding wellbore.

A method for completing a wellbore in a subsurface formation is also provided herein. The wellbore preferably includes a lower portion completed as an open-hole. In one aspect, the method includes providing a packer. The packer may be in accordance with the mechanically-set packer described above. For example, the packer will have an inner mandrel, alternate flow channels around the inner mandrel, and a sealing element external to the inner mandrel. The sealing element is preferably an elastomeric cup-type element.

The method also includes connecting the packer to a sand screen, and then running the packer and connected sand screen into the wellbore. The packer and connected sand screen are placed along the open-hole portion (or other production interval) of the wellbore.

The sand screen comprises a base pipe and a surrounding filter medium. The base pipe may be made up of a plurality of joints. The packer may be connected between two of the plurality of joints of the base pipe. Alternatively, the packer may be placed between a sand screen joint and a swellable packer element.

The method also includes setting the packer. This is done by actuating the sealing element of the packer into engagement with the surrounding open-hole portion of the wellbore. Thereafter, the method includes injecting a gravel slurry into an annular region formed between the sand screen and the surrounding open-hole portion of the wellbore, and then further injecting the gravel slurry through the alternate flow channels to allow the gravel slurry to bypass the packer. In this way, the open-hole portion of the wellbore is gravel-packed above and below the packer after the packer has been set in the wellbore.

In the method, it is preferred that the packer is a first mechanically-set packer that is part of a packer assembly. In this instance, the first mechanically-set packer is a first zonal isolation tool, and is part of a packer assembly that includes a second zonal isolation tool. The second zonal isolation tool may be a second mechanically-set packer that is constructed in accordance with the first mechanically-set packer. Alternatively, the second zonal isolation tool may be a gravel-based zonal isolation tool. Alternatively or in addition, the second zonal isolation tool may comprise a swellable packer intermediate the first and a second mechanically-set packer. The swellable packer has alternate flow channels aligned with the alternate flow channels of the first and second mechanically-set packers.

The step of further injecting the gravel slurry through the alternate flow channels allows the gravel slurry to bypass the packer assembly so that the open-hole portion of the wellbore is gravel-packed above and below the packer assembly after the first and second mechanically-set packers have been set in the wellbore.

The method may further include running a setting tool into the inner mandrel of the packers, and releasing the movable piston housing in each packer from its fixed position. The method then includes applying hydrostatic pressure to the piston housing through the one or more flow ports. Applying hydrostatic pressure moves the released piston housing and actuates the sealing element against the surrounding wellbore.

It is preferred that the setting tool is part of a washpipe used for gravel packing. In this instance, running the setting tool comprises running a washpipe into a bore within the inner mandrel of the packer, with the washpipe having a setting tool thereon. The step of releasing the movable piston housing from its fixed position then comprises pulling the washpipe with the setting tool along the inner mandrel of each packer. This serves to shear the at least one shear pin and shift the release sleeves in the respective packers.

The method may also include producing hydrocarbon fluids from at least one interval along the open-hole portion of the wellbore.

An alternate method for completing a wellbore is also provided herein. The wellbore again has a lower end defining an open-hole portion. In one aspect, the method includes running a gravel pack zonal isolation apparatus into the wellbore. The zonal isolation apparatus is generally in accordance with the zonal isolation apparatus described above, in its various embodiments. The zonal isolation apparatus will include the intermediate swellable packer element.

Next, the zonal isolation apparatus is hung in the wellbore. The apparatus is positioned such that one of the at least one packer assembly is positioned above or proximate the top of a selected subsurface interval. Alternatively, the at least one packer assembly is positioned proximate the interface of two adjacent subsurface intervals. Then, the mechanically set packers in each of the at least one packer assembly are set. This means that sealing elements in the mechanically-set packer elements are actuated into engagement with the surrounding open-hole portion of the wellbore.

The method also includes injecting a particulate slurry into an annular region formed between the sand screen and the surrounding subsurface formation. The particulate slurry is commonly made up of a carrier fluid and sand (and/or other) particles. The one or more alternate flow channels of the zonal isolation apparatus allow the particulate slurry to travel through or around the mechanically set packer elements and the intermediate swellable packer element. In this way, the open-hole portion of the wellbore is gravel packed above and below (but not between) the mechanically set packer elements. Further, the gravel may be placed along the open-hole portion of the wellbore after the mechanically-set packers have been set.

In one embodiment, the method includes running a setting tool into the inner mandrel of the first and second mechanically-set packers, and moving the setting tool along the inner mandrels. This releases the movable piston housing on each of the first and second mechanically-set packers. The method then includes applying hydrostatic pressure to the piston housing through the one or more flow ports. This serves to move the respective piston housings and to actuate the respective upper and lower sealing elements into engagement against the surrounding wellbore.

The method also includes producing production fluids from one or more production intervals along the open-hole portion of the wellbore. Production takes place for a period of time. Over the period of time, the upper packer, the lower packer, or both, may fail, permitting the inflow of fluids into an intermediate portion of the packer along the swellable packer element. Alternatively, the intermediate swellable packer may come into contact with formation fluids or an actuating chemical. In either instance, contact with fluids will cause the swellable packer element to swell, thereby providing a long term seal beyond the life of the mechanically set packers.

Additional steps may be taken to isolate subsurface intervals along the open-hole portion of the wellbore. For example, a straddle packer may be placed within the base pipe of the sand screen joints along an intermediate interval. The straddle packer straddles packer assemblies placed near upper and lower formation interfaces for the intermediate interval. In this way, formation fluids in the intermediate interval are sealed from entering the wellbore.

Alternatively, a plug may be placed within the base pipe of the sand screen joints above a lower interval. The plug is placed at the same depth as a packer assembly proximate the top of the lower interval. In this way, formation fluids in the lower interval are sealed from entering the wellbore.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

FIG. 10A provides a side view of a portion of a sand screen disposed along an open hole portion of a wellbore.

FIG. 10B is a cross-sectional view of the sand screen of FIG. 10A, taken across line 10B-10B of FIG. 10A. Alternate flow channels are seen internal to the screen.

FIG. 10C is another cross-sectional view of the sand screen of FIG. 10A. This view is taken across line 10C-10C of FIG. 10A.

FIG. 10D is a third cross-sectional view of the sand screen of FIG. 10A. This view is taken across line 10D-10D of FIG. 10A.

FIG. 11A provides a side view of a portion of the sand control device as may be placed along an open hole portion of a wellbore. The illustrative inflow control device is a choke at one end of the screen. A swellable packer is provided at the other end of the screen for fluid control.

FIG. 11B is a cross-sectional view of the sand control device of FIG. 11A, taken across line B-B of FIG. 11A. Alternate flow channels are seen internal to the screen.

FIG. 11C is another cross-sectional view of the sand control device of FIG. 11A, taken across line C-C.

FIG. 11D is a third cross-sectional view of the sand control device, taken across line D-D of FIG. 11A.

FIG. 11E is still another cross-sectional view of the sand control device of FIG. 11A, taken across line E-E of FIG. 11A.

FIG. 11F is another side view of the sand control device of FIG. 11A. Here, the swellable packer has been actuated and blocks annular flow at one end of the sand screen.

FIG. 11G is a cross-sectional view of the sand control device of FIG. 11F, taken across line G-G of FIG. 11F. The swellable packer is seen filling an annular region between the base pipe and the surrounding screen.

DETAILED DESCRIPTION OF CERTAIN EMBODIMENTS

Definitions

Figure 1:
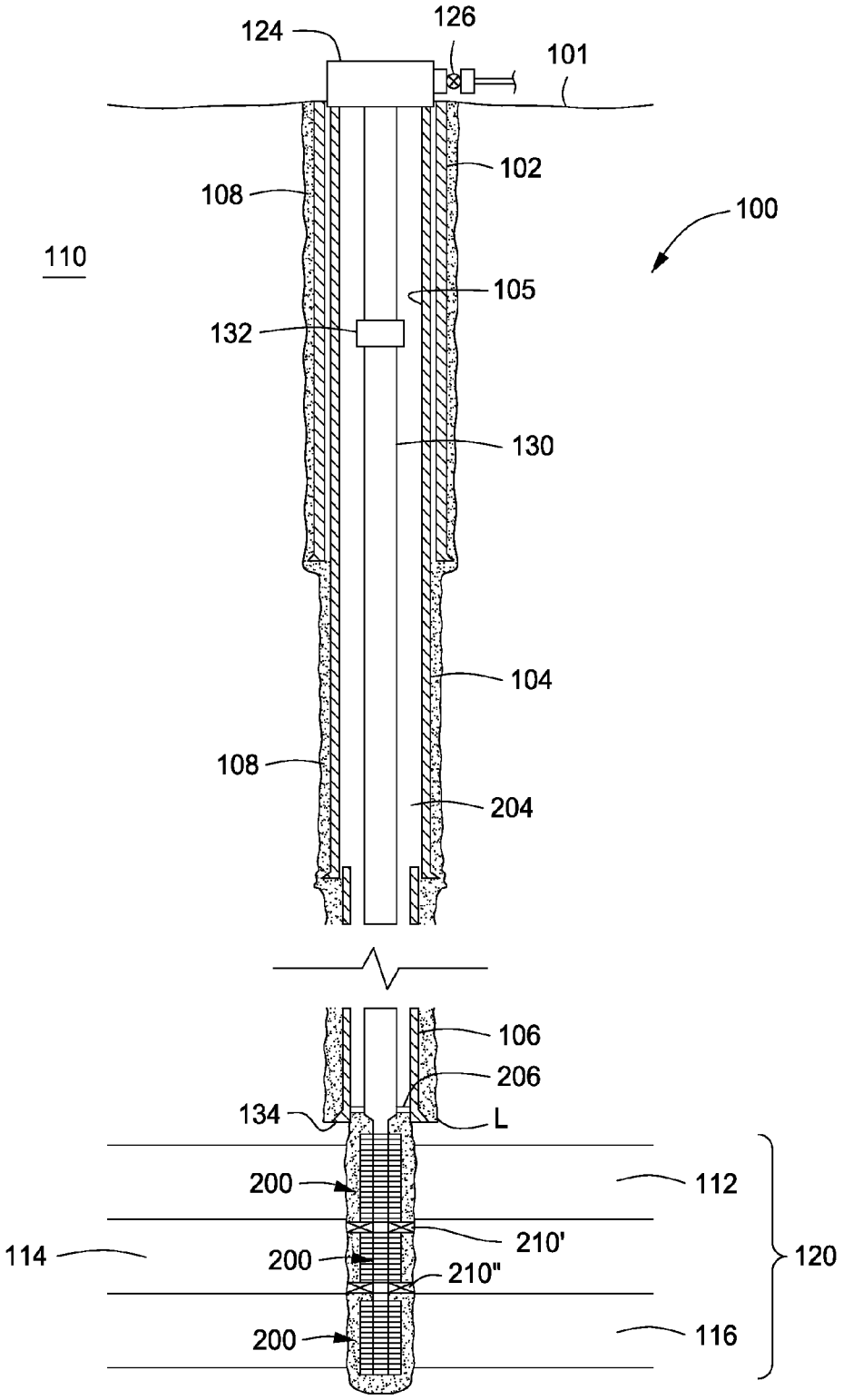
FIG. 1 is a cross-sectional view of an illustrative wellbore. The wellbore has been drilled through three different subsurface intervals, each interval being under formation pressure and containing fluids.

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "subsurface" refers to geologic strata occurring below the earth's surface.

The term "subsurface interval" refers to a formation or a portion of a formation wherein formation fluids may reside. The fluids may be, for example, hydrocarbon liquids, hydrocarbon gases, aqueous fluids, or combinations thereof.

As used herein, the term "wellbore" refers to a hole in the subsurface made by drilling or insertion of a conduit into the subsurface. A wellbore may have a substantially circular cross section, or other cross-sectional shape. As used herein, the term "well", when referring to an opening in the formation, may be used interchangeably with the term "wellbore."

The term "tubular member" refers to any pipe, such as a joint of casing, a portion of a liner, or a pup joint.

The term "sand control device" means any elongated tubular body that permits an inflow of fluid into an inner bore or a base pipe while filtering out predetermined sizes of sand, fines and granular debris from a surrounding formation. A sand screen is an example of a sand control device.

The term "alternate flow channels" means any collection of manifolds and/or shunt tubes that provide fluid communication through or around a tubular wellbore tool to allow a gravel slurry to by-pass the wellbore tool or any premature sand bridge in the annular region and continue gravel packing further downstream. Examples of such wellbore tools include (i) a packer having a sealing element, (ii) a sand screen or slotted pipe, and (iii) a blank pipe, with or without an outer protective shroud.

Description of Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

Certain aspects of the inventions are also described in connection with various figures. In certain of the figures, the top of the drawing page is intended to be toward the surface, and the bottom of the drawing page toward the well bottom. While wells commonly are completed in substantially vertical orientation, it is understood that wells may also be inclined and or even horizontally completed. When the descriptive terms "up and down" or "upper" and "lower" or similar terms are used in reference to a drawing or in the claims, they are intended to indicate relative location on the drawing page or with respect to claim terms, and not necessarily orientation in the ground, as the present inventions have utility no matter how the wellbore is orientated.

FIG. 1 is a cross-sectional view of an illustrative wellbore 100. The wellbore 100 defines a bore 105 that extends from a surface 101, and into the earth's subsurface 110. The wellbore 100 is completed to have an open-hole portion 120 at a lower end of the wellbore 100. The wellbore 100 has been formed for the purpose of producing hydrocarbons for commercial sale. A string of production tubing 130 is provided in the bore 105 to transport production fluids from the open-hole portion 120 up to the surface 101.

The wellbore 100 includes a well tree, shown schematically at 124. The well tree 124 includes a shut-in valve 126. The shut-in valve 126 controls the flow of production fluids from the wellbore 100. In addition, a subsurface safety valve 132 is provided to block the flow of fluids from the production tubing 130 in the event of a rupture or catastrophic event above the subsurface safety valve 132. The wellbore 100 may optionally have a pump (not shown) within or just above the open-hole portion 120 to artificially lift production fluids from the open-hole portion 120 up to the well tree 124.

The wellbore 100 has been completed by setting a series of pipes into the subsurface 110. These pipes include a first string of casing 102, sometimes known as surface casing or a conductor. These pipes also include at least a second 104 and a third 106 string of casing. These casing strings 104, 106 are intermediate casing strings that provide support for walls of the wellbore 100. Intermediate casing strings 104, 106 may be hung from the surface, or they may be hung from a next higher casing string using an expandable liner or liner hanger. It is understood that a pipe string that does not extend back to the surface (such as casing string 106) is normally referred to as a "liner."

In the illustrative wellbore arrangement of FIG. 1, intermediate casing string 104 is hung from the surface 101, while casing string 106 is hung from a lower end of casing string 104. Additional intermediate casing strings (not shown) may be employed. The present inventions are not limited to the type of casing arrangement used.

Each string of casing 102, 104, 106 is set in place through cement 108. The cement 108 isolates the various formations of the subsurface 110 from the wellbore 100 and each other. The cement 108 extends from the surface 101 to a depth "L" at a lower end of the casing string 106. It is understood that some intermediate casing strings may not be fully cemented.

An annular region 204 is formed between the production tubing 130 and the casing string 106. A production packer 206 seals the annular region 204 near the lower end "L" of the casing string 106.

In many wellbores, a final casing string known as production casing is cemented into place at a depth where subsurface production intervals reside. However, the illustrative wellbore 100 is completed as an open-hole wellbore. Accordingly, the wellbore 100 does not include a final casing string along the open-hole portion 120.

In the illustrative wellbore 100, the open-hole portion 120 traverses three different subsurface intervals. These are indicated as upper interval 112, intermediate interval 114, and lower interval 116. Upper interval 112 and lower interval 116 may, for example, contain valuable oil deposits sought to be produced, while intermediate interval 114 may contain primarily water or other aqueous fluid within its pore volume. This may be due to the presence of native water zones, high permeability streaks or natural fractures in the aquifer, or fingering from injection wells. In this instance, there is a probability that water will invade the wellbore 100.

Alternatively, upper 112 and intermediate 114 intervals may contain hydrocarbon fluids sought to be produced, processed and sold, while lower interval 116 may contain some oil along with ever-increasing amounts of water. This may be due to coning, which is a rise of near-well hydrocarbon-water contact. In this instance, there is again the possibility that water will invade the wellbore 100.

Alternatively still, upper 112 and lower 116 intervals may be producing hydrocarbon fluids from a sand or other permeable rock matrix, while intermediate interval 114 may represent a non-permeable shale or otherwise be substantially impermeable to fluids.

In any of these events, it is desirable for the operator to isolate selected intervals. In the first instance, the operator will want to isolate the intermediate interval 114 from the production string 130 and from the upper 112 and lower 116 intervals so that primarily hydrocarbon fluids may be produced through the wellbore 100 and to the surface 101. In the second instance, the operator will eventually want to isolate the lower interval 116 from the production string 130 and the upper 112 and intermediate 114 intervals so that primarily hydrocarbon fluids may be produced through the wellbore 100 and to the surface 101. In the third instance, the operator will want to isolate the upper interval 112 from the lower interval 116, but need not isolate the intermediate interval 114. Solutions to these needs in the context of an open-hole completion are provided herein, and are demonstrated more fully in connection with the proceeding drawings.

In connection with the production of hydrocarbon fluids from a wellbore having an open-hole completion, it is not only desirable to isolate selected intervals, but also to limit the influx of sand particles and other fines. In order to prevent the migration of formation particles into the production string 130 during operation, sand control devices 200 have been run into the wellbore 100. These are described more fully below in connection with FIG. 2 and with FIGS. 8A through 8N.

Figure 2:
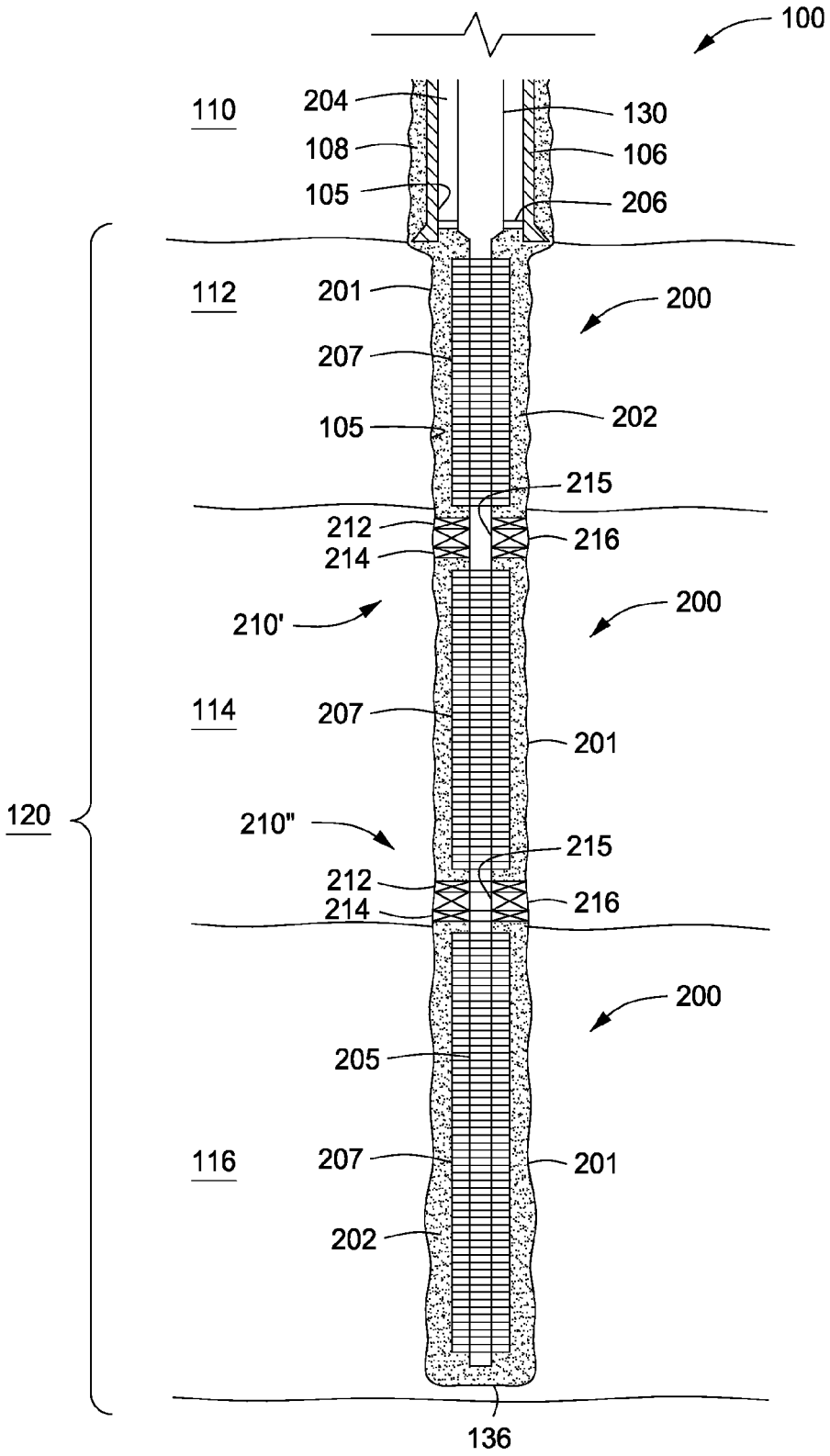
FIG. 2 is an enlarged cross-sectional view of an open-hole completion of the wellbore of FIG. 1. The open-hole completion at the depth of the three illustrative intervals is more clearly seen.

Referring now to FIG. 2, the sand control devices 200 contain an elongated tubular body referred to as a base pipe 205. The base pipe 205 typically is made up of a plurality of pipe joints. The base pipe 205 (or each pipe joint making up the base pipe 205) typically has small perforations or slots to permit the inflow of production fluids.

The sand control devices 200 also contain a filter medium 207 wound or otherwise placed radially around the base pipes 205. The filter medium 207 may be a wire mesh screen or wire wrap fitted around the base pipe 205. Alternatively, the filtering medium of the sand screen comprises a membrane screen, an expandable screen, a sintered metal screen, a porous media made of shape memory polymer (such as that described in U.S. Pat. No. 7,926,565), a porous media packed with fibrous material, or a pre-packed solid particle bed. The filter medium 207 prevents the inflow of sand or other particles above a pre-determined size into the base pipe 205 and the production tubing 130.

In addition to the sand control devices 200, the wellbore 100 includes one or more packer assemblies 210. In the illustrative arrangement of FIGS. 1 and 2, the wellbore 100 has an upper packer assembly 210' and a lower packer assembly 210". However, additional packer assemblies 210 or just one packer assembly 210 may be used. The packer assemblies 210', 210" are uniquely configured to seal an annular region (seen at 202 of FIG. 2) between the various sand control devices 200 and a surrounding wall 201 of the open-hole portion 120 of the wellbore 100.

FIG. 2 is an enlarged cross-sectional view of the open-hole portion 120 of the wellbore 100 of FIG. 1. The open-hole portion 120 and the three intervals 112, 114, 116 are more clearly seen. The upper 210' and lower 210" packer assemblies are also more clearly visible proximate upper and lower boundaries of the intermediate interval 114, respectively. Finally, the sand control devices 200 along each of the intervals 112, 114, 116 are shown.

Concerning the packer assemblies themselves, each packer assembly 210', 210" may have at least two packers. The packers are preferably set through a combination of mechanical manipulation and hydraulic forces. The packer assemblies 210 represent an upper packer 212 and a lower packer 214. Each packer 212, 214 has an expandable portion or element fabricated from an elastomeric or a thermoplastic material capable of providing at least a temporary fluid seal against the surrounding wellbore wall 201.

The elements for the upper 212 and lower 214 packers should be able to withstand the pressures and loads associated with a gravel packing process. Typically, such pressures are from about 2,000 psi to 3,000 psi. The elements for the packers 212, 214 should also withstand pressure load due to differential wellbore and/or reservoir pressures caused by natural faults, depletion, production, or injection. Production operations may involve selective production or production allocation to meet regulatory requirements. Injection operations may involve selective fluid injection for strategic reservoir pressure maintenance. Injection operations may also involve selective stimulation in acid fracturing, matrix acidizing, or formation damage removal.

The sealing surface or elements for the mechanically set packers 212, 214 need only be on the order of inches in order to affect a suitable hydraulic seal. In one aspect, the elements are each about 6 inches (15.2 cm) to about 24 inches (61.0 cm) in length.

The elements for the packers 212, 214 are preferably cup-type elements. Cup-type elements are known for use in cased-hole completions. However, they generally are not known for use in open-hole completions as they are not engineered to expand into engagement with an open-hole diameter. Moreover, such expandable cup-type elements may not maintain the required pressure differential encountered over the life of production operations, resulting in decreased functionality.

It is preferred for the packer elements 212, 214 to be able to expand to at least an 11-inch (about 28 cm) outer diameter surface, with no more than a 1.1 ovality ratio. The elements 212, 214 should preferably be able to handle washouts in an 8½ inch (about 21.6 cm) or 9⅞ inch (about 25.1 cm) open-hole section 120. The preferred cup-type nature of the expandable portions of the packer elements 212, 214 will assist in maintaining at least a temporary seal against the wall 201 of the intermediate interval 114 (or other interval) as pressure increases during the gravel packing operation.

In one embodiment, the cup-type elements need not be liquid tight, nor must they be rated to handle multiple pressure and temperature cycles. The cup-type elements need only be designed for one-time use, to wit, during the gravel packing process of an open-hole wellbore completion. This is because an intermediate swellable packer element 216 is also preferably provided for long term sealing.

The upper 212 and lower 214 packers are set prior to a gravel pack installation process. As described more fully below, the packers 212, 214 are preferably set by mechanically shearing a shear pin and sliding a release sleeve. This, in turn, releases a release key, which then allows hydrostatic pressure to act downwardly against a piston housing. The piston housing travels downward along an inner mandrel (not shown). The piston housing then acts upon a centralizer and/or a cup-type packing element. The centralizer and the expandable portion of the packers 212, 214 expand against the wellbore wall 201. The elements of the upper 212 and lower 214 packers are expanded into contact with the surrounding wall 201 so as to straddle the annular region 202 at a selected depth along the open-hole completion 120.

FIG. 2 shows a mandrel at 215. This may be representative of the piston mandrel, and other mandrels used in the packers 212, 214 as described more fully below.

As a "back-up" to the cup-type packer elements within the upper 212 and lower 214 packer elements, the packer assemblies 210', 210" also each include an intermediate packer element 216. The intermediate packer element 216 defines a swelling elastomeric material fabricated from synthetic rubber compounds. Suitable examples of swellable materials may be found in Easy Well Solutions' Constrictor™ or Swell-Packer™, and SwellFix's E-ZIP™. The swellable packer 216 may include a swellable polymer or swellable polymer material, which is known by those skilled in the art and which may be set by one of a conditioned drilling fluid, a completion fluid, a production fluid, an injection fluid, a stimulation fluid, or any combination thereof.

The swellable packer element 216 is preferably bonded to the outer surface of the mandrel 215. The swellable packer element 216 is allowed to expand over time when contacted by hydrocarbon fluids, formation water, or any chemical described above which may be used as an actuating fluid. As the packer element 216 expands, it forms a fluid seal with the surrounding zone, e.g., interval 114. In one aspect, a sealing surface of the swellable packet element 216 is from about 5 feet (1.5 meters) to 50 feet (15.2 meters) in length; and more preferably, about 3 feet (0.9 meters) to 40 feet (12.2 meters) in length.

The swellable packer element 216 must be able to expand to the wellbore wall 201 and provide the required pressure integrity at that expansion ratio. Since swellable packers are typically set in a shale section that may not produce hydrocarbon fluids, it is preferable to have a swelling elastomer or other material that can swell in the presence of formation water or an aqueous-based fluid. Examples of materials that will swell in the presence of an aqueous-based fluid are bentonite clay and a nitrile-based polymer with incorporated water absorbing particles.

Alternatively, the swellable packer element 216 may be fabricated from a combination of materials that swell in the presence of water and oil, respectively. Stated another way, the swellable packer element 216 may include two types of swelling elastomers—one for water and one for oil. In this situation, the water-swellable element will swell when exposed to the water-based gravel pack fluid or in contact with formation water, and the oil-based element will expand when exposed to hydrocarbon production. An example of an elastomeric material that will swell in the presence of a hydrocarbon liquid is oleophilic polymer that absorbs hydrocarbons into its matrix. The swelling occurs from the absorption of the hydrocarbons which also lubricates and decreases the mechanical strength of the polymer chain as it expands. Ethylene propylene diene monomer (M-class) rubber, or EPDM, is one example of such a material.

The swellable packer 216 may be fabricated from other expandable material. An example is a shape-memory polymer. U.S. Pat. No. 7,243,732 and U.S. Pat. No. 7,392,852 disclose the use of such a material for zonal isolation.

The mechanically set packer elements 212, 214 are preferably set in a water-based gravel pack fluid that would be diverted around the swellable packer element 216, such as through shunt tubes (not shown in FIG. 2). If only a hydrocarbon swelling elastomer is used, expansion of the element may not occur until after the failure of either of the mechanically set packer elements 212, 214.

The upper 212 and lower 214 packers may generally be mirror images of each other, except for the release sleeves that shear the respective shear pins or other engagement mechanisms. Unilateral movement of a shifting tool (shown in and discussed in connection with FIGS. 7A and 7B) will allow the packers 212, 214 to be activated in sequence or simultaneously. The lower packer 214 is activated first, followed by the upper packer 212 as the shifting tool is pulled upward through an inner mandrel (shown in and discussed in connection with FIGS. 6A and 6B). A short spacing is preferably provided between the upper 212 and lower 214 packers.

The packer assemblies 210', 210" help control and manage fluids produced from different zones. In this respect, the packer assemblies 210', 210" allow the operator to seal off an interval from either production or injection, depending on well function. Installation of the packer assemblies 210', 210"

in the initial completion allows an operator to shut-off the production from one or more zones during the well lifetime to limit the production of water or, in some instances, an undesirable non-condensable fluid such as hydrogen sulfide.

Packers historically have not been installed when an open-hole gravel pack is utilized because of the difficulty in forming a complete gravel pack above and below the packer. Related patent applications, U.S. Publication Nos. 2009/0294128 and 2010/0032158 disclose apparatus' and methods for gravel-packing an open-hole wellbore after a packer has been set at a completion interval.

Certain technical challenges have remained with respect to the methods disclosed in U.S. Pub Nos. 2009/0294128 and 2010/0032158, particularly in connection with the packer. The applications state that the packer may be a hydraulically actuated inflatable element. Such an inflatable element may be fabricated from an elastomeric material or a thermoplastic material. However, designing a packer element from such materials requires the packer element to meet a particularly high performance level. In this respect, the packer element needs to be able to maintain zonal isolation for a period of years in the presence of high pressures and/or high temperatures and/or acidic fluids. As an alternative, the applications state that the packer may be a swelling rubber element that expands in the presence of hydrocarbons, water, or other stimulus. However, known swelling elastomers typically require about 30 days or longer to fully expand into sealed fluid engagement with the surrounding rock formation. Therefore, improved packers and zonal isolation apparatus' are offered herein.

Figure 3A:
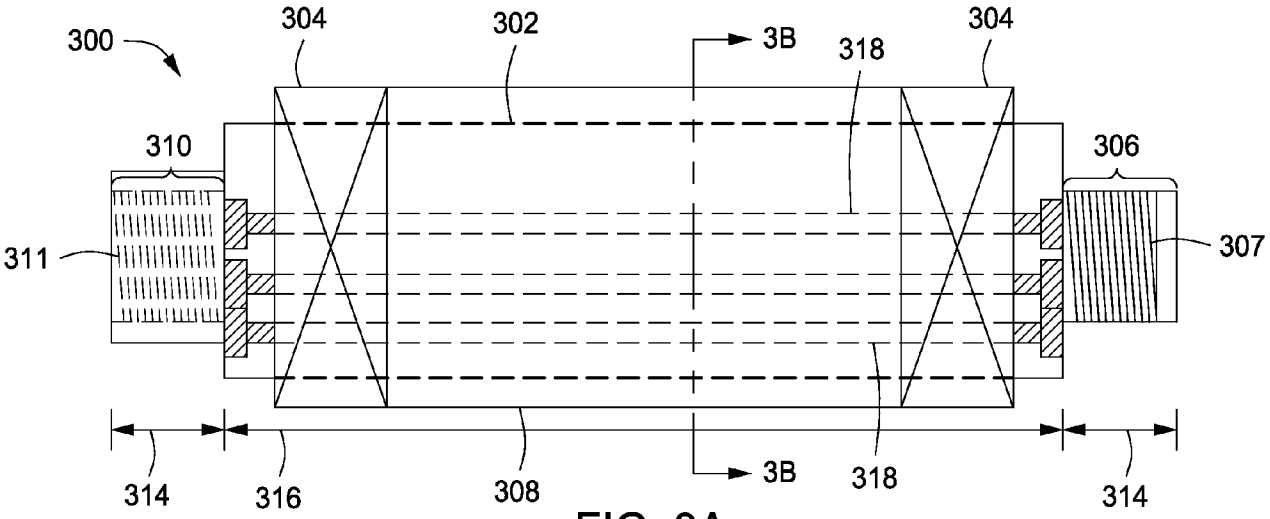
FIG. 3A is a cross-sectional side view of a packer assembly, in one embodiment. Here, a base pipe is shown, with surrounding packer elements. Two mechanically set packers are shown, along with an intermediate swellable packer element.

FIG. 3A presents an illustrative packer assembly 300 providing an alternate flowpath for a gravel slurry. The packer assembly 300 is seen in cross-sectional side view. The packer assembly 300 includes various components that may be utilized to seal an annulus along the open-hole portion 120.

The packer assembly 300 first includes a main body section 302. The main body section 302 is preferably fabricated from steel or from steel alloys. The main body section 302 is configured to be a specific length 316, such as about 40 feet (12.2 meters). The main body section 302 comprises individual pipe joints that will have a length that is between about 10 feet (3.0 meters) and 50 feet (15.2 meters). The pipe joints are typically threadedly connected end-to-end to form the main body section 302 according to length 316.

The packer assembly 300 also includes opposing mechanically-set packers 304. The mechanically-set packers 304 are shown schematically, and are generally in accordance with mechanically-set packer elements 212 and 214 of FIG. 2. The packers 304 preferably include cup-type elastomeric elements that are less than 1 foot (0.3 meters) in length. As described further below, the packers 304 have alternate flow channels that uniquely allow the packers 304 to be set before a gravel slurry is circulated into the wellbore.

The packer assembly 300 also optionally includes a swellable packer 308. The swellable packer 308 is in accordance with swellable packer element 216 of FIG. 2. The swellable packer 308 is preferably about 3 feet (0.9 meters) to 40 feet (12.2 meters) in length. Together, the mechanically-set packers 304 and the intermediate swellable packer 308 surround the main body section 302. Alternatively, a short spacing may be provided between the mechanically-set packers 304 in lieu of the swellable packer 308.

The packer assembly 300 also includes a plurality of shunt tubes. The shunt tubes are seen in phantom at 318. The shunt tubes 318 may also be referred to as transport tubes or jumper tubes. The shunt tubes 318 are blank sections of pipe having a length that extends along the length 316 of the mechanically-set packers 304 and the swellable packer 308. The shunt tubes 318 on the packer assembly 300 are configured to couple to and form a seal with shunt tubes on connected sand screens as discussed further below.

The shunt tubes 318 provide an alternate flowpath through the mechanically-set packers 304 and the intermediate swellable packer 308 (or spacing). This enables the shunt tubes 318 to transport a carrier fluid along with gravel to different intervals 112, 114 and 116 of the open-hole portion 120 of the wellbore 100.

The packer assembly 300 also includes connection members. These may represent traditional threaded couplings. First, a neck section 306 is provided at a first end of the packer assembly 300. The neck section 306 has external threads for connecting with a threaded coupling box of a sand screen or other pipe. Then, a notched or externally threaded section 310 is provided at an opposing second end. The threaded section 310 serves as a coupling box for receiving an external threaded end of a sand screen or other tubular member.

The neck section 306 and the threaded section 310 may be made of steel or steel alloys. The neck section 306 and the threaded section 310 are each configured to be a specific length 314, such as 4 inches (10.2 cm) to 4 feet (1.2 meters) (or other suitable distance). The neck section 306 and the threaded section 310 also have specific inner and outer diameters. The neck section 306 has external threads 307, while the threaded section 310 has internal threads 311. These threads 307 and 311 may be utilized to form a seal between the packer assembly 300 and sand control devices or other pipe segments.

Figure 3B:
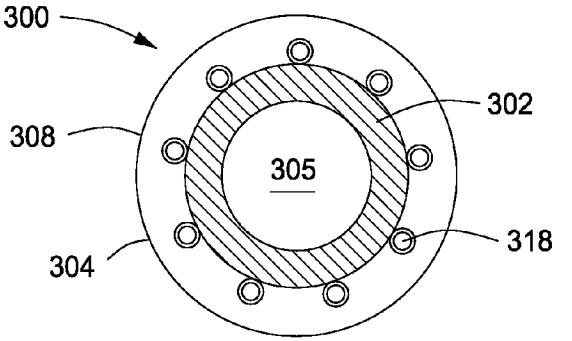
FIG. 3B is a cross-sectional view of the packer assembly of FIG. 3A, taken across lines 3B-3B of FIG. 3A. Shunt tubes are seen within the swellable packer element.

A cross-sectional view of the packer assembly 300 is shown in FIG. 3B. FIG. 3B is taken along the line 3B-3B of FIG. 3A. In FIG. 3B, the swellable packer 308 is seen circumferentially disposed around the base pipe 302. Various shunt tubes 318 are placed radially and equidistantly around the base pipe 302. A central bore 305 is shown within the base pipe 302. The central bore 305 receives production fluids during production operations and conveys them to the production tubing 130.

Figure 4A:
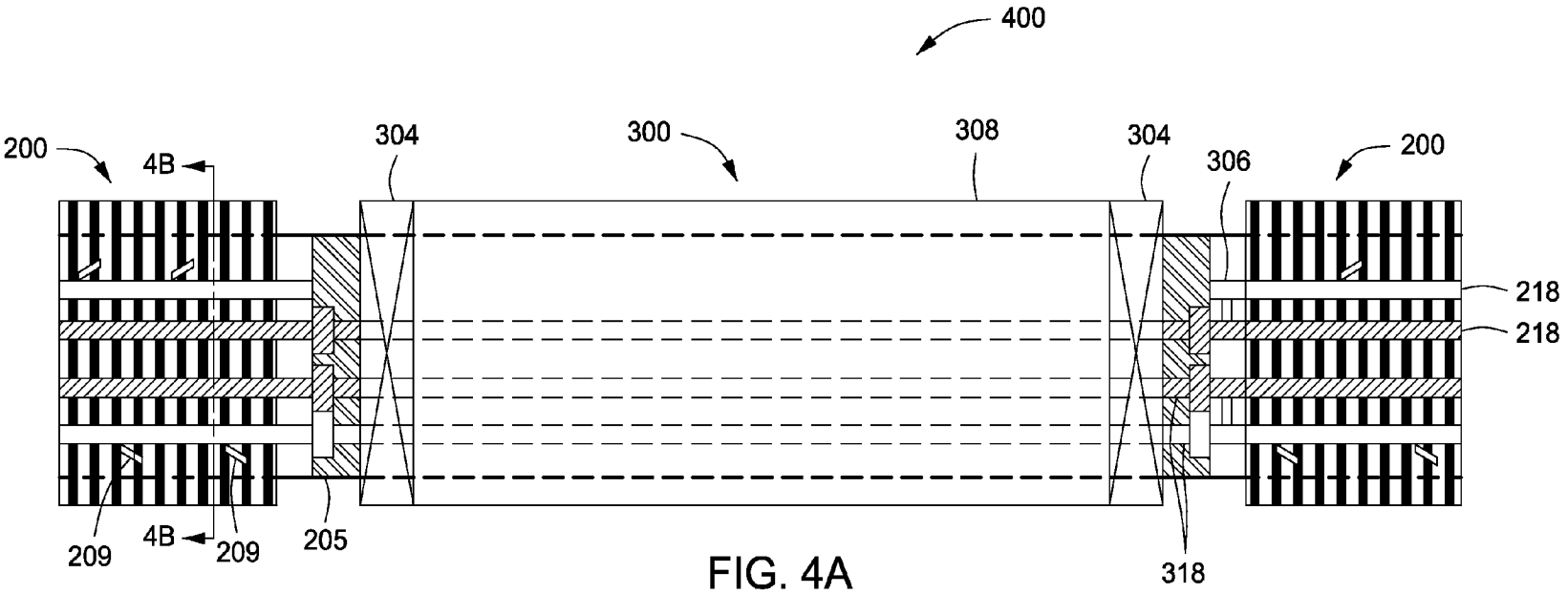
FIG. 4A is a cross-sectional side view of the packer assembly of FIG. 3A. Here, sand control devices, or sand screens, have been placed at opposing ends of the packer assembly. The sand control devices utilize external shunt tubes.

FIG. 4A presents a cross-sectional side view of a zonal isolation apparatus 400, in one embodiment. The zonal isolation apparatus 400 includes the packer assembly 300 from FIG. 3A. In addition, sand control devices 200 have been connected at opposing ends to the neck section 306 and the notched section 310, respectively. Shunt tubes 318 from the packer assembly 300 are seen connected to shunt tubes 218 on the sand control devices 200. The shunt tubes 218 represent packing tubes that allow the flow of gravel slurry between a wellbore annulus and the tubes 218. The shunt tubes 218 on the sand control devices 200 optionally include valves 209 to control the flow of gravel slurry such as to packing tubes (not shown).

Figure 4B:
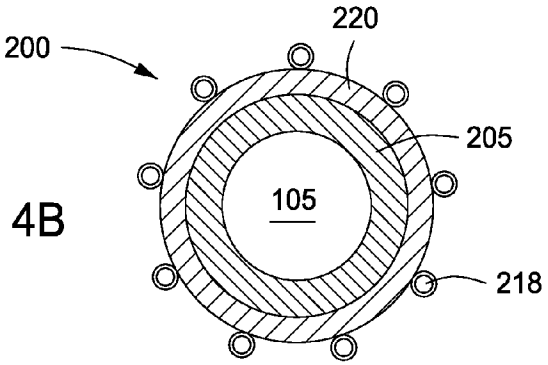
FIG. 4B provides a cross-sectional view of the packer assembly of FIG. 4A, taken across lines 4B-4B of FIG. 4A. Shunt tubes are seen outside of the sand screen to provide an alternative flowpath for a particulate slurry.

FIG. 4B provides a cross-sectional side view of the zonal isolation apparatus 400. FIG. 4B is taken along the line 4B-4B of FIG. 4A. This is cut through one of the sand screens 200. In FIG. 4B, the slotted or perforated base pipe 205 is seen. This is in accordance with base pipe 205 of FIGS. 1 and 2. The central bore 105 is shown within the base pipe 205 for receiving production fluids during production operations.

An outer mesh 220 is disposed immediately around the base pipe 205. The outer mesh 220 preferably comprises a wire mesh or wires helically wrapped around the base pipe 205, and serves as a screen. In addition, shunt tubes 218 are placed radially and equidistantly around the outer mesh 205. This means that the sand control devices 200 provide an external embodiment for the shunt tubes 218 (or alternate flow channels).

The configuration of the shunt tubes 218 is preferably concentric. This is seen in the cross-sectional view of FIG. 3B. However, the shunt tubes 218 may be eccentrically designed. For example, FIG. 2B in U.S. Pat. No. 7,661,476 presents a "Prior Art" arrangement for a sand control device wherein packing tubes 208*a* and transport tubes 208*b* are placed external to the base pipe 202 and surrounding filter medium 204.

In the arrangement of FIGS. 4A and 4B, the shunt tubes 218 are external to the filter medium, or outer mesh 220. However, the configuration of the sand control device 200 may be modified. In this respect, the shunt tubes 218 may be moved internal to the filter medium 220.

Figure 5A:
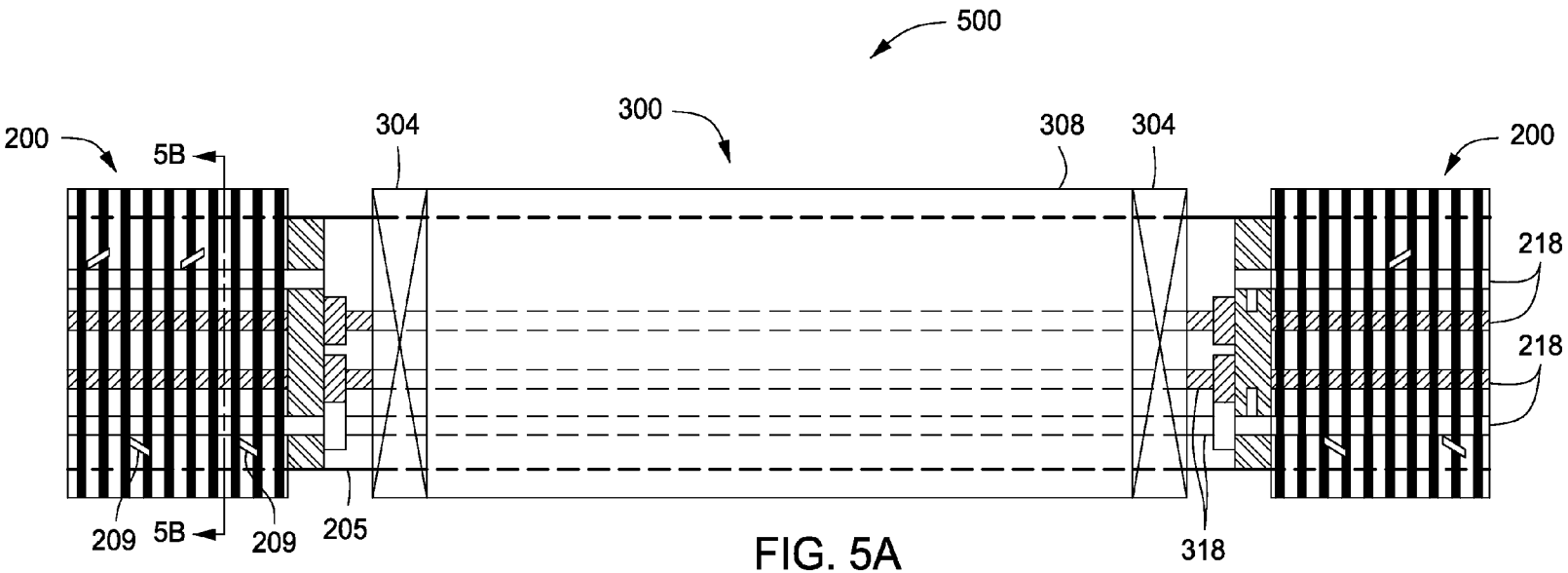
FIG. 5A is another cross-sectional side view of the packer assembly of FIG. 3A. Here, sand control devices, or sand screens, have again been placed at opposing ends of the packer assembly. However, the sand control devices utilize internal shunt tubes.

FIG. 5A presents a cross-sectional side view of a zonal isolation apparatus 500, in an alternate embodiment. In this embodiment, sand control devices 200 are again connected at opposing ends to the neck section 306 and the notched section 310, respectively, of the packer assembly 300. In addition, shunt tubes 318 on the packer assembly 300 are seen connected to shunt tubes 218 on the sand control assembly 200. However, in FIG. 5A, the sand control assembly 200 utilizes internal shunt tubes 218, meaning that the shunt tubes 218 are disposed between the base pipe 205 and the surrounding filter medium 220.

Figure 5B:
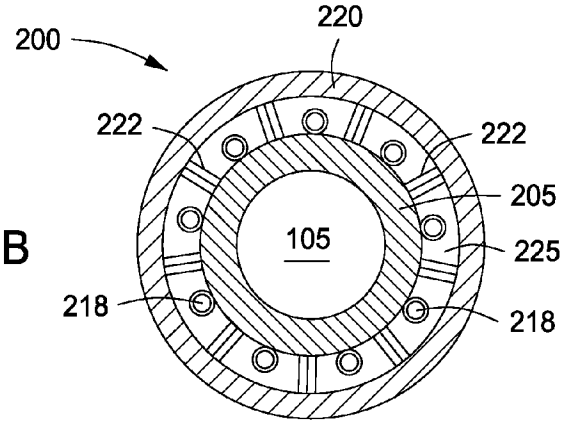
FIG. 5B provides a cross-sectional view of the packer assembly of FIG. 5A, taken across lines 5B-5B of FIG. 5A. Shunt tubes are seen within the sand screen to provide an alternative flowpath for a particulate slurry.

FIG. 5B provides a cross-sectional side view of the zonal isolation apparatus 500. FIG. 5B is taken along the line B-B of FIG. 5A. This is cut through one of the sand screens 200. In FIG. 5B, the slotted or perforated base pipe 205 is again seen. This is in accordance with base pipe 205 of FIGS. 1 and 2. The central bore 105 is shown within the base pipe 205 for receiving production fluids during production operations.

Shunt tubes 218 are placed radially and equidistantly around the base pipe 205. The shunt tubes 218 reside immediately around the base pipe 205, and within a surrounding filter medium 220. This means that the sand control devices 200 of FIGS. 5A and 5B provide an internal embodiment for the shunt tubes 218.

An annular region 225 is created between the base pipe 205 and the surrounding outer mesh or filter medium 220. The annular region 225 accommodates the inflow of production fluids in a wellbore. The outer wire wrap 220 is supported by a plurality of radially extending support ribs 222. The ribs 222 extend through the annular region 225.

FIGS. 4A and 5A present arrangements for connecting sand control joints to a packer assembly. Shunt tubes 318 (or alternate flow channels) within the packers fluidly connect to shunt tubes 218 along the sand screens 200. However, the zonal isolation apparatus arrangements 400, 500 of FIGS. 4A-4B and 5A-5B are merely illustrative. In an alternative arrangement, a manifolding system may be used for providing fluid communication between the shunt tubes 218 and the shunt tubes 318.

Figure 3C:
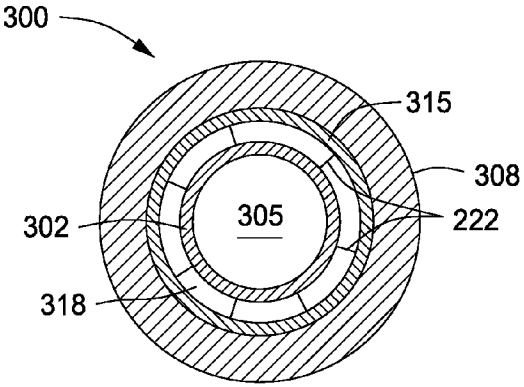
FIG. 3C is a cross-sectional view of the packer assembly of FIG. 3A, in an alternate embodiment. In lieu of shunt tubes, transport tubes are seen manifolded around the base pipe.

FIG. 3C is a cross-sectional view of the packer assembly 300 of FIG. 3A, in an alternate embodiment. In this arrangement, the shunt tubes 218 are manifolded around the base pipe 302. A support ring 315 is provided around the shunt tubes 318. It is again understood that the present apparatus and methods are not confined by the particular design and arrangement of shunt tubes 318 so long as slurry bypass is provided for the packer assembly 210. However, it is preferred that a concentric arrangement be employed.

It should also be noted that the coupling mechanism for the sand control devices 200 with the packer assembly 300 may include a sealing mechanism (not shown). The sealing mechanism prevents leaking of the slurry that is in the alternate flowpath formed by the shunt tubes. Examples of such sealing mechanisms are described in U.S. Pat. No. 6,464,261; Intl. Pat. Application No. WO 2004/094769; Intl. Pat. Application No. WO 2005/031105; U.S. Pat. Publ. No. 2004/0140089; U.S. Pat. Publ. No. 2005/0028977; U.S. Pat. Publ. No. 2005/0061501; and U.S. Pat. Publ. No. 2005/0082060.

Coupling sand control devices 200 with a packer assembly 300 requires alignment of the shunt tubes 318 in the packer assembly 300 with the shunt tubes 218 along the sand control devices 200. In this respect, the flow path of the shunt tubes 218 in the sand control devices should be un-interrupted when engaging a packer. FIG. 4A (described above) shows sand control devices 200 connected to an intermediate packer assembly 300, with the shunt tubes 218, 318 in alignment. However, making this connection typically requires a special sub or jumper with a union-type connection, a timed connection to align the multiple tubes, or a cylindrical cover plate over the connecting tubes. These connections are expensive, time-consuming, and/or difficult to handle on the rig floor.

U.S. Pat. No. 7,661,476, entitled "Gravel Packing Methods," discloses a production string (referred to as a joint assembly) that employs one or more sand screen joints. The sand screen joints are placed between a "load sleeve assembly" and a "torque sleeve assembly." The load sleeve assembly defines an elongated body comprising an outer wall (serving as an outer diameter) and an inner wall (providing an inner diameter). The inner wall forms a bore through the load sleeve assembly. Similarly, the torque sleeve assembly defines an elongated body comprising an outer wall (serving as an outer diameter) and an inner wall (providing an inner diameter). The inner wall also forms a bore through the torque sleeve assembly.

The load sleeve assembly includes at least one transport conduit and at least one packing conduit. The at least one transport conduit and the at least one packing conduit are disposed exterior to the inner diameter and interior to the outer diameter. Similarly, torque sleeve assembly includes at least one conduit. The at least one conduit is also disposed exterior to the inner diameter and interior to the outer diameter.

The production string includes a "main body portion." This is essentially a base pipe that runs through the sand screen. A coupling assembly having a manifold region may also be provided. The manifold region is configured to be in fluid flow communication with the at least one transport conduit and at least one packing conduit of the load sleeve assembly during at least a portion of gravel packing operations. The coupling assembly is operably attached to at least a portion of the at least one joint assembly at or near the load sleeve assembly. The load sleeve assembly and the torque sleeve assembly are made up or coupled with the base pipe in such a manner that the transport and packing conduits are in fluid communication, thereby providing alternate flow channels for gravel slurry. The benefit of the load sleeve assembly, the torque sleeve assembly, and a coupling assembly is that they enable a series of sand screen joints to be connected and run into the wellbore in a faster and less expensive manner.

As noted, the packer assembly 300 includes a pair of mechanically-set packers 304. When using the packer assembly 300, the packers 304 are beneficially set before the slurry is injected and the gravel pack is formed. This requires a unique packer arrangement wherein shunt tubes are provided for an alternate flow channel.

Figure 6A:
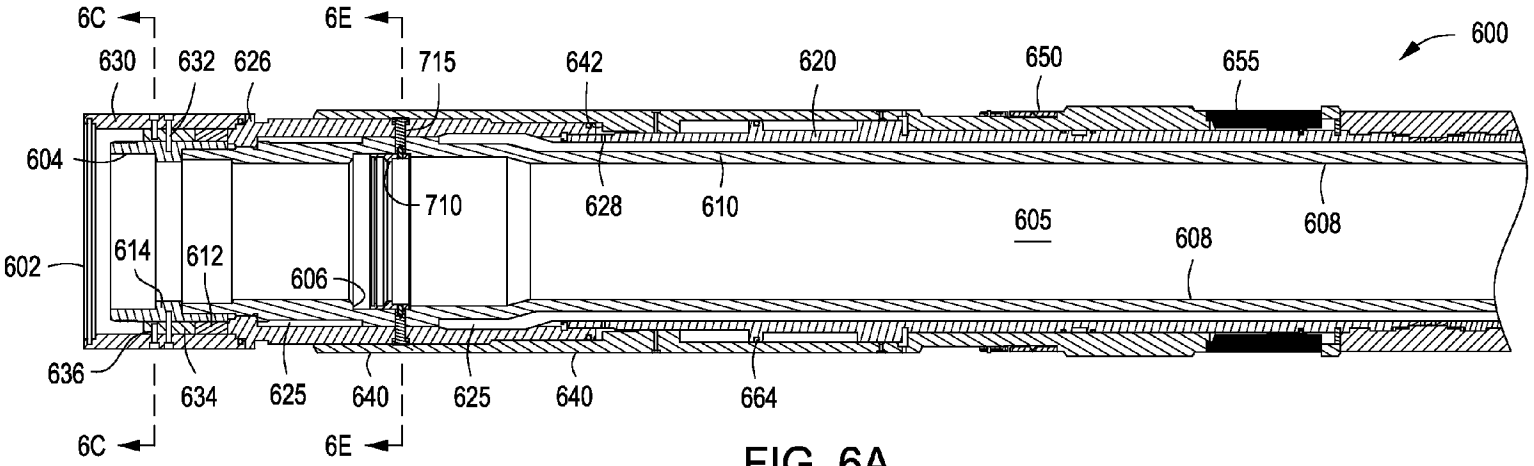
FIG. 6A is a cross-sectional side view of one of the mechanically-set packer of FIG. 3A. The mechanically-set packer is in its run-in position.
Figure 6B:
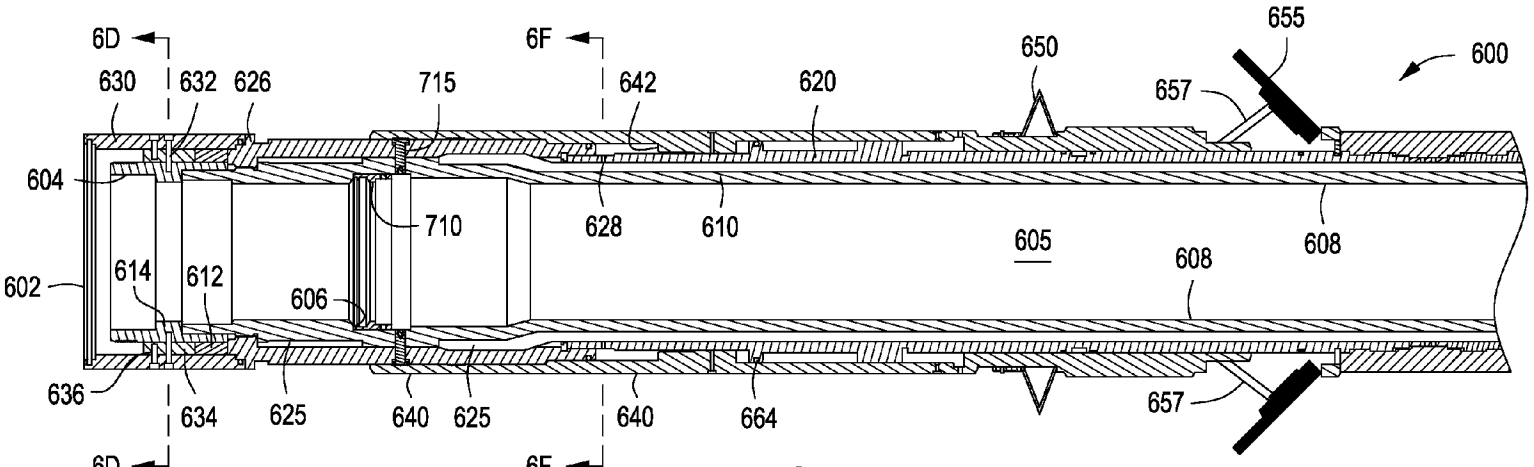
FIG. 6B is a cross-sectional side view of the mechanically-set packer of FIG. 3A. Here, the mechanically-set packer element is in its set position.

The packers 304 of FIG. 3A are shown schematically. However, FIGS. 6A and 6B provide more detailed views of a mechanically-set packer 600 that may be used in the packer assembly of FIG. 3A, in one embodiment. The views of FIGS. 6A and 6B provide cross-sectional side views. In FIG. 6A, the packer 600 is in its run-in position, while in FIG. 6B the packer 600 is in its set position.

Other embodiments of sand control devices 200 may be used with the apparatuses and methods herein. For example, the sand control devices may include stand-alone screens (SAS), pre-packed screens, or membrane screens. The joints may be any combination of screen, blank pipe, or zonal isolation apparatus.

The packer 600 first includes an inner mandrel 610. The inner mandrel 610 defines an elongated tubular body forming a central bore 605. The central bore 605 provides a primary flow path of production fluids through the packer 600. After installation and commencement of production, the central bore 605 transports production fluids to the bore 105 of the sand screens 200 (seen in FIGS. 4A and 4B) and the production tubing 130 (seen in FIGS. 1 and 2).

The packer 600 also includes a first end 602. Threads 604 are placed along the inner mandrel 610 at the first end 602. The illustrative threads 604 are external threads. A box connector 614 having internal threads at both ends is connected or threaded on threads 604 at the first end 602. The first end 602 of inner mandrel 610 with the box connector 614 is called the box end. The second end (not shown) of the inner mandrel 610 has external threads and is called the pin end. The pin end (not shown) of the inner mandrel 610 allows the packer 600 to be connected to the box end of a sand screen or other tubular body such as a stand-alone screen, a sensing module, a production tubing, or a blank pipe.

The box connector 614 at the box end 602 allows the packer 600 to be connected to the pin end of a sand screen or other tubular body such as a stand-alone screen, a sensing module, a production tubing, or a blank pipe.

The inner mandrel 610 extends along the length of the packer 600. The inner mandrel 610 may be composed of multiple connected segments, or joints. The inner mandrel 610 has a slightly smaller inner diameter near the first end 602. This is due to a setting shoulder 606 machined into the inner mandrel. As will be explained more fully below, the setting shoulder 606 catches a release sleeve 710 in response to mechanical force applied by a setting tool.

The packer 600 also includes a piston mandrel 620. The piston mandrel 620 extends generally from the first end 602 of the packer 600. The piston mandrel 620 may be composed of multiple connected segments, or joints. The piston mandrel 620 defines an elongated tubular body that resides circumferentially around and substantially concentric to the inner mandrel 610. An annulus 625 is formed between the inner mandrel 610 and the surrounding piston mandrel 620. The annulus 625 beneficially provides a secondary flow path or alternate flow channels for fluids.

In the arrangement of FIGS. 6A and 6B, the alternate flow channels defined by the annulus 625 are external to the inner mandrel 610. However, the packer could be reconfigured such that the alternate flow channels are within the bore 605 of the inner mandrel 610. In either instance, the alternate flow channels are "along" the inner mandrel 610.

The annulus 625 is in fluid communication with the secondary flow path of another downhole tool (not shown in FIGS. 6A and 6B). Such a separate tool may be, for example, the sand screens 200 of FIGS. 4A and 5A, or a blank pipe, a swellable zonal isolation packer such as packer 308 of FIG. 3A, or other tubular body. The tubular body may or may not have alternate flow channels.

The packer 600 also includes a coupling 630. The coupling 630 is connected and sealed (e.g., via elastomeric "o" rings) to the piston mandrel 620 at the first end 602. The coupling 630 is then threaded and pinned to the box connector 614, which is threadedly connected to the inner mandrel 610 to prevent relative rotational movement between the inner mandrel 610 and the coupling 630. A first torque bolt is shown at 632 for pinning the coupling to the box connector 614.

In one aspect, a NACA (National Advisory Committee for Aeronautics) key 634 is also employed. The NACA key 634 is placed internal to the coupling 630, and external to a threaded box connector 614. A first torque bolt is provided at 632, connecting the coupling 630 to the NACA key 634 and then to the box connector 614. A second torque bolt is provided at 636 connecting the coupling 630 to the NACA key 634. NACA-shaped keys can (a) fasten the coupling 630 to the inner mandrel 610 via box connector 614, (b) prevent the coupling 630 from rotating around the inner mandrel 610, and (c) streamline the flow of slurry along the annulus 612 to reduce friction.

Within the packer 600, the annulus 625 around the inner mandrel 610 is isolated from the main bore 605. In addition, the annulus 625 is isolated from a surrounding wellbore annulus (not shown). The annulus 625 enables the transfer of gravel slurry from alternative flow channels (such as shunt tubes 218) through the packer 600. Thus, the annulus 625 becomes the alternative flow channel(s) for the packer 600.

In operation, an annular space 612 resides at the first end 602 of the packer 600. The annular space 612 is disposed between the box connector 614 and the coupling 630. The annular space 612 receives slurry from alternate flow channels of a connected tubular body, and delivers the slurry to the annulus 625. The tubular body may be, for example, an adjacent sand screen, a blank pipe, or a zonal isolation device.

The packer 600 also includes a load shoulder 626. The load shoulder 626 is placed near the end of the piston mandrel 620 where the coupling 630 is connected and sealed. A solid section at the end of the piston mandrel 620 has an inner diameter and an outer diameter. The load shoulder 626 is placed along the outer diameter. The inner diameter has threads and is threadedly connected to the inner mandrel 610. At least one alternate flow channel is formed between the inner and outer diameters to connect flow between the annular space 612 and the annulus 625.

The load shoulder 626 provides a load-bearing point. During rig operations, a load collar or harness (not shown) is placed around the load shoulder 626 to allow the packer 600 to be picked up and supported with conventional elevators. The load shoulder 626 is then temporarily used to support the weight of the packer 600 (and any connected completion devices such as sand screen joints already run into the well) when placed in the rotary floor of a rig. The load may then be transferred from the load shoulder 626 to a pipe thread connector such as box connector 614, then to the inner mandrel 610 or base pipe 205, which is pipe threaded to the box connector 614.

The packer 600 also includes a piston housing 640. The piston housing 640 resides around and is substantially concentric to the piston mandrel 620. The packer 600 is configured to cause the piston housing 640 to move axially along and relative to the piston mandrel 620. Specifically, the piston housing 640 is driven by the downhole hydrostatic pressure. The piston housing 640 may be composed of multiple connected segments, or joints.

The piston housing 640 is held in place along the piston mandrel 620 during run-in. The piston housing 640 is secured using a release sleeve 710 and release key 715. The release sleeve 710 and release key 715 prevent relative translational movement between the piston housing 640 and the piston mandrel 620. The release key 715 penetrates through both the piston mandrel 620 and the inner mandrel 610.

Figure 7A:
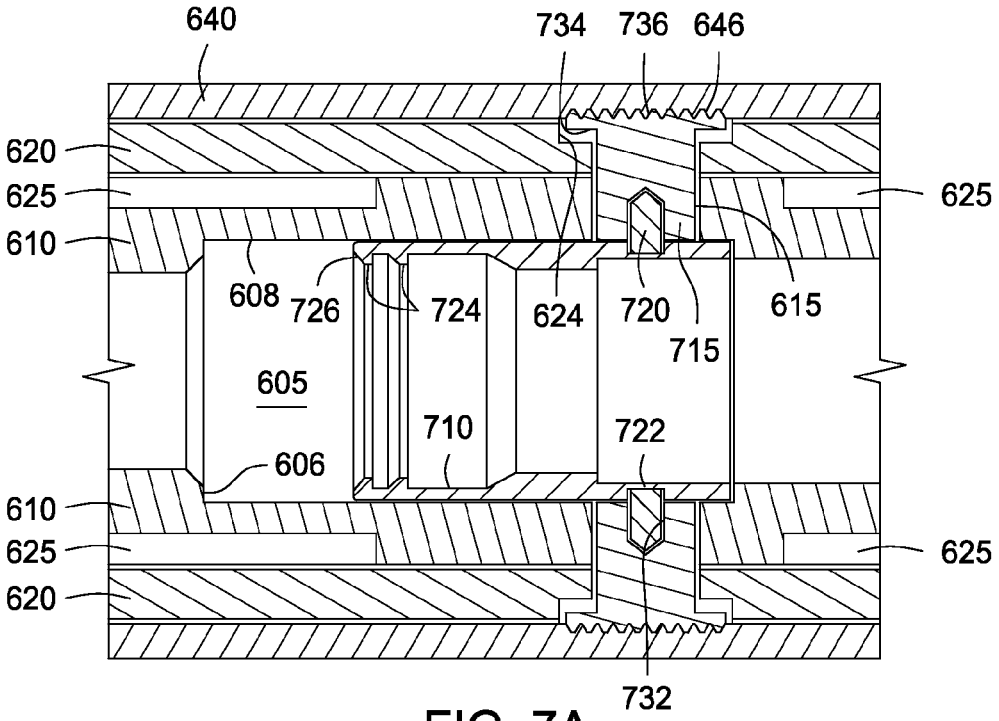
FIG. 7A is an enlarged view of the release key of FIG. 6A. The release key is in its run-in position along the inner mandrel. The shear pin has not yet been sheared.
Figure 7B:
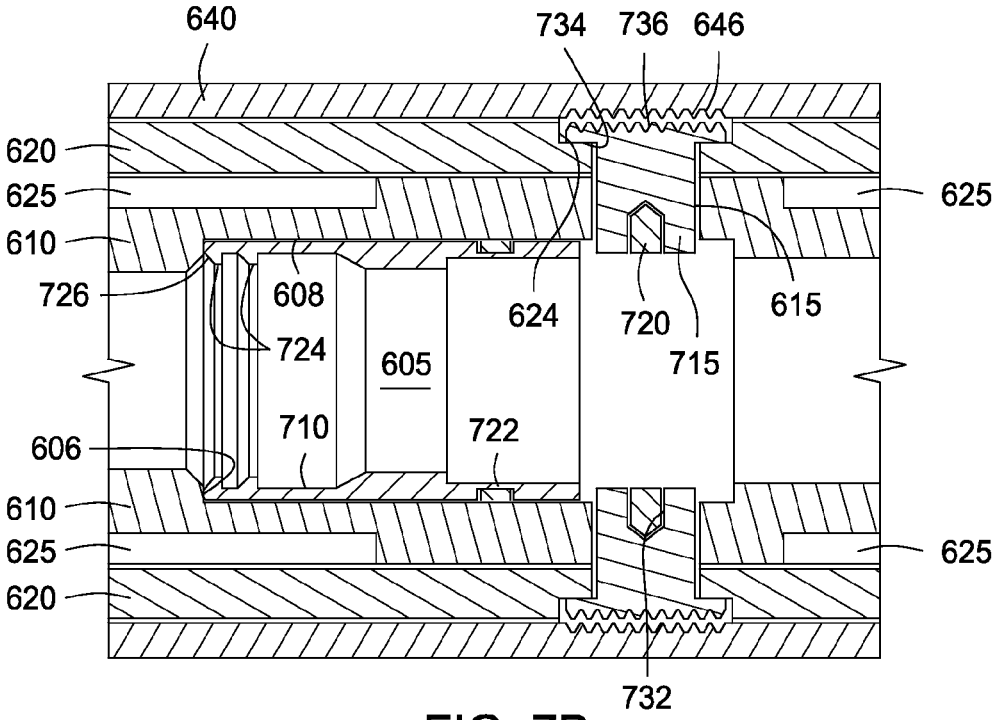
FIG. 7B is an enlarged view of the release key of FIG. 6B. The shear pin has been sheared, and the release key has dropped away from the inner mandrel.

FIGS. 7A and 7B provide enlarged views of the release sleeve 710 and the release key 715 for the packer 600. The release sleeve 710 and the release key 715 are held in place by a shear pin 720. In FIG. 7A, the shear pin 720 has not been sheared, and the release sleeve 710 and the release key 715 are held in place along the inner mandrel 610. However, in FIG. 7B the shear pin 720 has been sheared, and the release sleeve 710 has been translated along an inner surface 608 of the inner mandrel 610.

In each of FIGS. 7A and 7B, the inner mandrel 610 and the surrounding piston mandrel 620 are seen. In addition, the piston housing 640 is seen outside of the piston mandrel 620. The three tubular bodies representing the inner mandrel 610, the piston mandrel 620, and the piston housing 640 are secured together against relative translational or rotational movement by four release keys 715. Only one of the release keys 715 is seen in FIG. 7A; however, four separate keys 715 are radially visible in the cross-sectional view of FIG. 6E, described below.

The release key 715 resides within a keyhole 615. The keyhole 615 extends through the inner mandrel 610 and the piston mandrel 620. The release key 715 includes a shoulder 734. The shoulder 734 resides within a shoulder recess 624 in the piston mandrel 620. The shoulder recess 624 is large enough to permit the shoulder 734 to move radially inwardly. However, such play is restricted in FIG. 7A by the presence of the release sleeve 710.

It is noted that the annulus 625 between the inner mandrel 610 and the piston mandrel 620 is not seen in FIG. 7A or 7B. This is because the annulus 625 does not extend through this cross-section, or is very small. Instead, the annulus 625 employs separate radially-spaced channels that preserve the support for the release keys 715, as seen best in FIG. 6E. Stated another way, the large channels making up the annulus 625 are located away from the material of the inner mandrel 610 that surrounds the keyholes 615.

At each release key location, a keyhole 615 is machined through the inner mandrel 610. The keyholes 615 are drilled to accommodate the respective release keys 715. If there are four release keys 715, there will be four discrete bumps spaced circumferentially to significantly reduce the annulus 625. The remaining area of the annulus 625 between adjacent bumps allows flow in the alternate flow channel 625 to bypass the release key 715.

Bumps may be machined as part of the body of the inner mandrel 610. More specifically, material making up the inner mandrel 610 may be machined to form the bumps. Alternatively, bumps may be machined as a separate, short release mandrel (not shown), which is then threaded to the inner mandrel 610. Alternatively still, the bumps may be a separate spacer secured between the inner mandrel 610 and the piston mandrel 620 by welding or other means.

It is also noted here that in FIG. 6A, the piston mandrel 620 is shown as an integral body. However, the portion of the piston mandrel 620 where the keyholes 615 are located may be a separate, short release housing. This separate housing is then connected to the main piston mandrel 620.

Each release key 715 has an opening 732. Similarly, the release sleeve 710 has an opening 722. The opening 732 in the release key 715 and the opening 722 in the release sleeve 710 are sized and configured to receive a shear pin. The shear pin is seen at 720. In FIG. 7A, the shear pin 720 is held within the openings 732, 722 by the release sleeve 710. However, in FIG. 7B the shear pin 720 has been sheared, and only a small portion of the pin 720 remains visible.

An outer edge of the release key 715 has a ruggled surface, or teeth. The teeth for the release key 715 are shown at 736. The teeth 736 of the release key 715 are angled and configured to mate with a reciprocal ruggled surface within the piston housing 640. The mating ruggled surface (or teeth) for the piston housing 640 are shown at 646. The teeth 646 reside on an inner face of the piston housing 640. When engaged, the teeth 736, 646 prevent movement of the piston housing 640 relative to the piston mandrel 620 or the inner mandrel 610. Preferably, the mating ruggled surface or teeth 646 reside on the inner face of a separate, short outer release sleeve, which is then threaded to the piston housing 640.

Returning now to FIGS. 6A and 6B, the packer 600 includes a centralizing member 650. The centralizing member 650 is actuated by the movement of the piston housing 640. The centralizing member 650 may be, for example, as described in WO 2009/071874, entitled "Improved Centraliser," which an international filing date of Nov. 28, 2008.

The packer 600 further includes a sealing element 655. As the centralizing member 650 is actuated and centralizes the packer 600 within the surrounding wellbore, the piston housing 640 continues to actuate the sealing element 655 as described in WO 2007/107773, entitled "Improved Packer," which has an international filing date of Mar. 22, 2007.

In FIG. 6A, the centralizing member 650 and sealing element 655 are in their run-in position. In FIG. 6B, the centralizing member 650 and connected sealing element 655 have been actuated. This means the piston housing 640 has moved along the piston mandrel 620, causing both the centralizing member 650 and the sealing element 655 to engage the surrounding wellbore wall.

An anchor system as described in WO 2010/084353 may be used to prevent the piston housing 640 from going backward. This prevents contraction of the cup-type element 655.

As noted, movement of the piston housing 640 takes place in response to hydrostatic pressure from wellbore fluids, including the gravel slurry. In the run-in position of the packer 600 (shown in FIG. 6A), the piston housing 640 is held in place by the release sleeve 710 and associated piston key 715. This position is shown in FIG. 7A. In order to set the packer 600 (in accordance with FIG. 6B), the release sleeve 710 must be moved out of the way of the release key 715 so that the teeth 736 of the release key 715 are no longer engaged with the teeth 646 of the piston housing 640. This position is shown in FIG. 7B.

To move the release the release sleeve 710, a setting tool is used. An illustrative setting tool is shown at 750 in FIG. 7C. The setting tool 750 defines a short cylindrical body 755. Preferably, the setting tool 750 is run into the wellbore with a washpipe string (not shown). Movement of the washpipe string along the wellbore can be controlled at the surface.

An upper end 752 of the setting tool 750 is made up of several radial collet fingers 760. The collet fingers 760 collapse when subjected to sufficient inward force. In operation, the collet fingers 760 latch into a profile 724 formed along the release sleeve 710. The collet fingers 760 include raised surfaces 762 that mate with or latch into the profile 724 of the release key 710. Upon latching, the setting tool 750 is pulled or raised within the wellbore. The setting tool 750 then pulls the release sleeve 710 with sufficient force to cause the shear pins 720 to shear. Once the shear pins 720 are sheared, the release sleeve 710 is free to translate upward along the inner surface 608 of the inner mandrel 610.

Figure 7C:
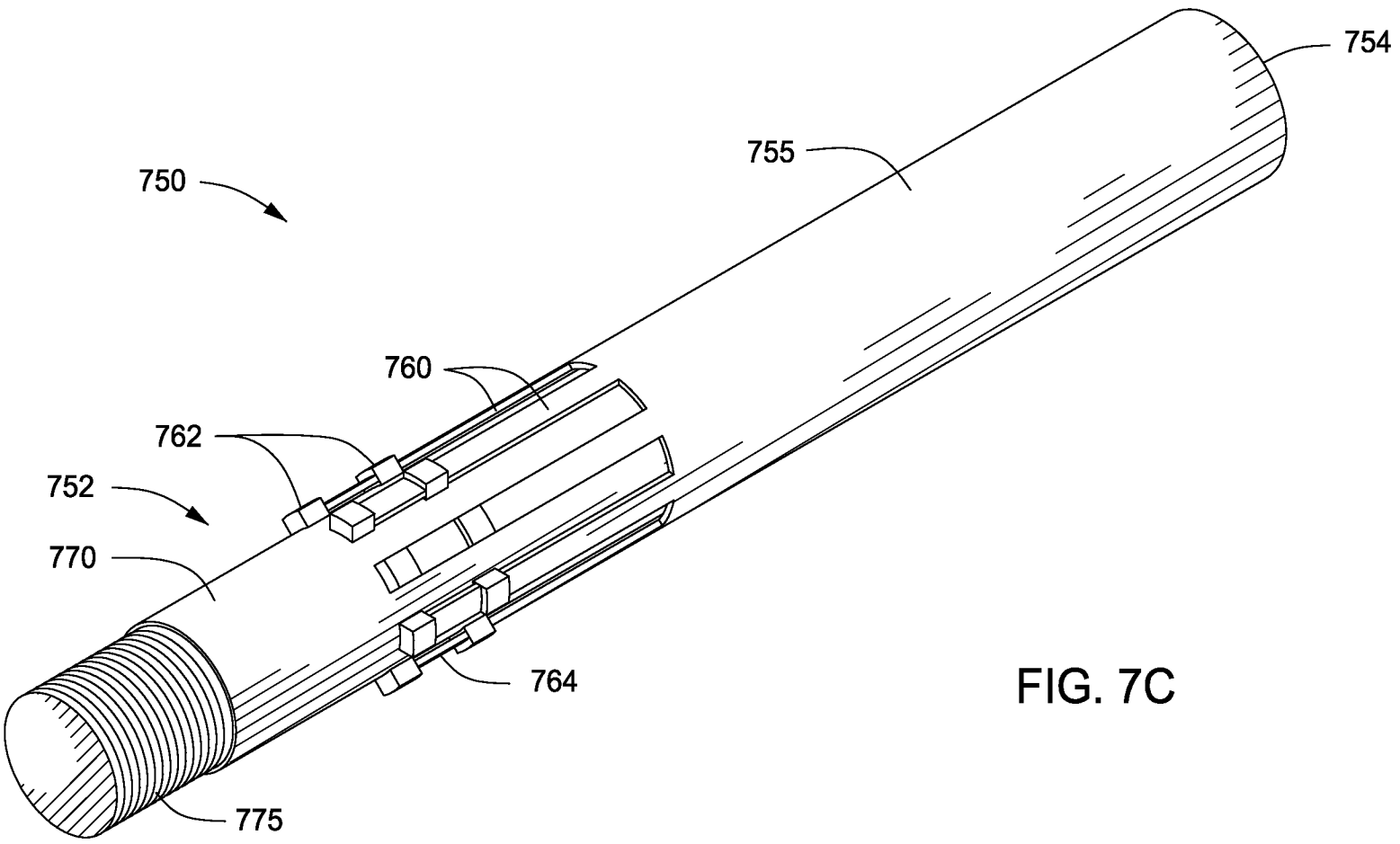
FIG. 7C is a perspective view of a setting tool as may be used to latch onto a release sleeve, and thereby shear a shear pin within the release key.

As noted, the setting tool 750 may be run into the wellbore with a washpipe. The setting tool 750 may simply be a profiled portion of the washpipe body. Preferably, however, the setting tool 750 is a separate tubular body 755 that is threadedly connected to the washpipe. In FIG. 7C, a connection tool is provided at 770. The connection tool 770 includes external threads 775 for connecting to a drill string or other run-in tubular. The connection tool 770 extends into the body 755 of the setting tool 750. The connection tool 770 may extend all the way through the body 755 to connect to the washpipe or other device, or it may connect to internal threads (not seen) within the body 755 of the setting tool 750.

Returning to FIGS. 7A and 7B, the travel of the release sleeve 710 is limited. In this respect, a first or top end 726 of the release sleeve 710 stops against the shoulder 606 along the inner surface 608 of the inner mandrel 610. The length of the release sleeve 710 is short enough to allow the release sleeve 710 to clear the opening 732 in the release key 715. When fully shifted, the release key 715 moves radially inward, pushed by the ruggled profile in the piston housing 640 when hydrostatic pressure is present.

Shearing of the pin 720 and movement of the release sleeve 710 also allows the release key 715 to disengage from the piston housing 640. The shoulder recess 624 is dimensioned to allow the shoulder 734 of the release key 715 to drop or to disengage from the teeth 646 of the piston housing 640 once the release sleeve 710 is cleared. Hydrostatic pressure then acts upon the piston housing 640 to translate it downward relative to the piston mandrel 620.

After the shear pins 720 have been sheared, the piston housing 640 is free to slide along an outer surface of the piston mandrel 620. To accomplish this, hydrostatic pressure from the annulus 625 acts upon a shoulder 642 in the piston housing 640. This is seen best in FIG. 6B. The shoulder 642 serves as a pressure-bearing surface. A fluid port 628 is provided through the piston mandrel 620 to allow fluid to access the shoulder 642. Beneficially, the fluid port 628 allows a pressure higher than hydrostatic pressure to be applied during gravel packing operations. The pressure is applied to the piston housing 640 to ensure that the packer elements 655 engage against the surrounding wellbore.

The packer 600 also includes a metering device. As the piston housing 640 translates along the piston mandrel 620, a metering orifice 664 regulates the rate the piston housing translates along the piston mandrel therefore slowing the movement of the piston housing and regulating the setting speed for the packer 600.

To further understand features of the illustrative mechanically-set packer 600, several additional cross-sectional views are provided. These are seen at FIGS. 6C, 6D, 6E, and 6F.

Figure 6D:
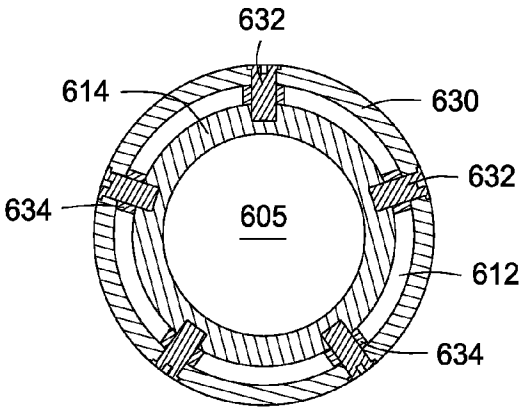
FIG. 6D is a cross-sectional view of the mechanically-set packer of FIG. 6A. The view is taken across line 6D-6D of FIG. 6B.
Figure 6C:
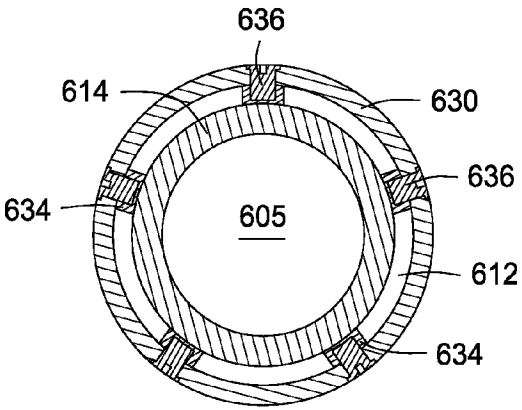
FIG. 6C is a cross-sectional view of the mechanically-set packer of FIG. 6A. The view is taken across line 6C-6C of FIG. 6A.

First, FIG. 6C is a cross-sectional view of the mechanically-set packer of FIG. 6A. The view is taken across line 6C-6C of FIG. 6A. Line 6C-6C is taken through one of the torque bolts 636. The torque bolt 636 connects the coupling 630 to the NACA key 634.

FIG. 6D is a cross-sectional view of the mechanically-set packer of FIG. 6A. The view is taken across line 6D-6D of FIG. 6B. Line 6D-6D is taken through another of the torque bolts 632. The torque bolt 632 connects the coupling 630 to the box connector 614, which is threaded to the inner mandrel 610.

Figure 6F:
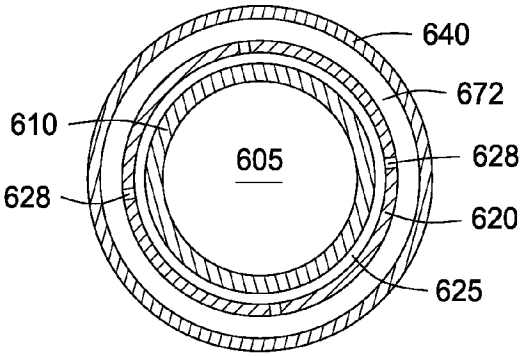
FIG. 6F is a cross-sectional view of the mechanically-set packer of FIG. 6A. The view is taken across line 6F-6F of FIG. 6B.
Figure 6E:
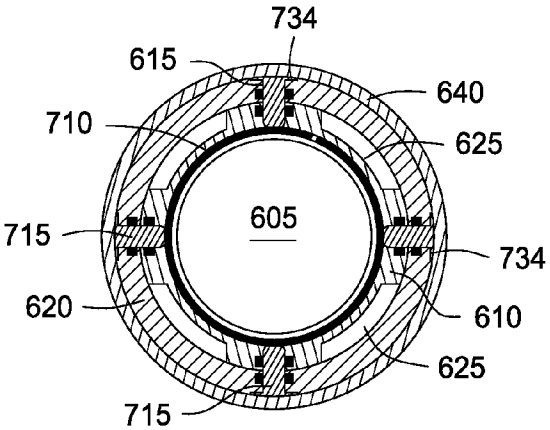
FIG. 6E is a cross-sectional view of the mechanically-set packer of FIG. 6A. The view is taken across line 6E-6E of FIG. 6A.

FIG. 6E is a cross-sectional view of the mechanically-set packer 600 of FIG. 6A. The view is taken across line 6E-6E of FIG. 6A. Line 6E-E is taken through the release key 715. It can be seen that the release key 715 passes through the piston mandrel 620 and into the inner mandrel 610. It is also seen that the alternate flow channel 625 resides between the release keys 715.

FIG. 6F is a cross-sectional view of the mechanically-set packer 600 of FIG. 6A. The view is taken across line 6F-6F of FIG. 6B. Line 6F-6F is taken through the fluid ports 628 within the piston mandrel 620. As the fluid moves through the fluid ports 628 and pushes the shoulder 642 of the piston housing 640 away from the ports 628, an annular gap 672 is created and elongated between the piston mandrel 620 and the piston housing 640.

Figure 8A:
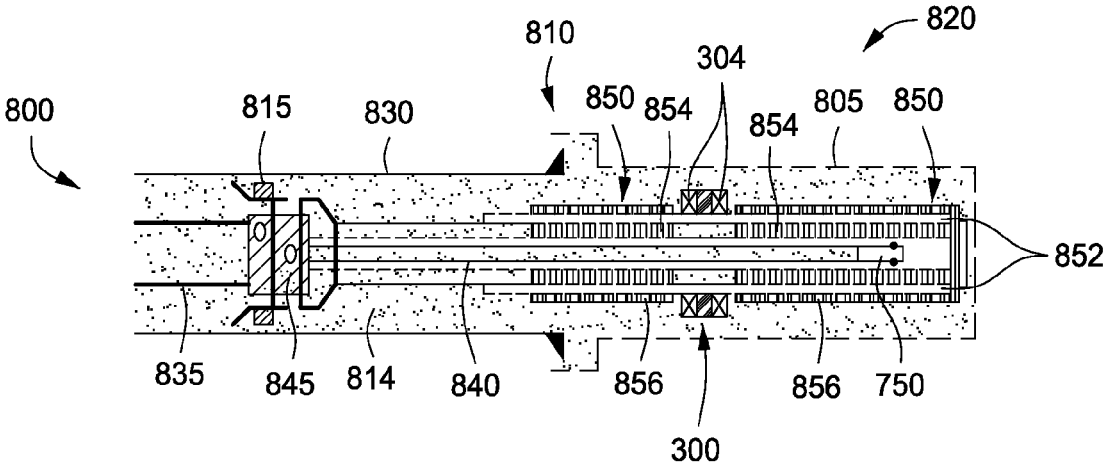
FIGS. 8A through 8N present stages of a gravel packing procedure using one of the packer assemblies of the present invention, in one embodiment. Alternate flowpath channels are provided through the packer elements of the packer assembly and through the sand control devices.

Once the fluid bypass packer 600 is set, gravel packing operations may commence. FIGS. 8A through 8N present stages of a gravel packing procedure, in one embodiment. The gravel packing procedure uses a packer assembly having alternate flow channels. The packer assembly may be in accordance with packer assembly 300 of FIG. 3A. The packer assembly 300 will have mechanically-set packers 304. These mechanically-set packers may be in accordance with packer 600 of FIGS. 6A and 6B.

In FIGS. 8A through 8N, sand control devices are utilized with an illustrative gravel packing procedure in a conditioned drilling mud. The conditioned drilling mud may be a non-aqueous fluid (NAF) such as a solids-laden oil-based fluid. Optionally, a solids-laden water-based fluid is also used. This process, which is a two-fluid process, may include techniques similar to the process discussed in International Pat. Appl. No. WO/2004/079145 and related U.S. Pat. No. 7,373,978, each of which is hereby incorporated by reference. However, it should be noted that this example is simply for illustrative purposes, as other suitable processes and fluids may be utilized.

In FIG. 8A, a wellbore 800 is shown. The illustrative wellbore 800 is a horizontal, open-hole wellbore. The wellbore 800 includes a wall 805. Two different production intervals are indicated along the horizontal wellbore 800. These are shown at 810 and 820. Two sand control devices 850 have been run into the wellbore 800. Separate sand control devices 850 are provided in each production interval 810, 820.

Each of the sand control devices 850 is comprised of a base pipe 854 and a surrounding sand screen 856. The base pipes 854 have slots or perforations to allow fluid to flow into the base pipe 854. The sand control devices 850 also each include alternate flow paths. These may be in accordance with shunt tubes 218 from either FIG. 4B or FIG. 5B. Preferably, the shunt tubes are internal shunt tubes disposed between the base pipes 854 and the sand screens 856 in the annular region shown at 852.

The sand control devices 850 are connected via an intermediate packer assembly 300. In the arrangement of FIG. 8A, the packer assembly 300 is installed at the interface between production intervals 810 and 820. More than one packer assembly 300 can be incorporated. The connection between the sand control devices 850 and a packer assembly 300 may be in accordance with U.S. Pat. No. 7,661,476, discussed above.

In addition to the sand control devices 850, a washpipe 840 has been lowered into the wellbore 800. The washpipe 840 is run into the wellbore 800 below a crossover tool or a gravel pack service tool (not shown) which is attached to the end of a drill pipe 835 or other working string. The washpipe 840 is an elongated tubular member that extends into the sand screens 850. The washpipe 840 aids in the circulation of the gravel slurry during a gravel packing operation, and is subsequently removed. Attached to the washpipe 840 is a shifting tool, such as the shifting tool 750 presented in FIG. 7C. The shifting tool 750 is positioned below the packer 300.

In FIG. 8A, a crossover tool 845 is placed at the end of the drill pipe 835. The crossover tool 845 is used to direct the injection and circulation of the gravel slurry, as discussed in further detail below.

A separate packer 815 is connected to the crossover tool 845. The packer 815 and connected crossover tool 845 are temporarily positioned within a string of production casing 830. Together, the packer 815, the crossover tool 845, the elongated washpipe 840, the shifting tool 750, and the gravel pack screens 850 are run into the lower end of the wellbore 800. The packer 815 is then set in the production casing 830. The crossover tool 845 is then released from the packer 815 and is free to move as shown in FIG. 8B.

Returning to FIG. 8A, a conditioned NAF (or other drilling mud) 814 is placed in the wellbore 800. Preferably, the drilling mud 814 is deposited into the wellbore 800 and delivered to the open-hole portion before the drill string 835 and attached sand screens 850 and washpipe 840 are run into the wellbore 800. The drilling mud 814 may be conditioned over mesh shakers (not shown) before the sand control devices 850 are run into the wellbore 800 to reduce any potential plugging of the sand control devices 850.

Figure 8B:
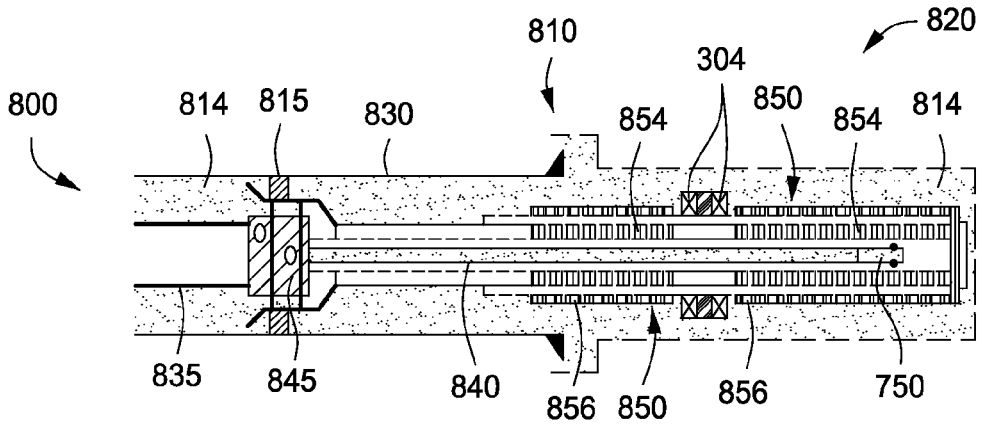
FIG. 8O shows the packer assembly and gravel pack having been set in an open-hole wellbore following completion of the gravel packing procedure from FIGS. 8A through 8N.

In FIG. 8B, the packer 815 is set in the production casing string 830. This means that the packer 815 is actuated to extend slips and an elastomeric sealing element against the surrounding casing string 830. The packer 815 is set above the intervals 810 and 820, which are to be gravel packed. The packer 815 seals the intervals 810 and 820 from the portions of the wellbore 800 above the packer 815.

Figure 8C:
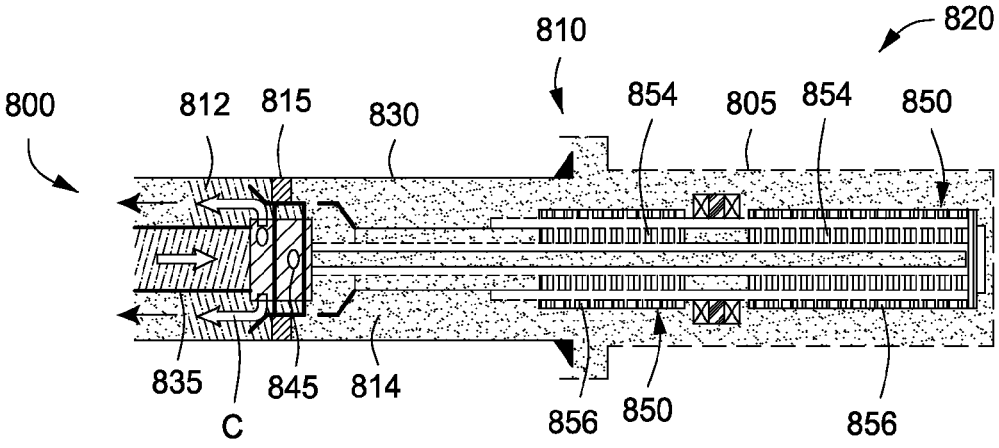

After the packer 815 is set, as shown in FIG. 8C, the crossover tool 845 is shifted up into a reverse position. Circulation pressures can be taken in this position. In most embodiments, a carrier fluid 812 is pumped down the drill pipe 835 and placed into an annulus between the drill pipe 835 and the surrounding production casing 830 above the packer 815. The carrier fluid is a gravel carrier fluid, which is the liquid component of the gravel packing slurry. (Those skilled in the art will recognize that in some embodiments a displacing fluid that is distinct from the carrier fluid may be used to displace or assist in displacing the drilling fluid, prior to the carrier fluid being introduced into the wellbore which then in turn displaces the displacement fluid. The displacement fluid may comprise the carrier fluid and/or another fluid composition. Such methods and embodiments are also within the scope of this invention.) The displacing or carrier fluid 812 displaces the conditioned drilling fluid 814 above the packer 815, which again may be an oil-based fluid such as the conditioned NAF. The carrier fluid 812 displaces the drilling fluid 814 in the direction indicated by arrows "C."

Figure 8D:
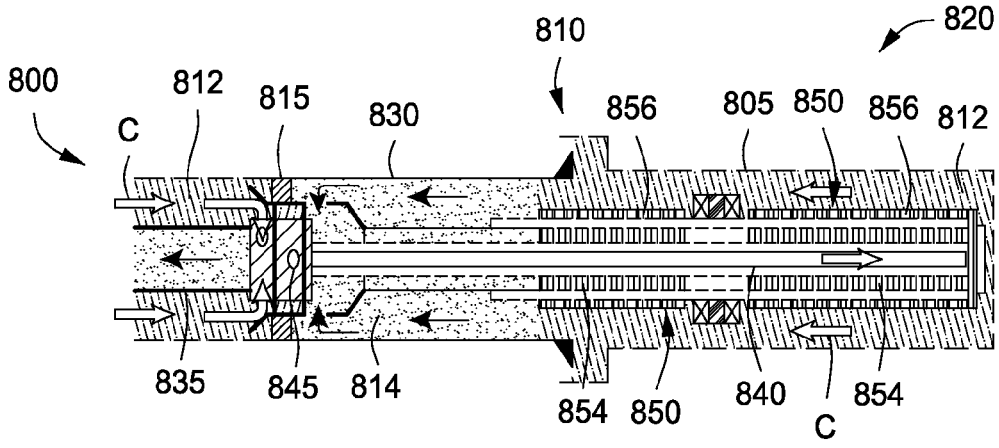

Next, in FIG. 8D, the crossover tool 845 is shifted back into a circulating position. This is the position used for circulating gravel pack slurry, and is sometimes referred to as the gravel pack position. The earlier placed carrier fluid 812 is pumped down the annulus between the drill pipe 835 and the production casing 830. The carrier fluid 812 is further pumped down the washpipe 840. This pushes the conditioned NAF 814 down the washpipe 840, out the sand screens 856, sweeping the open-hole annulus between the sand screens 856 and the surrounding wall 805 of the open-hole portion of the wellbore 800, through the crossover tool 845, and into the drill pipe 835. The flow path of the carrier fluid 812 is again indicated by the arrows "C."

Figure 8E:
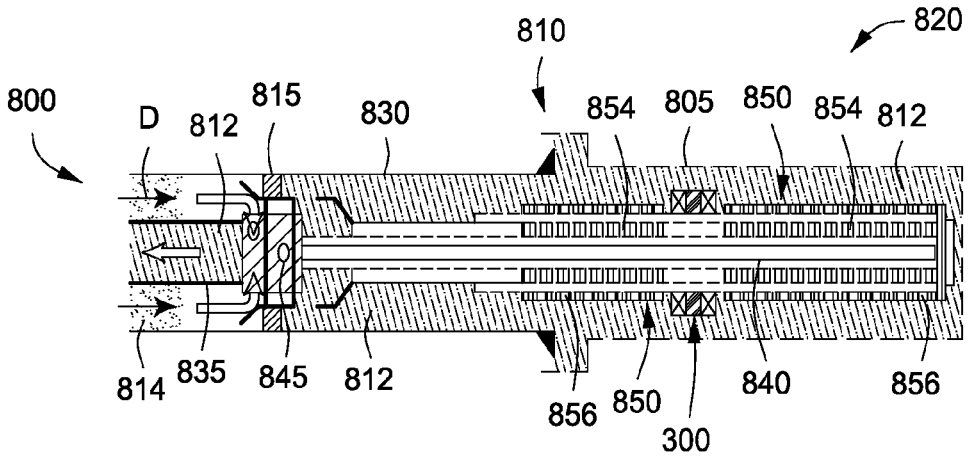
Figure 8F:
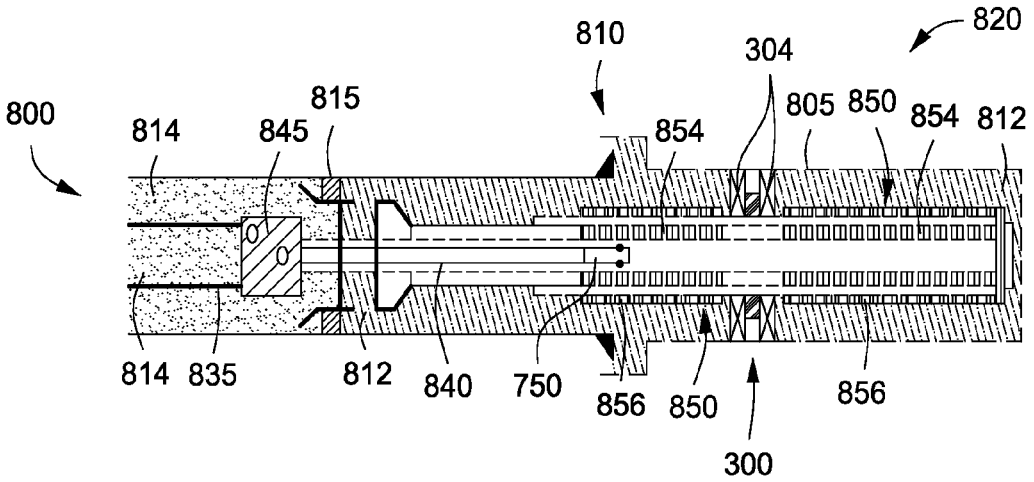
Figure 8G:
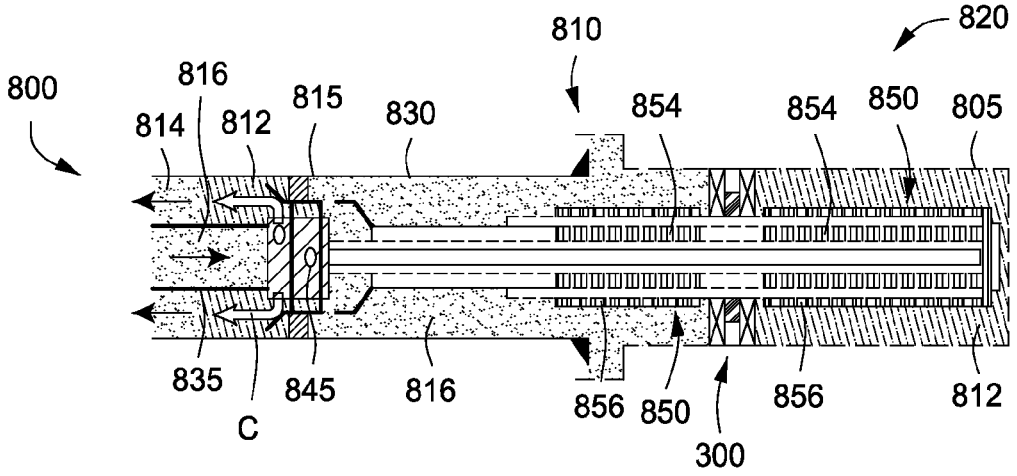

In FIGS. 8E through 8G, the production intervals 810, 820 are prepared for gravel packing.

In FIG. 8E, once the open-hole annulus between the sand screens 856 and the surrounding wall 805 has been swept with carrier fluid 812, the crossover tool 845 is shifted back to the reverse position. Conditioned drilling fluid 814 is pumped down the annulus between the drill pipe 835 and the production casing 830 to force the carrier fluid 812 out of the drill pipe 835, as shown by the arrows "D." These fluids may be removed from the drill pipe 835.

Next, the packers 304 are set, as shown in FIG. 8F by pulling the shifting tool located below the packer assembly 300 on the washpipe 840 and up past the packer assembly 300. More specifically, the mechanically-set packers 304 of the packer assembly 300 are set. The packers 304 may be, for example, packer 600 of FIGS. 6A and 6B. The packer 600 is used to isolate the annulus formed between the sand screens 856 and the surrounding wall 805 of the wellbore 800. The washpipe 840 is lowered to a reverse position.

While in the reverse position, as shown in FIG. 8G, the carrier fluid with gravel 816 may be placed within the drill pipe 835 and utilized to force the carrier fluid 812 up the annulus formed between the drill pipe 835 and production casing 830 above the packer 815, as shown by the arrows "C."

Figure 8H:
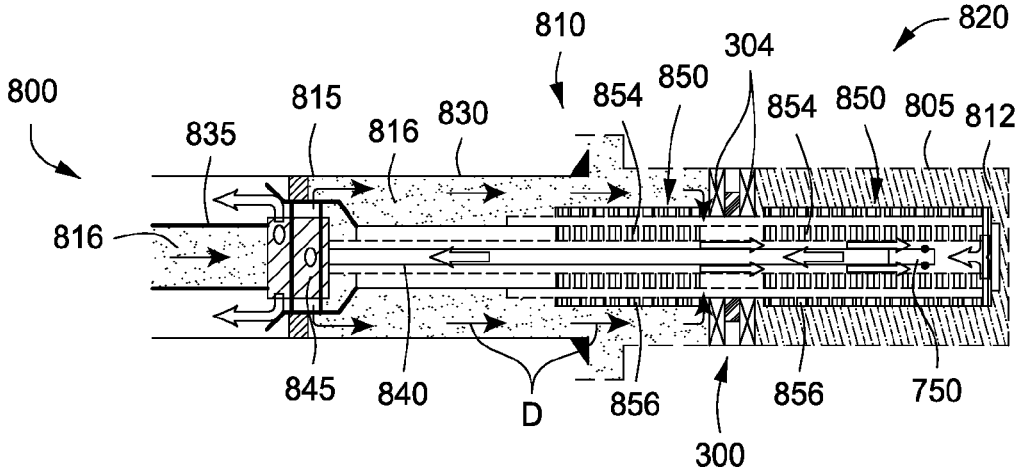
Figure 8I:
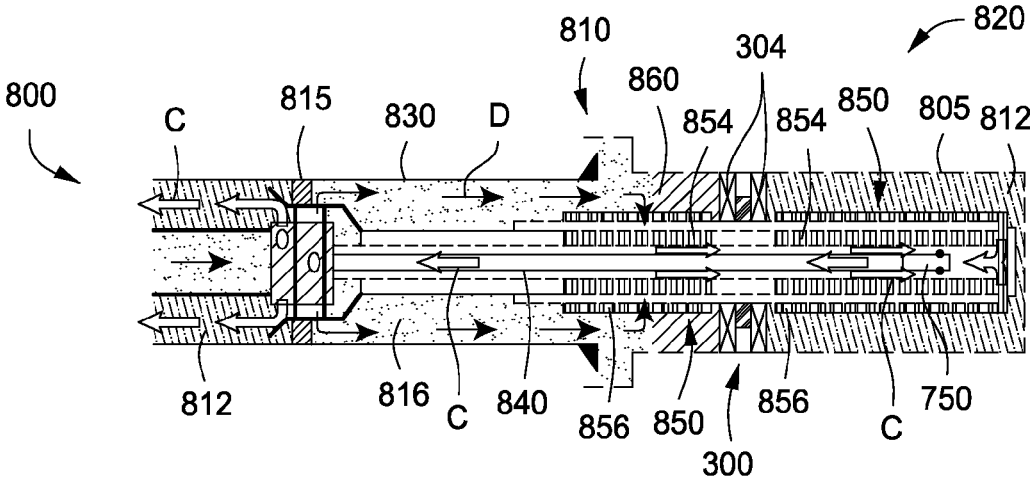
Figure 8J:
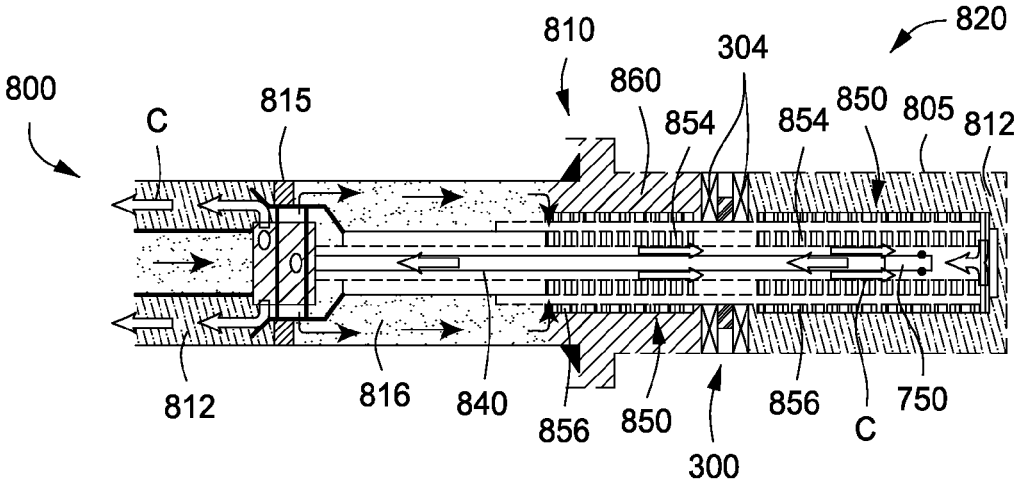

In FIGS. 8H through 8J, the crossover tool 845 may be shifted into the circulating position to gravel pack the first subsurface interval 810.

In FIG. 8H, the carrier fluid with gravel 816 begins to create a gravel pack within the production interval 810 above the packer 300 in the annulus between the sand screen 856 and the wall 805 of the open-hole wellbore 800. The fluid flows outside the sand screen 856 and returns through the washpipe 840 as indicated by the arrows "D." The carrier fluid 812 in the wellbore annulus is forced into screen, through the washpipe 840, and up the annulus formed between the drill pipe 835 and production casing 830 above the packer 815.

In FIG. 8I, a first gravel pack 860 begins to form above the packer 300. The gravel pack 860 is forming around the sand screen 856 and towards the packer 815. Carrier fluid 812 is circulated below the packer 300 and to the bottom of the wellbore 800. The carrier fluid 812 without gravel flows up the washpipe 840 as indicated by arrows "C."

In FIG. 8J, the gravel packing process continues to form the gravel pack 860 toward the packer 815. The sand screen 856 is now being fully covered by the gravel pack 860 above the packer 300. Carrier fluid 812 continues to be circulated below the packer 300 and to the bottom of the wellbore 800. The carrier fluid 812 sans gravel flows up the washpipe 840 as again indicated by arrows "C."

Once the gravel pack 860 is formed in the first interval 810 and the sand screens above the packer 300 are covered with gravel, the carrier fluid with gravel 816 is forced through the shunt tubes (shown at 318 in FIG. 3B). The carrier fluid with gravel 816 forms the gravel pack 860 in FIGS. 8K through 8N.

Figure 8K:
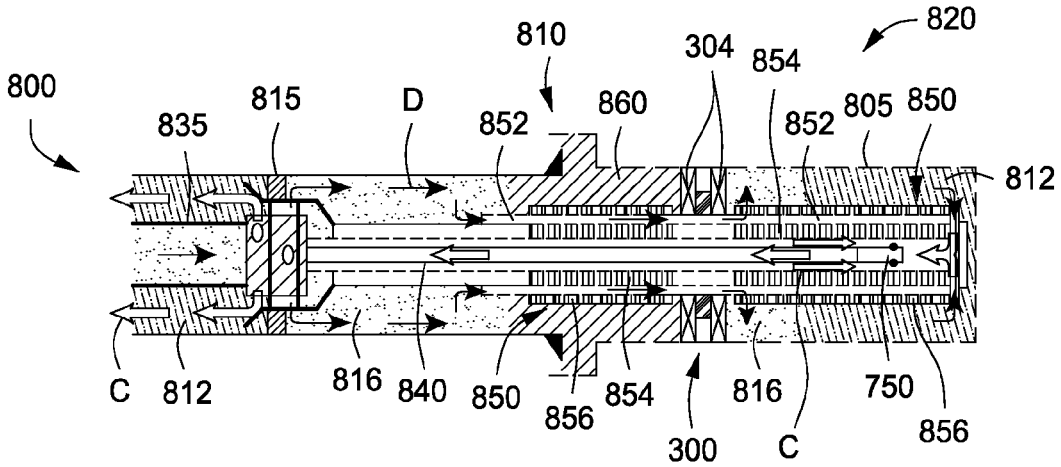

In FIG. 8K, the carrier fluid with gravel 816 now flows within the production interval 820 below the packer 300. The carrier fluid 816 flows through the shunt tubes and packer 300, and then outside the sand screen 856. The carrier fluid 816 then flows in the annulus between the sand screen 856 and the wall 805 of the wellbore 800, and returns through the washpipe 840. The flow of carrier fluid with gravel 816 is indicated by arrows "D," while the flow of carrier fluid in the washpipe 840 without the gravel is indicated at 812, shown by arrows "C."

It is noted here that slurry only flows through the bypass channels along the packer sections. After that, slurry will go into the alternate flow channels in the next, adjacent screen joint. Alternate flow channels have both transport and packing tubes manifolded together at each end of a screen joint. Packing tubes are provided along the sand screen joints. The packing tubes represent side nozzles that allow slurry to fill any voids in the annulus. Transport tubes will take the slurry further downstream.

Figure 8L:
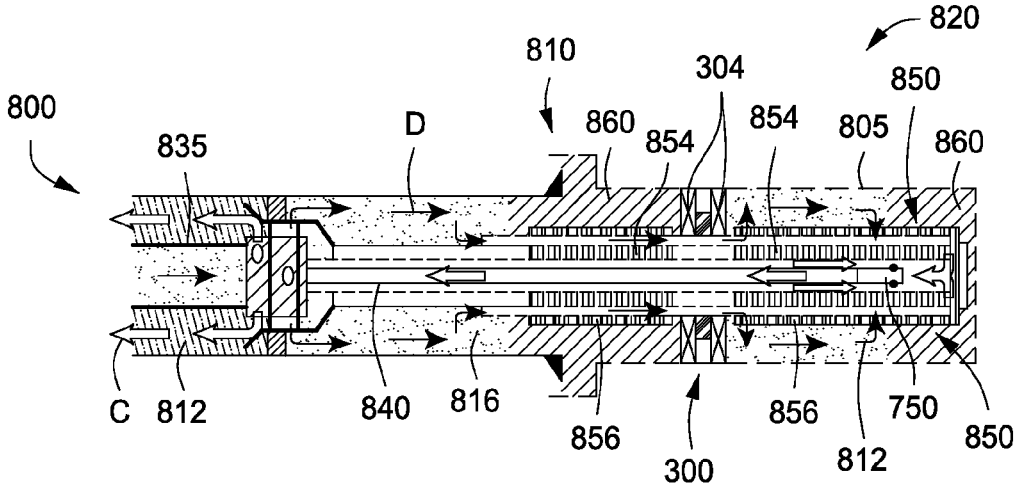
Figure 8M:
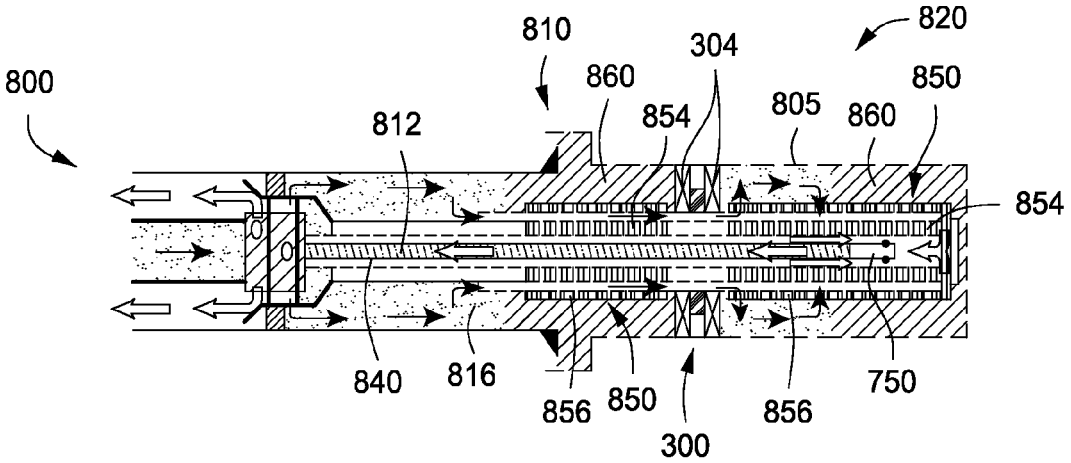
Figure 8N:
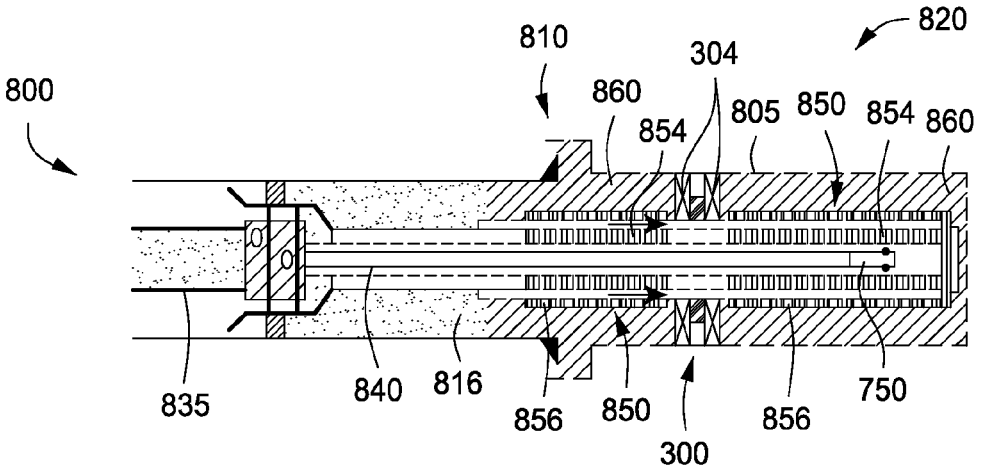

In FIG. 8L, the gravel pack 860 is beginning to form below the packer 300 and around the sand screen 856. In FIG. 8M, the gravel packing continues to grow the gravel pack 860 from the bottom of the wellbore 800 up toward the packer 300. In FIG. 8N, the gravel pack 860 has been formed from the bottom of the wellbore 800 up to the packer 300. The sand screen 856 below the packer 300 has been covered by gravel pack 860. The surface treating pressure increases to indicate that the annular space between the sand screens 856 and the wall 805 of the wellbore 800 is fully gravel packed.

Figure 8O:
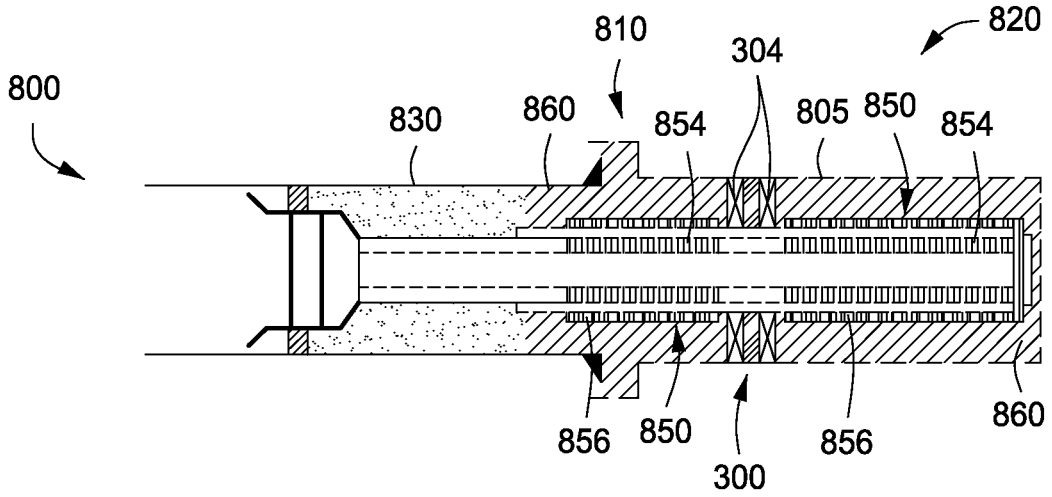

FIG. 8O shows the drill string 835 and the washpipe 840 from FIGS. 8A through 8N having been removed from the wellbore 800. The casing 830, the base pipes 854, and the sand screens 856 remain in the wellbore 800 along the upper 810 and lower 820 production intervals. Packer 300 and the gravel packs 860 remain set in the open hole wellbore 800 following completion of the gravel packing procedure from FIGS. 8A through 8N. The wellbore 800 is now ready for production operations.

As mentioned above, once a wellbore has undergone gravel packing, the operator may choose to isolate a selected interval in the wellbore, and discontinue production from that interval. To demonstrate how a wellbore interval may be isolated, FIGS. 9A and 9B are provided.

Figure 9A:
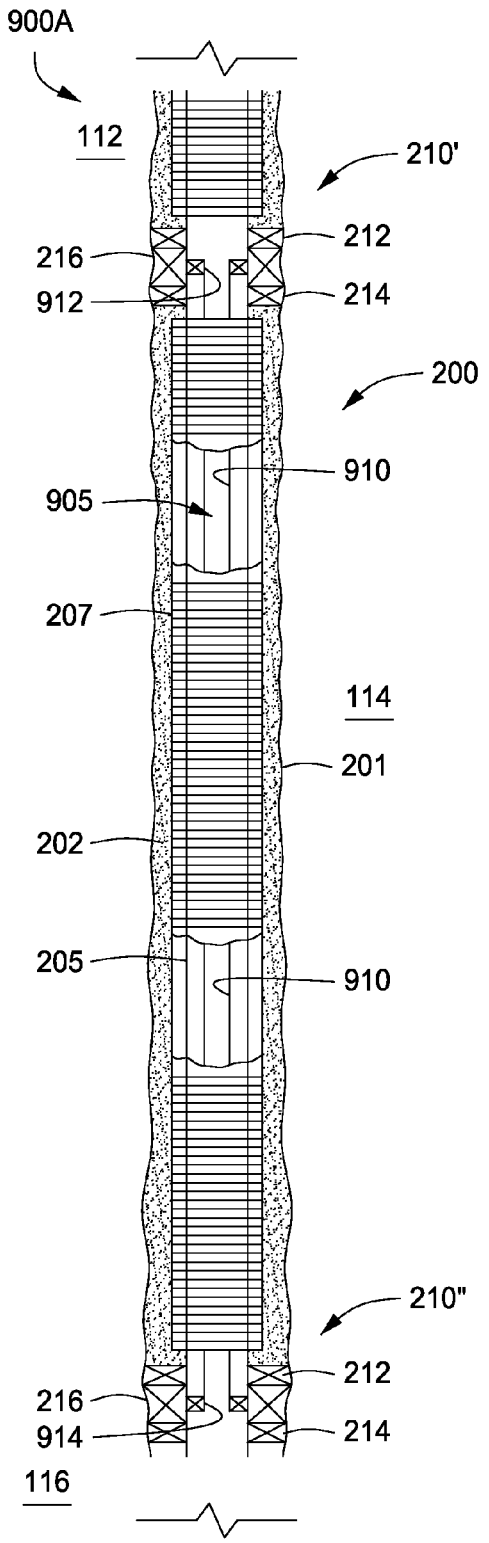
FIG. 9A is a cross-sectional view of a middle interval of the open-hole completion of FIG. 2. Here, a straddle packer has been placed within a sand control device across the middle interval to prevent the inflow of formation fluids.
Figure 9B:
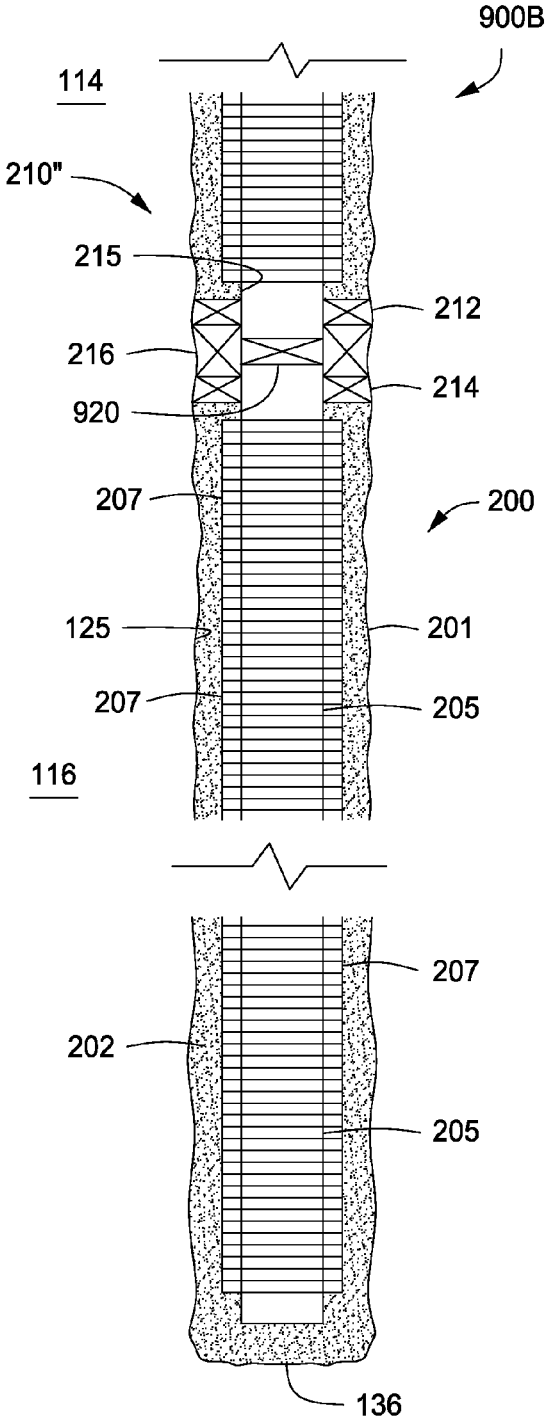
FIG. 9B is a cross-sectional view of middle and lower intervals of the open-hole completion of FIG. 2. Here, a plug has been placed within a packer assembly between the middle and lower intervals to prevent the flow of formation fluids up the wellbore from the lower interval.

First, FIG. 9A is a cross-sectional view of a wellbore 900A. The wellbore 900A is generally constructed in accordance with wellbore 100 of FIG. 2. In FIG. 9A, the wellbore 900A is shown intersecting through a subsurface interval 114. Interval 114 represents an intermediate interval. This means that there is also an upper interval 112 and a lower interval 116 (seen in FIG. 2, but not shown in FIG. 9A).

The subsurface interval 114 may be a portion of a subsurface formation that once produced hydrocarbons in commercially viable quantities but has now suffered significant water or hydrocarbon gas encroachment. Alternatively, the subsurface interval 114 may be a formation that was originally a water zone or aquitard or is otherwise substantially saturated with aqueous fluid. In either instance, the operator has decided to seal off the influx of formation fluids from interval 114 into the wellbore 900A.

A sand control device 200 has been placed in the wellbore 900A. Sand control device 200 is in accordance with the sand control device 200 of FIG. 2. In addition, a base pipe 205 is seen extending through the intermediate interval 114. The base pipe 205 is part of the sand control device 200. The sand control device 200 also includes a mesh screen, a wire-wrapped screen, or other radial filter medium 207. The base pipe 205 and surrounding filter medium 207 preferably comprise a series of joints connected end-to-end. The joints are ideally about 5 to 45 feet in length.

It is noted here that the sand control device 200 in FIGS. 9A and 9B may be in various forms. In some embodiments, the sand control device 200 is a sand screen such as described in U.S. Pat. No. 7,464,752.

Figure 10A:
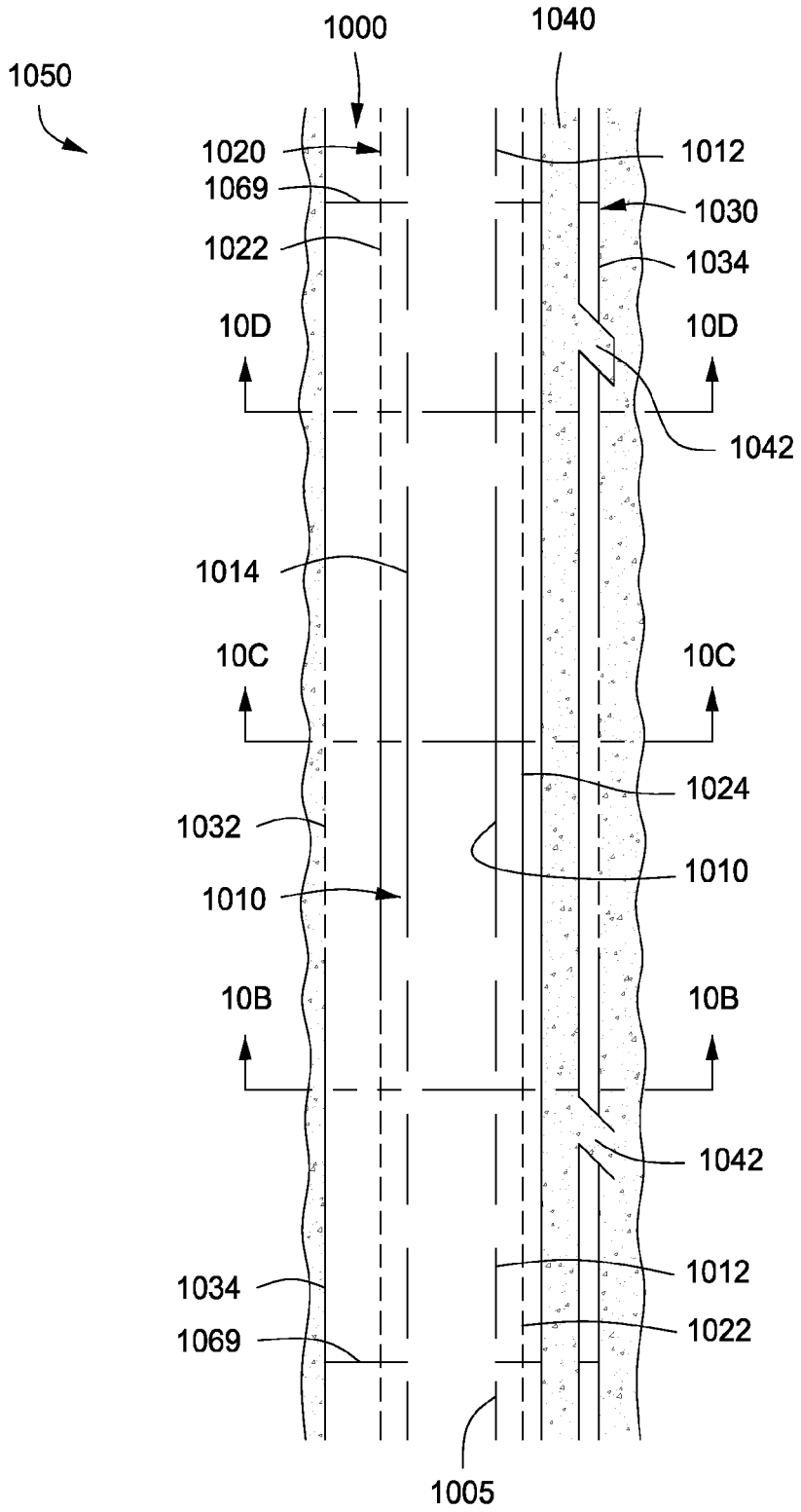
FIGS. 10A through 10D present a sand screen that may be used as part of a wellbore completion system having alternate flow channels. This screen utilizes the MazeFlo™ technology.

FIG. 10A illustrates a MazeFlo™ screen 1000, in one embodiment. The illustrative screen 1000 utilizes three concentric conduits to enable the flow of hydrocarbons while filtering out formation fines. In the arrangement of FIG. 10A, the first conduit is a base pipe 1010; the second conduit is a wire mesh or screen 1020; and the third conduit is a surrounding outer wire mesh or screen 1030.

Each conduit 1010, 1020, 1030 includes both permeable and impermeable sections. The permeable sections contain a filtering medium designed to retain particles larger than a predetermined size, while allowing fluids to pass through. For the first conduit 1010, the permeable sections are represented by slots 1012, while the impermeable section is represented by blank pipe 1014. For the second conduit 1020, the permeable sections are represented by wire screen or mesh 1022, while the impermeable section is represented by blank pipe 1024. For the third conduit 1030, the permeable sections are represented by wire screen or mesh 1032, while the impermeable section is represented by blank pipe 1034. The permeable sections 1022, 1032 are preferably a wire-wrapped screen wherein the gap between two wires is sufficient to retain most formation sand produced into wellbore 1050. The impermeable sections 1024, 1034 may also be wire-wrapped screens, but with the pitch of the wires so small as to effectively close off the flow of any fluids there through.

Figure 10B:
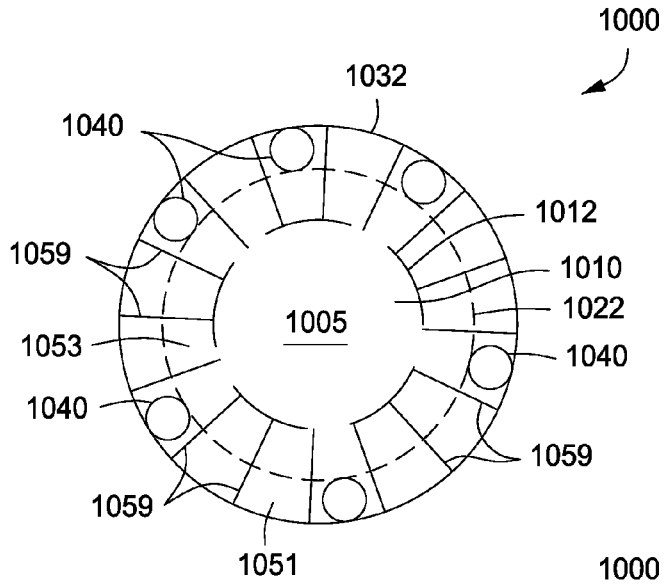
Figure 10C:
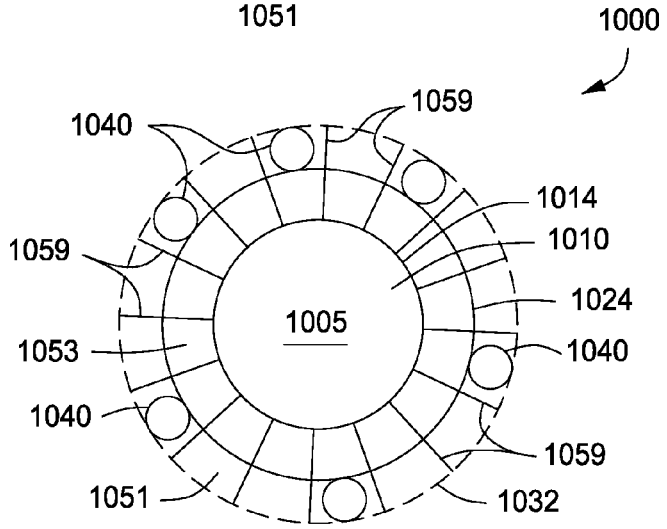
Figure 10D:
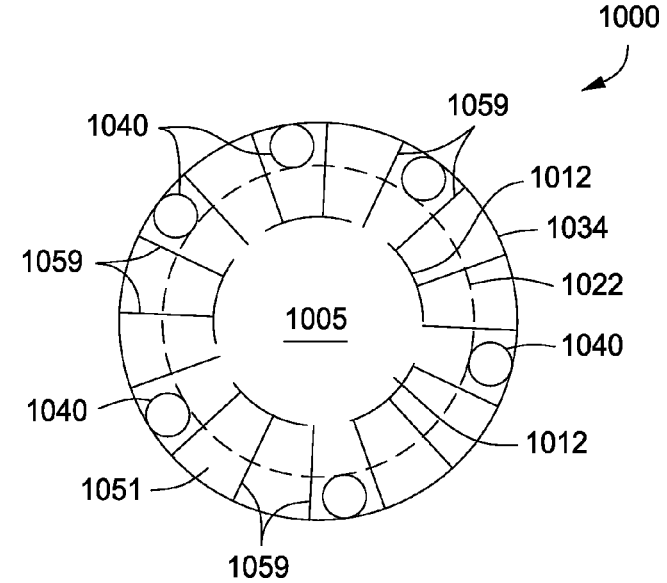

Cross-sectional views of the sand screen 1000 are provided in FIGS. 10B, 10C, and 10D. FIG. 10B is a cross-sectional view taken across line 10B-10B of FIG. 10A; FIG. 10C is a cross-sectional view taken across line 10C-10C of FIG. 10A; and FIG. 10D is a cross-sectional view taken across line 10D-10D of FIG. 10A.

It can be seen in the cross-sectional views of FIGS. 10B, 10C, and 10D that a series of small pipes are disposed radially around the sand screen 1000. These are shunt tubes 1040. The shunt tubes 1040 connect with alternate flow channels to carry gravel slurry along a portion of the wellbore undergoing a gravel packing operation. Nozzles 1042 serve as outlets for gravel slurry so as to bypass any sand bridges (not shown) or packer in the wellbore annulus.

It can also be seen in the cross-sectional views of FIGS. 10B, 10C, and 10D that a series of optional walls 1059 is provided. The walls 1059 are substantially impermeable and serve to create compartments or flow joints 1051, 1053 within the conduits 1020, 1030. In a three-dimensional perspective, the compartments or flow joints 1051, 1053 can be longitudinally bounded by either permeable, impermeable, partially permeable, or partially impermeable section dividers 1069, as shown in FIG. 10A.

Each of the compartments 1051, 1053 (or flow joints) has at least one inlet and at least one outlet. Compartments 1051 reside around the second conduit 1020, while compartments 1053 reside around the first conduit 1010. The compartments 1051, 1053 are adapted to accumulate particles to progressively increase resistance to fluid flow through the compartments 1051, 1053 in the event a permeable section of a conduit is compromised and permits formation particles to invade.

In the arrangement of FIG. 10A, the primary means of flow for hydrocarbons is the first conduit 1010. A central bore 1005 is formed within the first conduit 1010 to transport hydrocarbon fluids to a surface. The central bore 1005 may be considered an additional compartment. In operation, if the outermost conduit 1030 (e.g., filter medium 1032) fails and particulates enter the compartments 1051, the impermeable section 1024 and the permeable section 1022 along the second conduit 1020 will nevertheless prevent sand infiltration while still allowing fluids to pass through. Continuous sand invasion increases the sand concentration in the compartments 1051 around the second conduit 1020 and subsequently increases the frictional pressure loss, resulting in gradually diminished fluid/sand flow through the permeable sections 1022 of the second conduit 1020. Fluid production is then diverted to other permeable sections 1032 without filter media failure.

This same "backup system" also works with respect to the first conduit 1010. If a failure occurs in the second conduit 1020 such that formation particles pass through the second conduit 1020, then the slots in the permeable section 1012 of the first conduit 1010 will at least partially filter out formation particles.

The number of compartments 1053, 1051 along the respective circumferences of the second 1020 and third 1030 conduits may depend on borehole size for the wellbore 1000 and the type of permeable media used. Fewer compartments would enable larger compartment size and result in fewer redundant flow paths if sand infiltrates an outermost compartment 1051. A larger number of compartments 1053, 1051 would decrease the compartment sizes, increase frictional pressure losses, and reduce well productivity. The operator may choose to adjust the relative sizes of the compartments 1053, 1051.

As shown in FIG. 10A, preferably at least one impermeable and permeable section of the flow joints are adjacent. More preferably, at any cross-section location of the MazeFlo™ screen, at least one wall of the flow joint should be impermeable. Therefore, there is in this preferred embodiment, at least one flow joint that is impermeable is adjacent to at least one flow joint that is permeable at any cross-section location of the MazeFlo™ screen. This preferred embodiment is illustrated in FIGS. 10B, 10C and 10D whereby there are at any given cross-section location, at least one wall that is impermeable and at least one wall that is permeable.

Additional details concerning the sand screen 1000 is provided in U.S. Pat. No. 7,464,752 cited above. FIGS. 4A through 4D and FIGS. 5A through 5D, and accompanying descriptive text found in columns 7 through 9, are incorporated herein by reference.

As an alternative to the MazeFlo™ sand screen 1000 of FIGS. 10A through 10D, a separate sand screen design may be employed that utilizes inflow control devices, or "ICD's." ICD's are sometimes used with sand control devices to regulate flow from different production intervals downhole. Examples of known ICD's include Reslink's RESFLOW™ Baker Hughes' EQUALIZER™, and Weatherford's FLO-REG™. These devices are typically used in long, horizontal, open-hole completions to balance inflow into the completion across production intervals or zones. The balanced inflow enhances reservoir management and reduces the risk of early water or gas breakthrough from a high permeability reservoir streak or from the heel of a well. Additionally, more hydrocarbons may be captured from the toe of a horizontally completed well through the application of the inflow control technology.

Because gravel packing operations generally involve passing large quantities of fluid, such as carrier fluid, through a sand screen, gravel packing with typical ICD's is not feasible because the ICD's represent a substantial restriction in fluid flow for the carrier fluid. In this respect, the gravel slurry and the production fluids use the same flow paths. Localized and reduced inflow of the carrier fluid due to ICD's may cause early bridging, loose packs, voids, and/or increased pressure requirements during gravel pack pumping. U.S. Pat. No. 7,984,760 discloses three different methods for employing inflow control technology with a gravel packing operation.

FIGS. 11A through 11G present a sand control device 1100 that may be used as part of a wellbore completion system having alternate flow channels. The sand control device 1100 is designed to be coupled to a crossover tool (not shown), and provides one or more flow paths 1114 for a carrier fluid through a sand screen 1104 and into a base pipe 1102 during gravel packing operations. The carrier or gravel pack fluid may include XC gel (xanthomonas campestris or xanthan gum), visco-elastic fluids having non-Newtonian rheology properties, a fluid viscosified with hydroxyethylcellulose (HEC) polymer, a fluid viscosified with refined xanthan polymer (e.g. Kelco's XANVIS®), a fluid viscosified with visco-elastic surfactant, and/or a fluid having a favorable rheology and sand carrying capacity for gravel packing a wellbore.

The sand screen 1104 utilizes an inflow control device as disclosed in the '092 publication. The illustrative inflow control device is a choke 1108 at one end of the screen 1100. A swellable packer 1112 is provided at the other end of the screen 1100 to contain production fluids after gravel packing and during production.

Figure 11A:
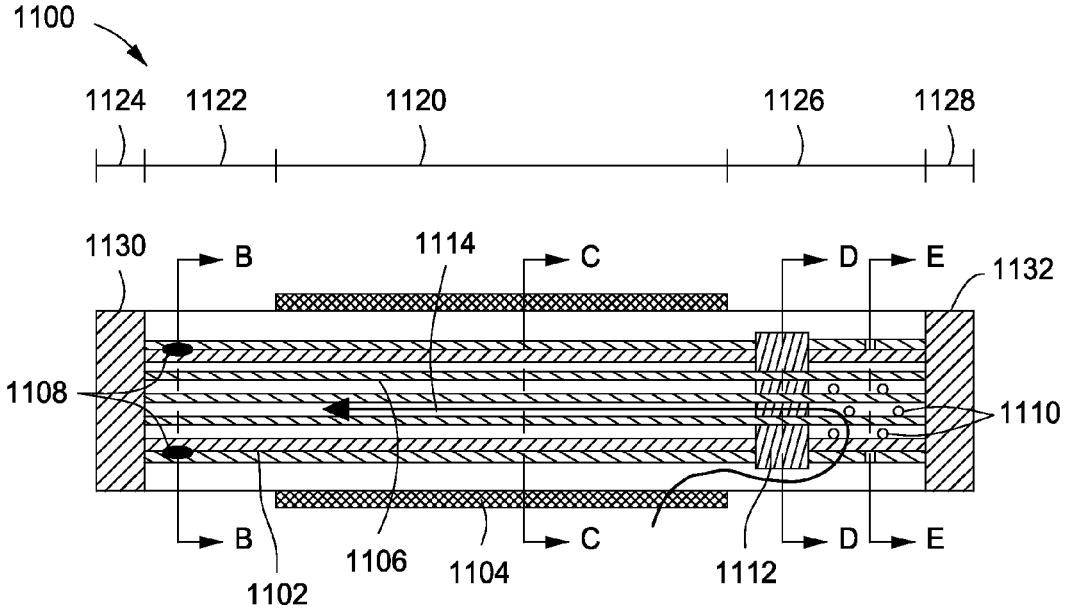
FIGS. 11A through 11G present a sand control device that may be used as part of a wellbore completion system having alternate flow channels. This device utilizes a screen with an inflow control device.

FIG. 11A provides a side view of the illustrative sand control device 1100. The sand control device 1100 includes a tubular member or base pipe 1102. The base pipe 1102 includes openings 1110 for receiving carrier fluid during a gravel packing operation, and for receiving production fluids during later production. The base pipe 1102 is surrounded by a sand screen 1104 having ribs 1105. The sand screen 1104 includes a permeable section, such as a wire-wrapped screen or filter medium, and a non-permeable section, such as a section of blank pipe. The ribs 1105, which are not shown in FIG. 11A for simplicity but are seen in FIG. 11C, are utilized to keep the sand screen 1104 a specific distance from the base pipe 1102. The space between the base pipe 1102 and the sand screen 1104 forms an annular chamber that is accessible from the fluids external to the sand control device 1100 via the permeable section.

The sand control device 1100 has a sealing element 1112. The sealing element 1112 is configured to provide one or more flow paths to the openings 1110 and/or inflow control device 1108 during gravel packing operations, and to block the flow path to the openings 1110 prior to or during production operations. As such, the sand control device 1100 may be utilized to enhance operations within a well.

In FIG. 11A, the sand control device 1100 includes various components utilized to manage the flow of fluids and solids into a well. For instance, the sand control device 1100 includes a main body section 1120, an inflow control section 1122, a first connection section 1124, a perforated section 1126 and a second connection section 1128, which may be made of steel, metal alloys, or other suitable materials. The main body section 1120 may be a portion of the base pipe 1102 surrounded by a portion of the sand screen 1104. The main body section 1120 may be configured to be a specific length, such as between 10 and 50 feet, and having specific internal and outer diameters. The inflow control section 1122 and perforated section 1126 may be other portions of the base pipe 1102 surrounded by other portions of the sand screen 1104. The inflow control section 1122 and perforated section 1126 may be configured to be between 0.5 feet and 4 feet in length.

The first 1124 and second 1128 connection sections may be utilized to couple the sand control device 1100 to other sand control devices or piping, and may be the location of the chamber formed by the base pipe 1102 and sand screen 1104 ends. The first 1124 and second 1128 connection sections may be configured to be a specific length, such as 2 inches to 4 feet or other suitable distance, having specific internal and outer diameters.

In some embodiments, coupling mechanisms may be utilized within the first 1124 and second 1128 connection sections to form the secure and sealed connections. For instance, a first connection 1130 may be positioned within the first connection section 1124, and a second connection 1132 may be positioned within the second connection section 1128. These connections 1130 and 1132 may include various methods for forming connections with other devices. For example, the first connection 1130 may have internal threads and the second connection 1132 may have external threads that form a seal with other sand control devices or another pipe segment. It should also be noted that in other embodiments, the coupling mechanism for the sand control device 1100 may include connecting mechanisms as described in U.S. Pat. Nos. 6,464,261 and 7,661,476, for example.

As noted, the sand control device 1100 also includes an inflow control device 1108. The inflow control device 1108 may include one or more nozzles, orifices, tubes, valves, tortuous paths, shaped objects or other suitable mechanisms known in the art to create a pressure drop. The inflow control device 1108 chokes flow through form pressure loss (e.g. a shaped object, nozzle) or frictional pressure loss (e.g. helical geometry/tubes).

Form pressure loss, which is based on the shape and alignment of an object relative to fluid flow, is caused by separation of fluid that is flowing over an object. This results in turbulent pockets at different pressure behind the object. The openings 1110 may be utilized to provide additional flow paths for the fluids, such as carrier fluids, during gravel packing operations because the inflow control device 1108 may restrict the placement of gravel by hindering the flow of carrier fluid into the base pipe 1102 during gravel packing operations. The number of openings 1110 in the base pipe 1102 may be selected to provide adequate inflow during the gravel packing operations to achieve partial or substantially complete gravel packing. That is, the number and size of the openings 1110 in the base pipe 1102 may be selected to provide sufficient fluid flow from the wellbore through the sand screen 1104, which is utilized to deposit gravel in the wellbore and to form the gravel pack (not shown).

The sealing or expansion element 1112 surrounds the base pipe 1102. The expansion element 1112 constitutes a swellable material, that is, a swelling rubber element or a swellable polymer. The swellable material may expand in the presence of a stimulus, such as water, conditioned drilling fluid, a completion fluid, a production fluid (i.e. hydrocarbons), other chemical, or any combination thereof. As an example, a swellable material may be placed in the sand control device 1100, which expands in the presence of hydrocarbons to form a seal between the walls of the base pipe 1102 and the non-permeable section of the sand screen 1104. Examples of swellable materials include Easy Well Solutions' Constrictor™ and SwellFix's E-ZIP™ or P-ZIP™. Other expandable materials that are sensitive to temperature and fluid chemistry may also be used. These include a shape-memory polymer such as the Baker Hughes GeoFORM™.

Alternatively, the sealing element 1112 may be activated chemically, mechanically by the removal of a washpipe, and/or via a signal, electrical or hydraulic, to isolate the openings 1110 from the fluid flow during some or all of the production operations.

The sand control device 1100 of FIG. 11A also includes shunt tubes 1106. The shunt tubes 1106 provide alternate flow paths for gravel slurry. Alternate flow channels gravel packing techniques with proper fluid leak-off through the sand screen 1104 have been demonstrated in the field to achieve a complete gravel pack.

Figure 11B:
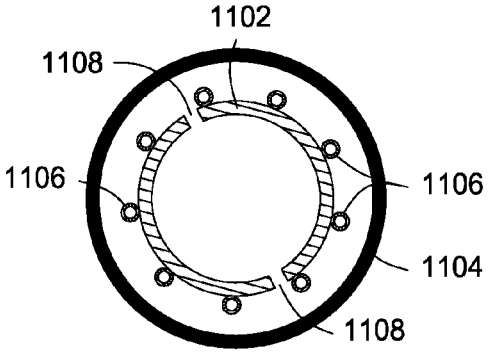
Figure 11C:
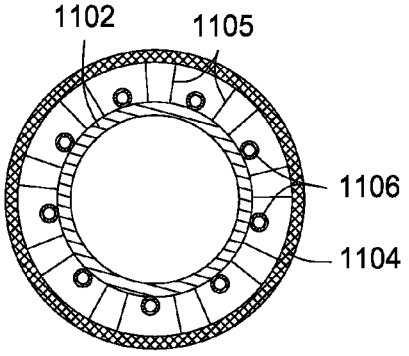

FIG. 11B is a cross-sectional view of the sand control 1100, taken across line 11B-11B of FIG. 11A. Alternate flow channels or shunt tubes 1106 are seen internal to the screen 1104. The ICD 1108 representing small flow-openings is also seen.

FIG. 11C is a cross-sectional view of the sand control device 1100 taken across line 11C-11C of FIG. 11A. Ribs 1105 are shown between the shunt tubes 1106.

Figure 11D:
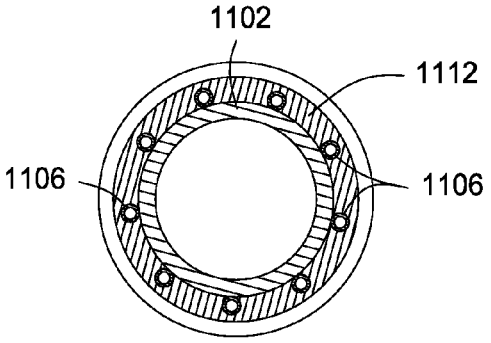

FIG. 11D is a cross-sectional view of the sand control device 1100 taken across line 11D-11D of FIG. 11A. The sealing element 1112 is seen around the base pipe 1102 in an un-actuated state. In this respect, during the gravel packing operations the sealing element 1112 does not block the flow path 1114 and provides an alternative flow path for carrier fluid in addition to the inflow control device 1108. Beneficially, by utilizing the shunt tubes 1106, longer portions of intervals may be packed without leaking off into the formation. Accordingly, the shunt tubes 1106 provide a mechanism for forming a substantially complete gravel pack along the sand screen 1104 that bypasses sand and/or gravel bridges.

Figure 11E:
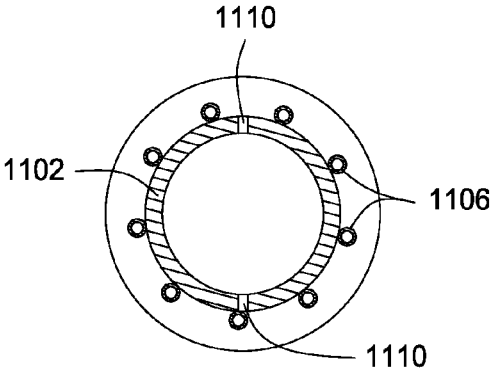

FIG. 11E is a cross-sectional view of the sand control device 1100 taken across line 11E-11E of FIG. 11A. The shunt tubes 1106 are shown around the permeable section of the base pipe 1102. The shunt tubes 1106 may include packing tubes and/or transport tubes. The packing tubes may have one or more valves or nozzles (not shown) that provide a flow path for the gravel pack slurry, which includes a carrier fluid and gravel, to the annulus formed between the sand screen 1104 and the walls of a wellbore (not shown). The valves may prevent fluids from an isolated interval from flowing through the at least one shunt tubes to another interval. These shunt tubes are known in the art as further described in U.S. Pat. Nos. 5,515,915, 5,890,533, 6,220,345 and 6,227,303. One of the openings 1110 is also visible in FIG. 11E.

Figure 11F:
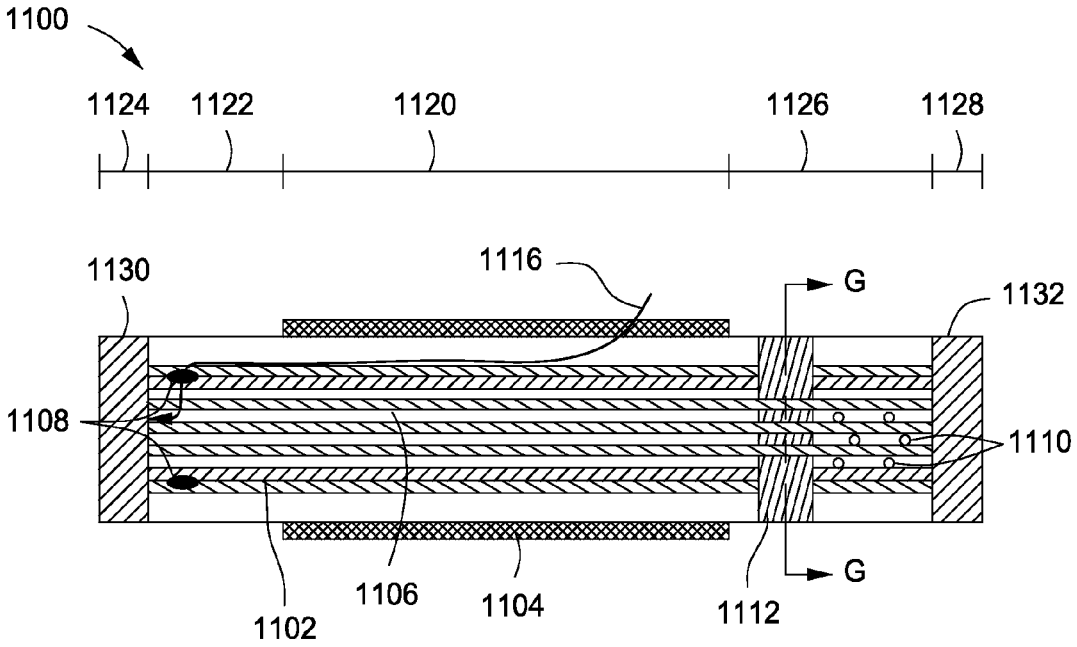

FIG. 11F is another side view of the sand control device 1100 of FIG. 11A. Production operations have begun and production fluids are flowing into the base pipe 1102 as indicated by arrow 1116. It is seen in FIG. 11F that the swellable packer 1112 has been actuated and blocks annular flow at one end of the sand screen 1104. Specifically, the sealing element 1112 is blocking fluid flow through the openings 1110. In this embodiment, the sealing element 1112 includes either multiple individual portions positioned between adjacent shunt tubes 1106, or a single sealing element with openings for the shunt tubes 1106.

In operation, the sand control device 1100 may be run in a water-based mud with a hydrocarbon-swellable material used for the sealing element 1112. During screen running and gravel packing operations, the chamber between the base pipe 1102 and the sand screen 1104 is open for fluid flow through the inflow control device 1108 and/or openings 1110. However, during production operations, such as post-well testing operations, the sealing element 1112 comprising a hydrocarbon-swellable material (or, optionally, individual sections of swellable material) expands to close off the chamber within the perforated section 1126. As a result, the fluid flow is limited to the inflow control device 1108 once the sealing element 1112 comprising a hydrocarbon-swellable material isolates the openings 1110. As a result, the sand control device 1100, which may be coupled to a production tubing string 130 or other piping, provides a specific flow path 1116 for formation fluids through the sand screen 1104 and inflow control device 1108 and into the base pipe 1102. Thus, the openings 1110 are isolated to limit fluid flow to only the inflow control device 1108, which is designed to manage the flow of fluids from a surrounding interval (such as interval 112 seen in FIG. 1).

Figure 11G:
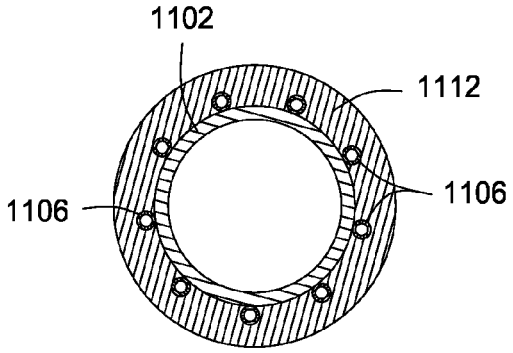

FIG. 11G is a cross-sectional view of the sand control device 1100, taken across line 11G-11G of FIG. 11F. The swellable packer 1112 is seen filling an annular region between the base pipe 1102 and the surrounding screen 1104.

Additional details concerning the sand control device 1100 are described in U.S. Patent Publ. No. 2009/0008092. Specifically, paragraphs 0054 through 0057 are incorporated herein by reference.

Other arrangements for a swellable inflow control device are also provided in U.S. Patent Publ. No. 2009/0008092. Paragraph 0058 and accompanying FIGS. 5A through 5F describe an embodiment for a swellable packer wherein the sealing element and the shunt tubes are configured to engage ribs radially spaced around the base pipe. Paragraphs 0059 through 0061 and accompanying FIGS. 6A through 6G describe an embodiment for a swellable packer wherein the shunt tubes are external to the sand screen, providing an eccentric configuration. These portions of U.S. Patent Publ. No. 2009/0008092 are likewise incorporated herein by reference.

U.S. Patent Publ. No. 2009/0008092 discloses two other ways of providing ICD's for a gravel pack for use in an open hole completion. Once such way involves the use of a flow-through conduit. The conduit runs along and internal to the sand screen. Paragraphs 0072 and accompanying FIGS. 9A through 9E describe such an embodiment using internal shunt tubes. Paragraphs 0073 and 0074 and accompanying FIGS. 10A through 10C describe such an embodiment using internal shunt tubes. These portions of U.S. Patent Publ. No. 2009/0008092 are likewise incorporated herein by reference.

Another such way involves the use of a sleeve. The sleeve may slide or it may rotate to selectively cover all or a portion of openings 1110. In this manner, inflow control is provided. Paragraphs 0075 through 0080 and accompanying FIGS. 11A through 11F describe the use of a sleeve. These portions of U.S. Patent Publ. No. 2009/0008092 are likewise incorporated herein by reference.

Returning now to FIG. 9A, the wellbore 900A has an upper packer assembly 210' and a lower packer assembly 210". The upper packer assembly 210' is disposed near the interface of the upper interval 112 and the intermediate interval 114, while the lower packer assembly 210" is disposed near the interface of the intermediate interval 114 and the lower interval 116. Each packer assembly 210', 210" is preferably in accordance with packer assembly 300 of FIGS. 3A and 3B. In this respect, the packer assemblies 210', 210" will each have opposing mechanically-set packers 304. Optionally, the packer assemblies 210', 210" will also each have an intermediate swellable packer 308. The mechanically-set packers are shown in FIG. 9A at 212 and 214, while the intermediate swellable packer is shown at 216. The mechanically-set packers 212, 214 may be in accordance with packer 600 of FIGS. 6A and 6B.

The dual packers 212, 214 are mirror images of each other, except for the release sleeves (e.g., release sleeve 710 and associated shear pin 720). As noted above, unilateral movement of a shifting tool (such as shifting tool 750) shears the shear pins 720 and moves the release sleeves 710. This allows the packer elements 655 to be activated in sequence, the lower one first, and then the upper one.

The wellbore 900A is completed as an open-hole completion. A gravel pack has been placed in the wellbore 900A to help guard against the inflow of granular particles. Gravel packing is indicated as spackles in the annulus 202 between the filter media 207 of the sand screen 200 and the surrounding wall 201 of the wellbore 900A.

In the arrangement of FIG. 9A, the operator desires to continue producing formation fluids from upper 112 and lower 116 intervals while sealing off intermediate interval 114. The upper 112 and lower 116 intervals are formed from sand or other rock matrix that is permeable to fluid flow. To accomplish this, a straddle packer 905 has been placed within the sand screen 200. The straddle packer 905 is placed substantially across the intermediate interval 114 to prevent the inflow of formation fluids from the intermediate interval 114.

The straddle packer 905 comprises a mandrel 910. The mandrel 910 is an elongated tubular body having an upper end adjacent the upper packer assembly 210', and a lower end adjacent the lower packer assembly 210". The straddle packer 905 also comprises a pair of annular packers. These represent an upper packer 912 adjacent the upper packer assembly 210', and a lower packer 914 adjacent the lower packer assembly 210". The novel combination of the upper packer assembly 210' with the upper packer 912 and the lower packer assembly 210" with the lower packer 914 allows the operator to successfully isolate a subsurface interval such as intermediate interval 114 in an open-hole completion.

Another technique for isolating an interval along an open-hole formation is shown in FIG. 9B. FIG. 9B is a side view of a wellbore 900B. Wellbore 900B may again be in accordance with wellbore 100 of FIG. 2. Here, the lower interval 116 of the open-hole completion is shown. The lower interval 116 extends essentially to the bottom 136 of the wellbore 900B and is the lowermost zone of interest.

In this instance, the subsurface interval 116 may be a portion of a subsurface formation that once produced hydrocarbons in commercially viable quantities but has now suffered significant water or hydrocarbon gas encroachment. Alternatively, the subsurface interval 116 may be a formation that was originally a water zone or aquitard or is otherwise substantially saturated with aqueous fluid. In either instance, the operator has decided to seal off the influx of formation fluids from the lower interval 116 into the wellbore 100.

To accomplish this, a plug 920 has been placed within the wellbore 100. Specifically, the plug 920 has been set in the mandrel 215 supporting the lower packer assembly 210". Of the two packer assemblies 210', 210", only the lower packer assembly 210" is seen. By positioning the plug 920 in the lower packer assembly 210", the plug 920 is able to prevent the flow of formation fluids up the wellbore 200 from the lower interval 116.

It is noted that in connection with the arrangement of FIG. 9B, the intermediate interval 114 may comprise a shale or other rock matrix that is substantially impermeable to fluid flow. In this situation, the plug 920 need not be placed adjacent the lower packer assembly 210"; instead, the plug 920 may be placed anywhere above the lower interval 116 and along the intermediate interval 114. Further, in this instance the upper packer assembly 210' need not be positioned at the top of the intermediate interval 114; instead, the upper packer assembly 210' may also be placed anywhere along the intermediate interval 114. If the intermediate interval 114 is comprised of unproductive shale, the operator may choose to place blank pipe across this region, with alternate flow channels, i.e. transport tubes, along the intermediate interval 114.

Figure 12:
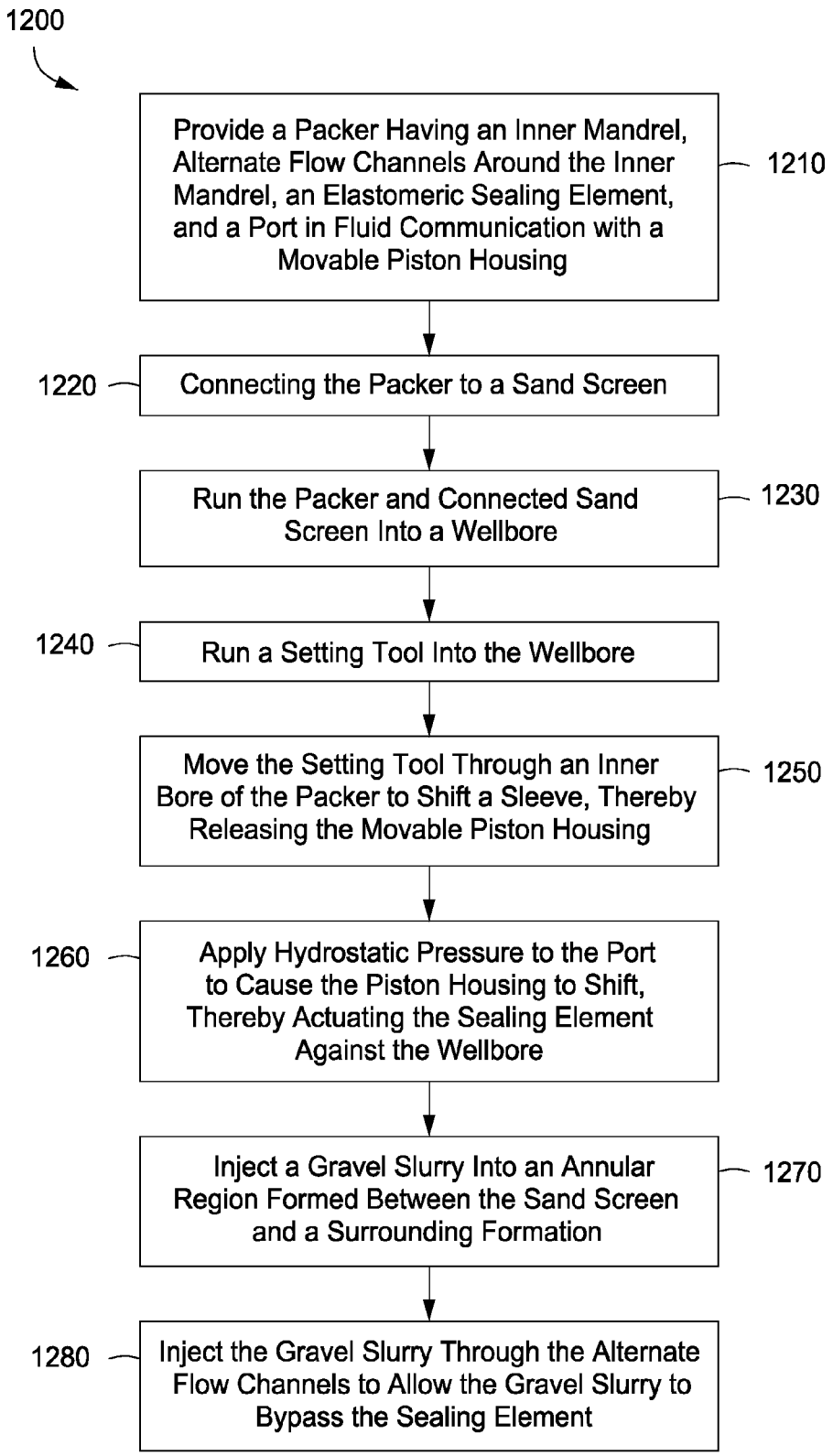
FIG. 12 is a flowchart for a method of completing a wellbore, in one embodiment. The method involves setting a packer and installing a gravel pack in the wellbore.

A method for completing an open-hole wellbore is also provided herein. The method is presented in FIG. 12. FIG. 12 provides a flow chart presenting steps for a method 1200 of completing an open-hole wellbore, in various embodiments.

The method 1200 first includes providing a packer. This is shown at Box 1210. The packer may be in accordance with packer 600 of FIGS. 6A and 6B. Thus, the packer is a mechanically-set packer that is set against an open-hole wellbore to seal an annulus.

Fundamentally, the packer will have an inner mandrel, and alternate flow channels around the inner mandrel. The packer may further have a movable piston housing and an elastomeric sealing element. The sealing element is operatively connected to the piston housing. This means that sliding the movable piston housing along the packer (relative to the inner mandrel) will actuate the sealing element into engagement with the surrounding wellbore.

The packer may also have a port. The port is in fluid communication with the piston housing. Hydrostatic pressure within the wellbore communicates with the port. This, in turn, applies fluid pressure to the piston housing. Movement of the piston housing along the packer in response to hydrostatic pressure causes the elastomeric sealing element to be expanded into engagement with the surrounding wellbore.

It is preferred that the packer also have a centralizing system. An example is the centralizer 650 of FIGS. 6A and 6B. It is also preferred that mechanical force used to actuate the sealing element be applied by the piston housing through the centralizing system. In this way, both the centralizers and the sealing element are set through the same hydrostatic force.

The method 1200 also includes connecting the packer to a sand screen. This is provided at Box 1220. The sand screen comprises a base pipe and a surrounding filter medium. The sand screen is equipped with alternate flow channels.

Preferably, the packer is one of two mechanically-set packers having cup-type sealing elements. The two packers form a packer assembly. The packer assembly is placed within a string of sand screens or blanks equipped with alternate flow channels. Preferably, a swellable packer is placed between the two mechanically-set packers.

As an alternative, the packer is a first zonal isolation tool, and is connected to a sand screen. A second zonal isolation tool is used as a back-up, and is a gravel-based zonal isolation tool. The use of a gravel-based zonal isolation tool is described below in connection with FIGS. 14A and 14B.

Regardless of the arrangement, the method 1200 also includes running the packer and the connected sand screen into a wellbore. This is shown at Box 1230. In addition, the method 1200 includes running a setting tool into the wellbore. This is provided at Box 1240. Preferably, the packer and connected sand screen are run first, followed by the setting tool. The setting tool may be in accordance with exemplary setting tool 750 of FIG. 7C. Preferably, the setting tool is part of or is run in with a washpipe.

The method 1200 next includes moving the setting tool through the inner mandrel of the packer. This is shown at Box 1250. The setting tool is translated within the wellbore through mechanical force. Preferably, the setting tool is at the end of a working string such as coiled tubing.

Movement of the setting tool through the inner mandrel causes the setting tool to shift a sleeve along the inner mandrel. In one aspect, shifting the sleeve will shear one or more shear pins. In any aspect, shifting the sleeve releases the piston housing, permitting the piston housing to shift or to slide along the packer relative to the inner mandrel. As noted above, this movement of the piston housing permits the sealing element to be actuated against the wall of the surrounding open-hole wellbore.

In connection with the moving step of Box 1250, the method 1200 also includes communicating hydrostatic pressure to the port. This is seen in Box 1260. Communicating hydrostatic pressure means that the wellbore has sufficient energy stored in a column of fluid to create a hydrostatic head, wherein the hydrostatic head acts against a surface or shoulder on the piston housing. The hydrostatic pressure includes pressure from fluids in the wellbore, whether such fluids are completion fluids or reservoir fluids, and may also include pressure contributed downhole by a reservoir. Because the shear pins (including set screws) have been sheared, the piston housing is free to move.

The method 1200 also includes injecting a gravel slurry into an annular region formed between the sand screen and the surrounding formation. This is provided at Box 1270 of FIG. 12. In addition, the method 1200 includes injecting the gravel slurry through the alternate flow channels. This allows the gravel slurry to at least partially bypass the sealing element so that the wellbore is gravel-packed within the annular region below the packer. This is shown at Box 1280.

Figure 13:
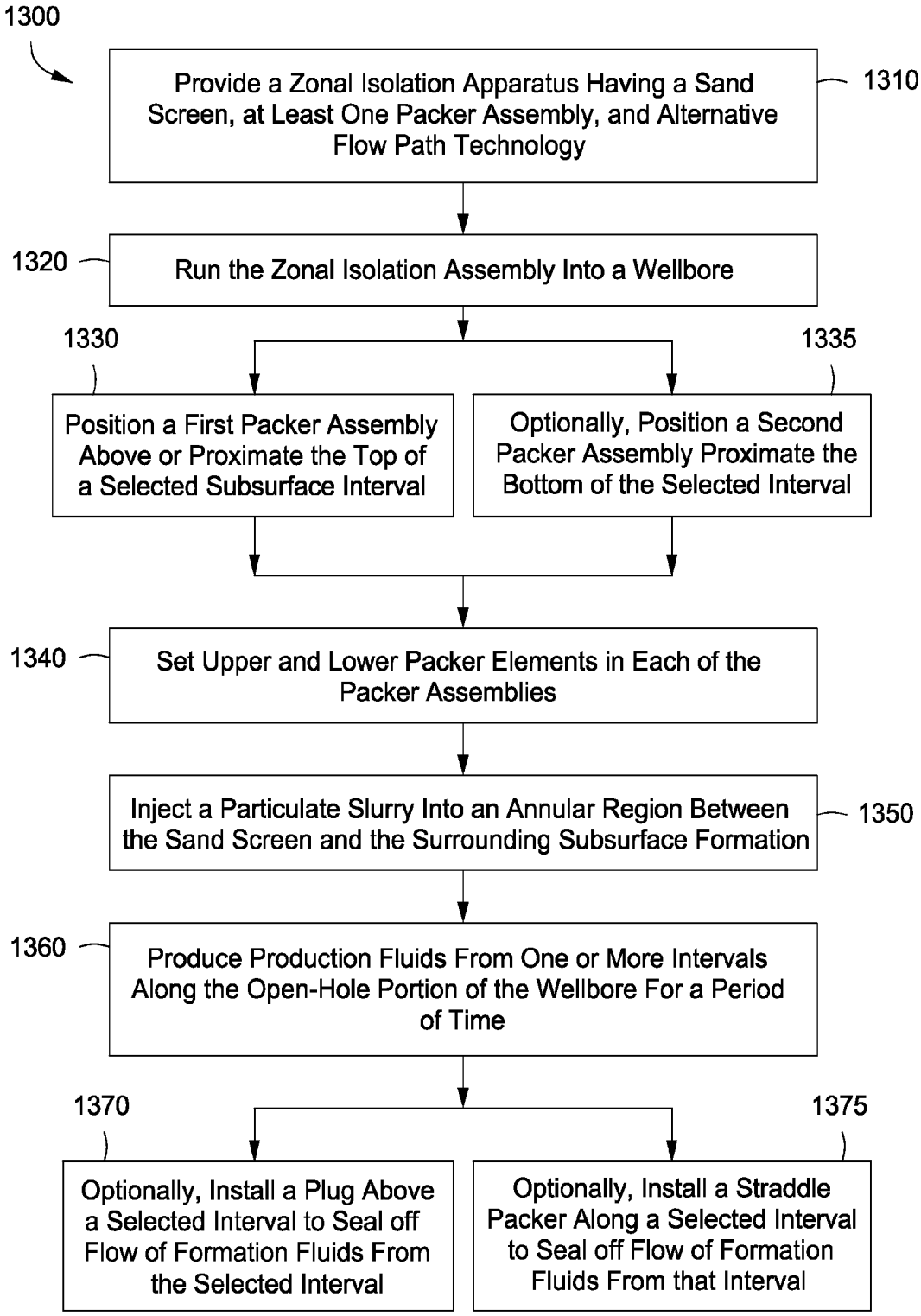
FIG. 13 is a flowchart showing steps that may be performed in connection with a method for completing an open-hole wellbore, in an alternate embodiment. The method involves the installation of a zonal isolation apparatus.

A separate method is provided herein for completing a wellbore. This method is shown in FIG. 13 as method 1300. FIG. 13 is also a flowchart showing steps for the method 1300.

The method 1300 first includes providing a zonal isolation apparatus. This is shown at Box 1310. The zonal isolation apparatus is preferably in accordance with the components described above in connection with FIG. 2. In this respect, the zonal isolation apparatus may first include a sand screen. The sand screen will represent a base pipe and a surrounding mesh or wound wire. The zonal isolation apparatus will also have at least one packer assembly. The packer assembly will have at least one mechanically-set packer, with the mechanically-set packer having alternate flow channels.

Preferably, the packer assembly will have at least two mechanically set packers and an intermediate elongated swellable packer. Alternate flow channels will travel through each of the mechanically-set packers and the intermediate swellable packer element. Preferably, the zonal isolation apparatus will comprise at least two packer assemblies separated by sand screen joints.

The method 1300 also includes running the zonal isolation apparatus into the wellbore. The step of running the zonal isolation apparatus into the wellbore is shown at Box 1320. The zonal isolation apparatus is run into a lower portion of the wellbore, which is preferably completed as an open-hole.

The open-hole portion of the wellbore may be completed substantially vertically. Alternatively, the open-hole portion may be deviated, or even horizontal.

The method 1300 also includes positioning the zonal isolation apparatus in the wellbore. This is shown in FIG. 13 at Box 1330. The step 1330 of positioning the zonal isolation apparatus is preferably done by hanging the zonal isolation apparatus from a lower portion of a string of production casing. The apparatus is positioned such that the sand screen is adjacent one or more selected production intervals along the open-hole portion of the wellbore. Further, a first of the at least one packer assembly is positioned above or proximate the top of a selected subsurface interval.

In one embodiment, the open-hole wellbore traverses through three separate intervals. These include an upper interval from which hydrocarbons are produced, and a lower interval from which hydrocarbons are no longer being produced in economically viable volumes. Such intervals may be formed of sand or other permeable rock matrix. The intervals may also include an intermediate interval from which hydrocarbons are not produced. The formation along the intermediate interval may be formed of shale or other substantially impermeable material. The operator may choose to position the first of the at least one packer assembly near the top of the lower interval or anywhere along the non-permeable intermediate interval.

In one aspect, the at least one packer assembly is placed proximate a top of an intermediate interval. Optionally, a second packer assembly is positioned proximate the bottom of a selected interval such as the intermediate interval. This is shown in Box 1335.

The method 1300 next includes setting the mechanically set packer elements in each of the at least one packer assembly. This is provided in Box 1340. Mechanically setting the upper and lower packer elements means that an elastomeric (or other) sealing member engages the surrounding wellbore wall. The packer elements isolate an annular region formed between the sand screens and the surrounding subsurface formation above and below the packer assemblies.

Beneficially, the step of setting the packer of Box 1340 is provided before slurry is injected into the annular region. Setting the packer provides a hydraulic and mechanical seal to the wellbore before any gravel is placed around the elastomeric element. This provides a better seal during the gravel packing operation.

The step of Box 1340 may be accomplished by using the packer 600 of FIGS. 6A and 6B. The open-hole, mechanically-set packer 600 enables gravel pack completions to gain the current flexibility of standalone screen (SAS) applications by providing future zonal isolation of unwanted fluids while enjoying the benefits of an alternate flow channel gravel pack completion.

The method 1300 for completing an open-hole wellbore also includes injecting a particulate slurry into the annular region. This is demonstrated in Box 1350. The particulate slurry is made up of a carrier fluid and sand (and/or other) particles. One or more alternate flow channels allow the particulate slurry to bypass the sealing elements of the mechanically-set packers. In this way, the open-hole portion of the wellbore is gravel-packed below, or above and below (but not between), the mechanically-set packer elements.

For the method 1300, the sequence for annulus pack-off may vary. For example, if a premature sand bridge is formed during gravel packing, the annulus above the bridge will continue to be gravel packed via fluid leak-off through the sand screen due to the alternate flow channels. In this respect, some slurry will flow into and through the alternate flow channels to bypass the premature sand bridge and deposit a gravel pack. As the annulus above the premature sand bridge is nearly completely packed, slurry is increasingly diverted into and through the alternate flow channels. Here, both the premature sand bridge and the packer will be bypassed so that the annulus is gravel packed below the packer.

It is also possible that a premature sand bridge may form below the packer. Any voids above or below the packer will eventually be packed by the alternate flow channels until the entire annulus is fully gravel packed.

During pumping operations, once gravel covers the screens above the packer, slurry is diverted into the shunt tubes, then passes through the packer, and continues to pack below the packer via the shunt tubes (or alternate flow channels) with side ports allowing slurry to exit into the wellbore annulus. The hardware provides the ability to seal off bottom water, selectively complete or gravel pack targeted intervals, perform a stacked open-hole completion, or isolate a gas/water-bearing sand following production. The hardware further allows for selective stimulation, selective water or gas injection, or selective chemical treatment for damage removal or sand consolidation.

The method 1300 further includes producing production fluids from intervals along the open-hole portion of the wellbore. This is provided at Box 1360. Production takes place for a period of time.

In one embodiment of the method 1300, flow from a selected interval may be sealed from flowing into the wellbore. For example, a plug may be installed in the base pipe of the sand screen above or near the top of a selected subsurface interval. This is shown at Box 1070. Such a plug may be used at or below the lowest packer assembly, such as the second packer assembly from step 1335.

In another example, a straddle packer is placed along the base pipe along a selected subsurface interval to be sealed. This is shown at Box 1375. Such a straddle may involve placement of sealing elements adjacent upper and lower packer assemblies (such as packer assemblies 210', 210" of FIG. 2 or FIG. 9A) along a mandrel.

It is noted that the mechanically-set packers used in connection with the methods 1200 and 1300 above are complex downhole tools. The tools must be designed not only to withstand the high temperatures and pressures of a downhole environment, but must be reliable enough to provide at least a temporary wellbore seal while a gravel packing procedure is being undertaken at high fluid velocities. As such, the mechanically-set packer is an expensive device. This expense is increased when a packer assembly is employed that includes two mechanically-set packers plus an intermediate swellable packer.

Because of the cost, in some instances the operator may wish to utilize a less-expensive, gravel-based zonal isolation system in lieu of a second mechanically-set packer. Such a system relies upon a long blank pipe surrounded by densely packed sand. Such a system is described in WO Pat. Publ. No. 2010/120419 entitled "Systems and Methods for Providing Zonal Isolation in Wells."

Figure 14A:
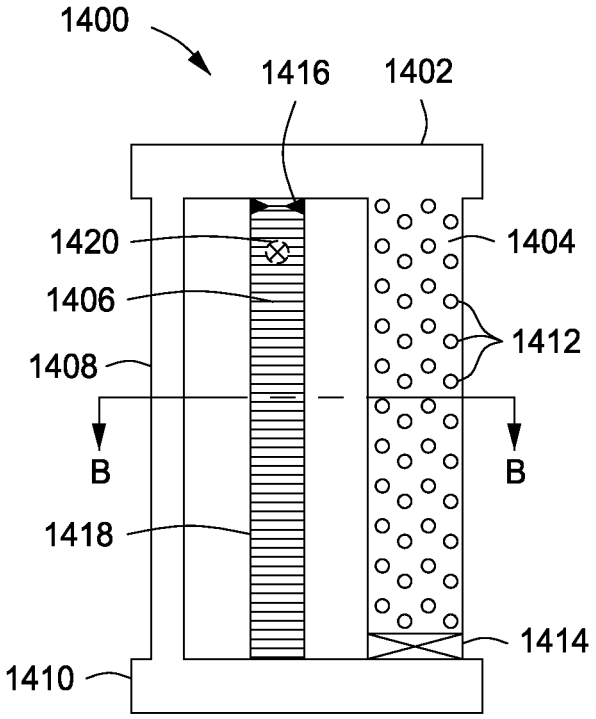
FIG. 14A is a side view of a gravel-packing assembly for providing back-up zonal isolation. The assembly defines a base pipe having shunt tubes there around.
Figure 14B:
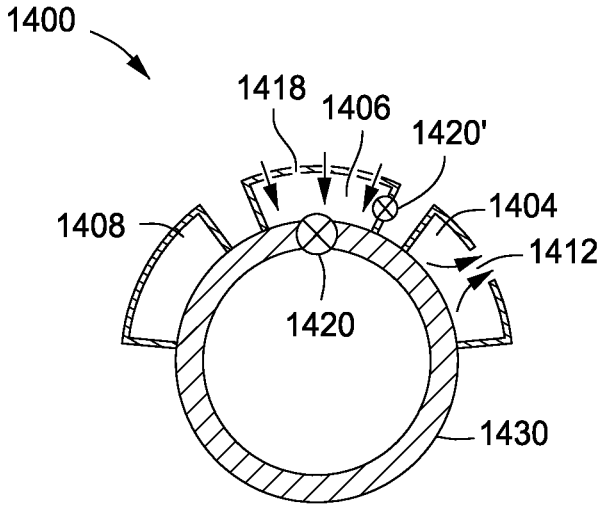
FIG. 14B is a cross-sectional view of the gravel-packing assembly of FIG. 14A, taken across line B-B of FIG. 14A.

FIGS. 14A and 14B present side and cross-sectional views of a gravel-packing assembly 1400 for providing back-up zonal isolation. The assembly defines a tubular body having an upstream manifold 1402 at a first end, and a downstream manifold 1410 at a second end. Intermediate the upstream manifold 1402 and the downstream manifold 1410 is an elongated base pipe 1430.

In operation, gravel slurry is pumped downhole until it reaches the upstream manifold 1402. The gravel slurry is then distributed through both a gravel packing conduit 1404 and a transport conduit 1408. The gravel packing conduit 1404 serves to deliver slurry into an annular region between the gravel-packing assembly 1400 and the surrounding wellbore (not shown), while the transport conduit 1408 delivers a portion of the gravel slurry further downhole. Thus, the gravel packing conduit 1404 and the transport conduit 1408 serve as classic shunt tubes.

The gravel packing conduit 1404 contains a number of leak-off ports 1412. As gravel slurry enters the gravel packing conduit, the slurry exits the ports 1412 and fills the annular space, typically from the bottom (or toe) of the well to the top (or heel) of the well. A plug 1414 prevents gravel slurry from bypassing the ports 1412.

The transport conduit 1408 moves slurry from the upstream manifold 1402 to the downstream manifold 1410. In this way, any sand bridges along the blank pipe 1430 are bypassed in a downstream flow path. Preferably, the transport conduit 1408 and the adjacent blank pipe 1430 run together in 40 foot sections.

The gravel-packing assembly 1400 also includes a leak-off conduit 1406. The leak-off conduit 1406 represents a wire-wrapped screen or other filtering arrangement. A restriction 1416 between the leak-off conduit 1406 and the upstream manifold 1402 minimizes the gravel slurry entering the leak-off conduit 1406 from the upstream manifold 1402. The leak-off conduit 1406 receives water (or carrier fluid) during the gravel-packing operation, and merges the water (or carrier fluid) with the gravel slurry in the downstream manifold 1410. Alternatively, the leak-off conduit 1406 may be in direct fluid communication with the transport conduit 1408 above the downstream manifold 1410. At the same time, the leak-off conduit 1406 filters out sand particles, leaving the gravel-pack in place around the blank pipe 1430.

The gravel-packing assembly 1400 is designed to threadedly connect to the base pipe of a section of sand screen at one end. At another end, the gravel-packing assembly 1400 is connected to a mechanically-set packer 600. The gravel-packing assembly 1400 at least partially restricts the flow of production fluids between production zones or geologic intervals in an open-hole wellbore. The gravel-based isolation system of the assembly 1400 may not be a primary isolation tool, but it does substantially restrict the flow in the event of failure of a cup-type element 655. Ideally, the gravel-packing assembly 1400 is at least 40 feet, and more preferably at least 80 feet, in order to provide optimum fluid isolation.

Additional details concerning the design and operation of gravel-based zonal isolation systems are found in WO Pat. Publ. No. 2010/120419. This application is incorporated herein by reference in its entirety.

While it will be apparent that the inventions herein described are well calculated to achieve the benefits and advantages set forth above, it will be appreciated that the inventions are susceptible to modification, variation and change without departing from the spirit thereof. Improved methods for completing an open-hole wellbore are provided so as to seal off one or more selected subsurface intervals. An improved zonal isolation apparatus is also provided. The inventions permit an operator to produce fluids from or to inject fluids into a selected subsurface interval.

What is claimed is:

1. A method for completing a wellbore in a subsurface formation, the method comprising:

providing a packer assembly having a first mechanically-set packer as a first zonal isolation tool, and a second zonal isolation tool, wherein each of the first and second zonal isolation tools comprises an internal bore for receiving production fluids, and alternate flow channels, and the first mechanically-set packer comprises:

an inner mandrel as the internal bore, the alternate flow channels along the inner mandrel, a movable piston housing external to the inner mandrel;

one or more flow ports providing fluid communication between the alternate flow channels and a pressure-bearing surface of the piston housing; and a sealing element external to the inner mandrel and in selectively movable engagement with the piston housing;

connecting the packer assembly to a sand screen, the sand screen comprising a base pipe, a surrounding filter medium, and alternate flow channels, wherein:

the base pipe has an inner bore in fluid communication with the internal bore of the first and second zonal isolation tools, and the alternate flow channels of the sand screen are in fluid communication with alternate flow channels of the first and second zonal isolation tools;

running the packer assembly and connected sand screen into the wellbore;

setting the first mechanically-set packer by communicating fluid pressure to the piston housing through the one or more flow ports to actuate the sealing element into engagement with the surrounding subsurface formation;

injecting a gravel slurry into the wellbore; and injecting the gravel slurry at least partially through the alternate flow channels to allow the gravel slurry to bypass the sealing element so that the wellbore is gravel-packed within an annular region between the sand screen and the surrounding formation below the packer assembly.

2. The method of claim 1, wherein the filtering medium of the sand screen comprises a wire-wrapped screen, a membrane screen, an expandable screen, a sintered metal screen, a wire-mesh screen, a shape memory polymer, or a pre-packed solid particle bed.

3. The method of claim 1, wherein the second zonal isolation tool is a gravel-based zonal isolation tool comprising:

an upstream manifold configured to receive the gravel slurry;

a gravel-packing conduit in fluid communication with the upstream manifold and extending longitudinally away from the upstream manifold, the gravel-packing conduit having a plurality of ports to place the gravel-packing conduit in fluid communication with an annulus between the second zonal isolation tool and the surrounding wellbore, and having a plug proximate a lower end of the gravel-packing conduit to isolate the gravel-packing conduit from a downstream flow path;

a transport conduit in fluid communication with the upstream manifold and in fluid communication with the downstream flow path, the transport conduit serving as the alternate flow channels for the second zonal isolation tool; and a leak-off conduit comprising permeable media in order to place the leak-off conduit in fluid communication with the annulus but filtering gravel-packing particles during a gravel-packing procedure, the leak-off conduit comprising a longitudinal tubular body in fluid communication with the downstream flow path.

4. The method of claim 3, wherein the gravel-based zonal isolation tool is at least 40 feet in length.

5. The method of claim 1, wherein the second zonal isolation tool comprises a second mechanically-set packer constructed in accordance with the first mechanically-set packer, and being arranged within the packer assembly as substantially a mirror image of the first mechanically-set packer.

6. The method of claim 1, wherein the second zonal isolation tool comprises a swellable packer adjacent the first mechanically-set packer.

7. The method of claim 1, wherein:

the second zonal isolation tool comprises a second mechanically-set packer constructed in accordance with the first mechanically-set packer; and the packer assembly further comprises a swellable packer intermediate the first and second mechanically-set packers, the swellable packer having alternate flow channels fluidly connected with the alternate flow channels of the first and second mechanically-set packers.

8. The method of claim 7, wherein the second mechanically-set packer is arranged within the packer assembly as substantially a mirror image of the first mechanically-set packer.

9. The method of claim 7, wherein the step of further injecting the gravel slurry through the alternate flow channels comprises bypassing the packer assembly so that the wellbore is gravel-packed above and below the packer assembly after the first and second mechanically-set packers have been set in the wellbore.

10. The method of claim 1, wherein the sand screen comprises:

a) a first conduit forming a primary flow path in fluid communication with the inner mandrel of the first mechanically-set packer, the first conduit having at least one section that is permeable and at least one section that is impermeable;

b) at least one shunt tube along the length of the first conduit, the at least one shunt tube being in fluid communication with one of the alternate flow channels of the first mechanically-set packer to transport gravel slurry;

c) a second conduit comprising a secondary flow joint, wherein the second conduit also has at least one section that is permeable and at least one section that is impermeable, and wherein one of the at least one permeable sections of the second conduit is in fluid communication with one of the at least one permeable sections of the first conduit, thereby providing fluid communication between the first and second conduits; and d) the filtering medium, the filtering medium being designed to retain particles larger than a predetermined size while allowing fluids to pass into the permeable sections of the first and second conduits.

11. The method of claim 10, wherein:

the filtering medium comprises a first filtering screen placed along the permeable sections of the first conduit, and a second filtering medium placed along the permeable sections of the second conduit; and the first conduit and the second conduit each comprises a tubular body having a cylindrical wall, with the first conduit and the second conduit running substantially parallel to one another within the wellbore.

12. The method of claim 11, wherein:

the second conduit is disposed concentrically within the first conduit; and at any cross-section location of the sand screen, the cylindrical wall of the first conduit or the second conduit is impermeable, while the cylindrical wall of the other one of the first conduit or the second conduit is permeable.

13. The method of claim 12, wherein the sand screen further comprises:

at least one wall inside the first conduit to form at least one compartment in the first conduit, wherein the compartment has at least one inlet and at least one outlet; and wherein the at least one compartment is adapted to accumulate particles in the compartment to progressively increase resistance to fluid flow through the compartment in the event the at least one inlet is impaired and allows particles larger than a predetermined size to pass into the compartment.

14. The method of claim 1, wherein the sand screen comprises:

a first tubular member having a permeable section and a non permeable section, the permeable section defining the filtering medium;

a second tubular member disposed within the first tubular member, the second tubular member defining the base pipe, wherein the second tubular member has a plurality of openings and at least one inflow control device that each provide a flow path to an inner bore within the second tubular member; and a sealing mechanism disposed between the first tubular member and the second tubular member.

15. The method of claim 14, further comprising:

activating the sealing mechanism to direct the flow of production fluids through the inflow control device and into the inner bore.

16. The method of claim 15, wherein:

the sealing mechanism comprises a swellable material disposed adjacent a non-permeable section; and activating the sealing mechanism comprises allowing the swellable material to contact production fluids during production operations, thereby allowing the swellable material to swell so as to seal an annular region between the second tubular member and the surrounding first tubular member.

17. The method of claim 16, wherein the inflow control device comprises a choke, a rotating sleeve, a sliding sleeve, or an elongated conduit placed between the second tubular member and the surrounding first tubular member.

18. The method of claim 1, wherein:

the wellbore has a lower end defining an open-hole portion;

running the packer assembly and sand screen into the wellbore along the open-hole portion; and setting the packer within the open-hole portion of the wellbore.

19. The method of claim 18, wherein the sand screen and the base pipe are made up of a plurality of joints.

20. The method of claim 19, wherein:

the second zonal isolation tool comprises a second mechanically-set packer constructed in accordance with the first mechanically-set packer, and being arranged within the packer assembly as substantially a mirror image of the first mechanically-set packer.

21. The method of claim 20, further comprising:

running a setting tool into the inner mandrel of the first and second mechanically-set packers;

manipulating the setting tool to mechanically release a movable piston housing from a retained position along each of the first and second mechanically-set packers; and communicating hydrostatic pressure to the piston housings through the one or more flow ports, thereby moving the released piston housings and actuating the respective sealing elements against the surrounding wellbore.

22. The method of claim 21, wherein:

each of the first and second mechanically-set packers further comprises a release sleeve along an inner surface of the respective inner mandrels; and manipulating the setting tool comprises pulling the setting tool through the inner mandrels to shift the respective release sleeves.

23. The method of claim 22, wherein shifting the release sleeve shears at least one shear pin along the respective inner mandrels.

24. The method of claim 23, wherein:

running the setting tool comprises running a washpipe into a bore within the inner mandrel of the each of the first and second mechanically-set packers, the washpipe having the setting tool thereon; and releasing the movable piston housing from the retained position comprises pulling the washpipe with the setting tool along an inner mandrel, thereby shifting the release sleeves and shearing the at least one shear pin within each of the first and second mechanically-set packers.

25. The method of claim 21, wherein the sealing element of each of the first and second mechanically-set packers is an elastomeric cup-type element.

26. The method of claim 21, wherein:

each of the first and second mechanically-set packers further comprises a centralizer; and releasing the piston housing further actuates the centralizer into engagement with the surrounding open-hole portion of the wellbore.

27. The method of claim 26, wherein communicating hydrostatic pressure to the piston housing moves the piston housing to actuate the centralizer, which in turn actuates the sealing element of each of the first and second mechanically-set packers against the surrounding subsurface formation.

28. The method of claim 21, further comprising:

producing formation fluids through the inner bore of the sand screen and through the inner mandrel of each of the first and second mechanically-set packers from a subsurface formation below the packer assembly.

29. A method for completing a wellbore, the wellbore having a lower end defining an open-hole portion, and the method comprising:

running a gravel pack zonal isolation apparatus into the wellbore, the zonal isolation apparatus comprising:

a sand control device having:

an elongated base pipe, a filter medium circumferentially surrounding at least a portion of the base pipe, and at least one alternate flow channel along the base pipe; and at least one packer assembly, each of the at least one packer assembly comprising:

a first mechanically set packer having an upper sealing element, a second mechanically set packer having a lower sealing element, each of the first and second mechanically set packers comprises;

a movable piston housing external to the elongated base pipe;

one or more flow ports providing fluid communication between the alternate flow channels and a pressure-bearing surface of the piston housing, the piston housing in selectively movable engagement with the respective sealing element;

a swellable packer element between the upper sealing element and the lower sealing element that swells over time in the presence of a fluid, and one or more alternate flow channels along the first mechanically-set packer, the swellable packer element, and the second mechanically-set packer to permit a gravel pack slurry to by-pass the at least one packer assembly;

positioning the zonal isolation apparatus in the open-hole portion of the wellbore;

setting each of the first and second mechanically-set packers by communicating fluid pressure to each selectively movable piston housing through the one or more flow ports to actuate the respective sealing element into engagement with the surrounding open-hole portion of the wellbore;

injecting a gravel slurry into an annular region formed between the sand control device and the surrounding open-hole portion of the wellbore;

further injecting the gravel slurry through the alternate flow channels to allow the gravel slurry to bypass the at least one packer assembly so that the open-hole portion of the wellbore is gravel-packed above and below the at least one packer assembly after the packer has been set in the wellbore.

30. The method of claim 29, wherein positioning the zonal isolation apparatus comprises positioning the zonal isolation apparatus such that a first of the at least one packer assembly is above or proximate the top of a selected subsurface interval.

31. The method of claim 29, wherein each of the first and second mechanically-set packers further comprises:

an inner mandrel;

a movable piston housing around the inner mandrel; and one or more flow ports providing fluid communication between the alternate flow channels and a pressure-bearing surface of the piston housing.

32. The method of claim 31, wherein the sealing elements are elastomeric cup-type elements.

33. The method of claim 32, wherein:

each of the first and second mechanically-set packers further comprises a centralizer; and moving the respective piston housings further actuates the respective centralizers into engagement with the surrounding open-hole portion of the wellbore.

34. The method of claim 33, further comprising:

actuating the respective centralizers in the mechanically-set packers into engagement with the surrounding wellbore by applying hydrostatic pressure to the respective piston housings.

35. The method of clam 34, wherein applying hydrostatic pressure to the piston housings moves the respective piston housings to act on the respective centralizers, which in turn actuates the upper and lower sealing elements against the surrounding wellbore.

36. The method of claim 31, further comprising:

running a setting tool into the inner mandrel of the first and second mechanically-set packers;

moving the setting tool along the inner mandrels, thereby releasing the movable piston housing on each of the first and second mechanically-set packers; and communicating hydrostatic pressure to the piston housings through the one or more flow ports, thereby allowing the respective piston housings to slide, and thereby actuating the respective upper and lower sealing elements against the surrounding wellbore.

37. The method of claim 36, wherein releasing the movable piston housings comprises shifting respective release sleeves in the first and second mechanically-set packers by pulling the setting tools along the inner mandrels.

38. The method of claim 29, wherein the elongated base pipe comprises multiple joints of pipe connected end-to-end.

39. The method of claim 38, further comprising:

producing hydrocarbon fluids from the open-hole portion of the wellbore.

40. The method of claim 39, further comprising:

permitting fluids to contact the swellable packer element in at least one of the at least one packer assembly; and wherein the swellable packer element comprises a material that swells (i) in the presence of an aqueous liquid, (ii) in the presence of a hydrocarbon liquid, or (iii) combinations thereof.

41. The method of claim 40, wherein:

positioning the zonal isolation apparatus comprises positioning the zonal isolation apparatus such that a first of the at least one packer assembly is above or proximate the top of a selected subsurface interval; and a second of the at least one packer assembly is set proximate a lower boundary of the selected subsurface interval.

42. The method of claim 41, further comprising:

running a tubular string into the wellbore and into the base pipe, the tubular string having a straddle packer at a lower end; and setting the straddle packer across the selected subsurface interval.

43. The method of claim 42, wherein the open-hole portion comprises the selected subsurface interval, and an additional subsurface interval adjacent the selected subsurface interval;

an upper end of the straddle packer is set adjacent the first packer assembly;

a lower end of the straddle packer is set adjacent the second packer assembly; and producing production fluids from the open-hole portion of the wellbore comprises:

producing production fluids from the selected subsurface interval and the additional subsurface interval for a period of time; and continuing to produce from the additional subsurface interval after the straddle packer is in place.

44. The method of claim 43, further comprising:

determining that the selected subsurface interval has become saturated with an aqueous or gaseous fluid after producing for the period of time.

45. The method of claim 43, wherein the additional subsurface interval comprises a lower interval below the selected subsurface interval.

46. The method of claim 43, wherein the additional subsurface interval comprises an upper interval above the selected interval.

47. The method of claim 46, wherein:

the open-hole portion further comprises a lower interval below the selected subsurface interval; and producing production fluids further comprises producing production fluids from the lower interval, the selected subsurface interval, and the upper interval for the period of time, and continuing to produce production fluids from the lower interval along with the upper interval after the straddle packer is in place.

48. The method of claim 40, wherein:

the open-hole portion comprises a selected subsurface interval, and an additional subsurface interval below the selected subsurface interval representing a lower interval;

producing hydrocarbon fluids comprises producing hydrocarbon fluids from at least the lower interval for a period of time;

positioning the zonal isolation apparatus comprises positioning the zonal isolation apparatus such that the at least one packer assembly is above or proximate the top of the lower interval; and the method further comprises setting a plug within a base pipe to seal off production from the lower interval and up into the base pipe along the selected interval.

49. The method of claim 48, wherein the plug is set adjacent the at least one packer assembly.

50. The method of claim 48, wherein:

the open-hole portion further comprises an additional subsurface interval between the selected subsurface interval and the lower interval representing an intermediate interval;

the intermediate interval is made up of a rock matrix that is substantially impermeable to fluid flow; and the plug is set adjacent the at least one packer assembly or along the intermediate interval.

51. A gravel pack zonal isolation apparatus, comprising:

a sand control device having:

an elongated base pipe extending from a first end to a second end, at least one alternate flow channel along the base pipe extending from the first to the second end, and a filter medium radially surrounding the base pipe along a substantial portion of the base pipe so as to form a sand screen; and at least one packer assembly, each of the at least one packer assembly comprising:

an upper mechanically-set packer having a sealing element, and a lower mechanically-set packer having a sealing element, wherein:

the upper packer and the lower packer each comprises at least one alternate flow channel in fluid communication with the at least one alternate flow channel in the sand control device to divert gravel pack slurry past the upper mechanically set packer and the lower mechanically set packer during a gravel-packing operation; and each of the upper packer and lower packer comprises:

an inner mandrel, a movable piston housing retained around the inner mandrel, one or more flow ports providing fluid communication between the alternate flow channels and a pressure-bearing surface of the piston housing, a release sleeve along an inner surface of the inner mandrel, the release sleeve being configured to move in response to movement of a setting tool within the inner mandrel and thereby expose the one or more flow ports to hydrostatic pressure during the gravel-packing operation.

52. The apparatus of claim 51, wherein the filter medium for the sand screen comprises wound wires, a wire mesh, or combinations thereof.

53. The apparatus of claim 52, further comprising:

a swellable packer intermediate the upper mechanically-set packer and the lower mechanically-set packer, the swellable packer having an element that swells over time in the presence of a fluid; and wherein the swellable packer comprises at least one alternate flow channel in fluid communication with the at least one alternate flow channel in the upper mechanically set packer and the lower mechanically set packer to divert gravel pack slurry past the upper mechanically set packer and the lower mechanically set packer during a gravel-packing operation.

54. The apparatus of claim 53, wherein the swellable packer element is at least partially fabricated from an elastomeric material.

55. The apparatus of claim 54, wherein the swellable elastomeric packer element is about 3 feet (0.91 meters) to about 40 feet (12.2 meters) in length.

56. The apparatus of claim 53, wherein the swellable elastomeric packer element comprises a material that swells (i) in the presence of an aqueous liquid, (ii) in the presence of a hydrocarbon liquid, (iii) in the presence of an actuating chemical, or (iv) combinations thereof.

57. The apparatus of claim 52, wherein the element for the first mechanically set packer and the element for the second mechanically set packer is each about 6 inches (15.2 cm) to 24 inches (61 cm) in length.

58. The apparatus of claim 57, wherein the elements for the first and second mechanically set packer elements are elastomeric cup-type elements.

59. The apparatus of claim 52, wherein the alternate flow channels reside external to the filter medium.

60. The apparatus of claim 52, wherein the alternate flow channels reside internal to the filter medium.

61. The apparatus of claim 52, wherein the sand screen comprises:

a) a first conduit forming a primary flow path in fluid communication with the inner mandrels of the upper and lower packers, the first conduit having at least one section that is permeable and at least one section that is impermeable;

b) at least one shunt tube along the length of the first conduit, the at least one shunt tube being in fluid communication with one of the alternate flow channels of the upper and lower packers to transport gravel slurry;

c) a second conduit comprising a secondary flow joint, wherein the second conduit also has at least one section that is permeable and at least one section that is impermeable, and wherein one of the at least one permeable sections of the second conduit is in fluid communication with one of the at least one permeable sections of the first conduit, thereby providing fluid communication between the first and second conduits; and d) the filter medium, the filter medium being designed to retain particles larger than a predetermined size while allowing fluids to pass into the permeable sections of the first and second conduits.

62. The apparatus of claim 61, wherein:

the filter medium comprises a first filtering screen placed along the permeable sections of the first conduit, and a second filtering medium placed along the permeable sections of the second conduit; and the first conduit and the second conduit each comprises a tubular body having a cylindrical wall, with the first conduit and the second conduit running substantially parallel to one another within the wellbore.

63. The apparatus of claim 62, wherein:

the second conduit is disposed concentrically within the first conduit; and at any cross-section location of the sand screen, the cylindrical wall of the first conduit or the second conduit is impermeable, while the cylindrical wall of the other one of the first conduit or the second conduit is permeable.

64. The apparatus of claim 63, wherein the sand screen further comprises:

at least one wall inside the first conduit to form at least one compartment in the first conduit, wherein the compartment has at least one inlet and at least one outlet; and wherein the at least one compartment is adapted to accumulate particles in the compartment to progressively increase resistance to fluid flow through the compartment in the event the at least one inlet is impaired and allows particles larger than a predetermined size to pass into the compartment.

65. The apparatus of claim 52, wherein the sand control device comprises:

a first tubular member having a permeable section and a non permeable section, the permeable section defining the filtering medium;

a second tubular member disposed within the first tubular member, the second tubular member defining the base pipe, wherein the second tubular member has a plurality of openings and at least one inflow control device that each provide a flow path to an inner bore within the second tubular member; and a sealing mechanism disposed between the first tubular member and the second tubular member.

66. The apparatus of claim 51, wherein the elongated base pipe comprises multiple joints of pipe connected end-to-end.

67. The apparatus of claim 51, wherein at least one of the at least one packer assembly is placed at the first end of the sand control device.

68. The apparatus of claim 51, wherein at least one of the at least one packer assembly is placed between two joints of the elongated base pipe intermediate the first and second ends.

69. The apparatus of claim 51, wherein:

the elongated base pipe comprises multiple joints of pipe connected end-to-end forming the first end of the sand control device and a second end of the sand control device; and the gravel pack zonal isolation apparatus comprises an upper packer assembly placed at the first end of the sand control device, and a lower packer assembly placed at the second end of the sand control device.

70. The apparatus of claim 69, wherein the upper packer assembly and the lower packer assembly are spaced apart along the joints of pipe so as to straddle a selected subsurface interval within a wellbore.

71. The apparatus of claim 51, further comprising:

drilling a wellbore through the subsurface formation using a drilling fluid;

conditioning the drilling fluid;

running the packer assembly and connected sand screen into the wellbore in the conditioned drilling fluid;

displacing the conditioned drilling fluid in the wellbore with a displacement fluid.

72. The apparatus of claim 71 wherein the drilling fluid is an oil-based fluid.

73. The apparatus of claim 71 wherein the drilling fluid is a water-based fluid.

74. The apparatus of claim 71, wherein the displacement fluid comprises at least one of the carrier fluid and another fluid.

75. The apparatus of claim 71 wherein the drilling fluid is conditioned to remove a pre-determined larger-than size of solids.

76. The apparatus of claim 71 wherein the gravel slurry comprises a carrier fluid and gravel.

77. The apparatus of claim 71 wherein the carrier fluid has favorable rheology for effectively displacing the conditioned drilling fluid and is a fluid viscosified with xanthan polymer, HEC polymer, visco-elastic surfactant, or any combination thereof.

* * * * *